US010787821B2

(12) United States Patent
Zhang et al.

(10) Patent No.: US 10,787,821 B2
(45) Date of Patent: Sep. 29, 2020

(54) LOCKING TYPE PANEL AND PANEL CONNECTING PIECE AND CONNECTION METHOD THEREFOR

(71) Applicants: Jiaming Zhang, Longtan Township (TW); Beijia Xu, Longtan Township (TW); Qihui Zhang, Longtan Township (TW)

(72) Inventors: Jiaming Zhang, Longtan Township (TW); Beijia Xu, Longtan Township (TW); Qihui Zhang, Longtan Township (TW)

( * ) Notice: Subject to any disclaimer, the term of this patent is extended or adjusted under 35 U.S.C. 154(b) by 702 days.

(21) Appl. No.: 14/367,132

(22) PCT Filed: Dec. 19, 2012

(86) PCT No.: PCT/CN2012/001714
§ 371 (c)(1),
(2) Date: Jun. 19, 2014

(87) PCT Pub. No.: WO2013/091284
PCT Pub. Date: Jun. 27, 2013

(65) Prior Publication Data

US 2015/0040508 A1 Feb. 12, 2015

(30) Foreign Application Priority Data

Dec. 21, 2011 (CN) ..... 2011 1 0431111

(51) Int. Cl.
*E04F 15/02* (2006.01)
*E04F 13/00* (2006.01)

(52) U.S. Cl.
CPC .. *E04F 15/02005* (2013.01); *E04F 15/02038* (2013.01); *E04F 15/02044* (2013.01);
(Continued)

(58) Field of Classification Search
CPC ..... E04F 15/02; E04F 15/02005; E04F 15/02038; E04F 15/02044; E04F 15/04;
(Continued)

(56) References Cited

U.S. PATENT DOCUMENTS 2,269,926 A * 1/1942 Crooks ..... E04F 15/04 52/390
4,716,704 A * 1/1988 Murr ..... E04F 19/065 52/471

(Continued)

*Primary Examiner* — Patrick J Maestri
*Assistant Examiner* — Joseph J. Sadlon
(74) *Attorney, Agent, or Firm* — Wag Law Firm, Inc.

(57) ABSTRACT

A flooring system includes multiple panels (10) which are connected to each other by connectors (20). Each panel (10) has a tongue (30) and each connector (20) has an engaging slot (40). The tongue (30) does not extend beyond the side of the panel (10). The panel (10) is moved horizontally to insert the lower protrusion (300) of the tongue (30) into the lower recess (400) of the engaging slot (40) of the connector (20). The inner inclined face (302) of the lower protrusion (300) of the tongue (30) contacts the curved wall (410) of the lower recess (400) of the connector (20). The tongue (30) of the panel (10) is engaged with the engaging slot (40) of the connector (20) by way of pressing the panel in a direction perpendicular to the panel. No hammering to the side of the panel is needed.

11 Claims, 32 Drawing Sheets

(52) U.S. Cl.
CPC ..... *E04F 2015/0205* (2013.01); *E04F 2201/0115* (2013.01); *E04F 2201/041* (2013.01); *E04F 2201/0517* (2013.01)

(58) Field of Classification Search
CPC ..... E04F 2015/0205; E04F 2201/0115; E04F 2201/0138; E04F 2201/041; E04F 2201/0511; E04F 2201/0517
USPC ..... 52/384, 385, 386, 387, 582.1, 584.1, 52/586.1, 585.1, 745.05
See application file for complete search history.

(56) References Cited

U.S. PATENT DOCUMENTS 5,570,554 A * 11/1996 Searer ..... E04F 15/02033 52/539
5,791,111 A * 8/1998 Beenders ..... E04B 1/6804 404/67
6,141,931 A * 11/2000 Simmons ..... E04F 15/02005 16/16
6,449,918 B1 * 9/2002 Nelson ..... E04F 15/04 52/570
6,647,690 B1 * 11/2003 Martensson ..... E04F 15/02005 52/601
6,763,643 B1 * 7/2004 Mårtensson ..... E04F 15/02 52/403.1
6,925,764 B2 * 8/2005 Hrovath ..... E04F 13/0862 52/390
7,677,001 B2 * 3/2010 Pervan ..... E04F 15/02 52/390
7,757,452 B2 * 7/2010 Pervan ..... B27F 1/02 52/582.1
8,161,702 B2 * 4/2012 Eberle, III ..... E04F 15/04 403/231
8,266,863 B2 * 9/2012 Knauseder ..... E04F 15/02 403/293
8,281,549 B2 * 10/2012 Du ..... E04F 15/02038 52/591.1
8,464,489 B2 * 6/2013 Pervan ..... B44C 1/28 52/589.1
8,505,257 B2 * 8/2013 Boo ..... B27F 1/02 52/582.1
8,544,231 B2 * 10/2013 Hannig ..... E04F 15/02 52/588.1
8,726,513 B2 * 5/2014 Braun ..... B27F 5/02 144/371
8,782,989 B2 * 7/2014 Tang ..... E04F 15/02005 52/589.1
8,833,026 B2 * 9/2014 Devos ..... E04F 13/0894 52/582.2
8,978,336 B2 * 3/2015 Perra ..... E04F 15/02 52/530
8,993,098 B2 * 3/2015 Masanek, Jr. ..... B29C 45/34 264/273
2002/0124506 A1 * 9/2002 Mercade ..... E04F 15/10 52/390
2009/0041987 A1 * 2/2009 Schitter ..... B32B 3/06 428/172
2011/0045250 A1 * 2/2011 De Zen ..... B29C 47/0019 428/168

* cited by examiner

LOCKING TYPE PANEL AND PANEL CONNECTING PIECE AND CONNECTION METHOD THEREFOR

FIELDS OF THE INVENTION

The present invention relates to a connector for interlocking floor panels, and more particularly, to the floor panels having tongues on the sides thereof, and to the connector having grooves in the sides, the tongues are engaged with the grooves to connect the floor panels.

BACKGROUND OF THE INVENTION

The interlocking floor panels are used for a long period of time and which are easily connected to each other. The technique is developed further so that the interlocking panels can be used to decorate the wall by connecting the panels to each other and secured on the wall.

There are two catalogues for the connection of the floor panels, the first is that the floor panels each have tongue and groove formed on the cooperated sides thereof so that the floor panels can be connected to each other by engaging the tongues with the grooves. The second is to use a connector which is located between the panels so as to connect the floor panels.

For the first catalogue, CN 97190692.0 and U.S. Pat. No. 6,874,292 to Unilin Beheer BV disclose the floor panels that have a connection portion composed of a tongue and a groove in the opposite sides thereof, and a mechanical locking device is connected to the connection portion so that the floor panels do not disengaged upwardly from reach other in the direction that is perpendicular to the relative sides, and in the direction that is parallel to the underside of the panels. There are two tools are required when manufacturing the panels and the equipment for manufacturing the panels is required to have higher standard. When assembling the panels, the assemblers have to choose the installation direction and this is an inconvenient requirement for the assemblers. The obvious disadvantage is that, in order to have the tongues and the grooves, a certain width of the material of the board has to be discarded. If the material that is discarded for making the tongues and the grooves reaches 10% of the whole width of the board, this means that 10% of the floor area composed of the panels is disappeared. This also means that the manufacturing cost increases 10%. It is also a waste for the natural source.

The second catalogue uses a connector to connect the panels, the connector is made to have symmetrical structure, and the panels have the same structure on the sides to be cooperated with the connector. That is to say, the panels have grooves on the sides, and the connector has tongues on the sides, so that the tongues are engaged with the grooves. China Patent Application No. 200910304656.1 discloses a connector with a tongue on each of two sides thereof, and the tongue has an engaging piece on the top and the bottom thereof. The panels has a groove in each of the sides thereof and each of the grooves has a notch which is shaped to be engaged with the engaging piece. When assembling, the two tongues of the connector are respectively engaged with the grooves of the two connected panels. Theoretically, the connection is by using the connector meets the requirement for connecting the panels. However, it is difficult to make the notch in the groove the same time when forming the groove. The existed equipment cannot make the groove and the notch in one action, wherein the notch is perpendicular to the groove. Besides, after the panels are connected to each other, the locking force in the horizontal direction is made by the flexibility of the material of the connector. If the flexibility of the material of the connector is not strong enough, the locking force in the horizontal direction is not sufficient. If the material for the connector has larger flexibility, when assembling the panels, the assembler has to hammer the other side of the panel to force the connection portions of the panels and the connector to be deformed, so that the connector is connected between the panels. This causes difficulties when assembling and disassembling. Furthermore, the hammering action may damage the groove of the hammered sides of the panels.

U.S. Pat. Nos. 6,460,306, 7,614,791 and China Utility Model ZL 02249916.4 306 disclose a similar connector for connecting floor panels, and the connector has two tongues in opposite directions. A base board is connected to the underside of the connector and is connected to the connector by an upright board. The base board has a flange on each of two sides thereof. The panels has a groove in two opposite sides thereof and a positioning slot is defined in the underside of each of the two sides of the panel. The tongues are engaged with the grooves of the panels, and the flanges are engaged with the positioning slots so as to connect the panels. The connection between the tongues and the grooves provides the locking feature in the vertical direction, and the connection between the flanges and the positioning slots provides the locking feature in the horizontal direction, so that the connection between the panels is secure and reliable. However, in order to engage flanges with the positioning slots, the panel has to be tilt so that the side to be connected is positioned to be over the flange so as to be connected with the connector. This is inconvenient for the assemblers because when the long sides of the panels are connected to each other, and the short sides are then to be connected. However, the connected long sides cannot be tilt so that the short side cannot be connected to each other. To improve this problem, the short side can only use a horizontal groove to be connected with each other, and the horizontal groove cannot provide a secure locking feature.

U.S. Pat. No. 6,769,217 discloses an interconnecting disengageable flooring system wherein the base board on the underside of the connector does not have the positioning ridge, so that the panels can be horizontally connected to each other. Nevertheless, an engaging slot is required in the base board or the underside of the connector, and the panel has an engaging member in the groove or on the underside thereof. Furthermore, the assembling action has to hammer from the other side of the panels to force the connection portion between the connector and the panel to be deformed slightly, such that the panels can be successfully connected to each other. Again, the similar disadvantages mentioned above are existed.

The present invention intends to provide a connector for interlocking floor panels and the floor panels, eliminate the shortcomings mentioned above.

SUMMARY OF THE INVENTION

The present invention relates to a flooring system and comprises multiple panels connected to each to other. Each panel has a first surface, a second surface which is located corresponding to the first surface and at least three sides. At least two sides of the panel each have a tongue. The panels each have a groove defined in one side thereof, and each groove has an inner side. A top protrusion extends outward from the side having the groove and is located above the groove. Each top protrusion has an end face and a bottom face. The second surface of each panel has a slot defined in the side having the tongue. Each slot has an inside which faces the side having the slot. A tongue is formed between the groove and the slot. Each tongue has a lower protrusion. Each tongue has a tongue top face which faces the groove. Each tongue has a tongue outer face which faces the side having the groove. The tongue outer face does not protrude beyond the end face of the top protrusion. An outer curved face is formed on an outside of the lower protrusion and connected to the tongue outer face. An inner curved face is formed on an inside of the lower protrusion and faces the slot.

At least one first stepped portion is formed between the tongue top face and the inner side. Each of the at least one first stepped portion has an engaging face on a top thereof. Each of the at least one first stepped portion has a contact face facing the side having the groove.

Preferably, the first stepped portion and a second stepped portion are formed between the tongue top face and the inner side. The first stepped portion has the engaging face on the top thereof and the contact face on the side thereof. The second stepped portion has an engaging face on a top thereof and a contact face on the side thereof.

Preferably, the first stepped portion extends from an area between the tongue top face and the inner side of the groove. The first stepped portion has the engaging face on the top thereof. The tongue has a lower protrusion. A top recess is formed between the tongue outer face and the inner curved face of the lower protrusion. A top curved face is connected between an outside of the top recess and the tongue outer face. An outer curved face is connected between an inside of the top recess and the inner curved face.

Preferably, the outer curved face of the lower protrusion is a curved face.

Preferably, the outer curved face of the lower portion is an curved face.

Preferably, the inner curved face of the lower protrusion is a curved face.

Preferably, the inner curved face of the lower protrusion is an curved face.

Preferably, the tongue has a resilient slot defined in an underside thereof.

Preferably, the connector is an elongate connector and has a symmetric top end. The connector has a base board on a lower end thereof. An upright portion extends from the base board. The base board has a bottom face and two side faces. The base board has a locking member on a top of each of the two sides thereof. A locking piece extends laterally from each of two sides of the upright portion. The locking piece has a side face. The upright portion has a top face. An engaging slot is defined between the locking piece of the upright portion and the locking member of the base board. The engaging slot defines a top wall in a bottom of the locking piece. The upright portion has an inside wall formed in each of two sides thereof. The base board has a lower recess defined in a top face of each of two sides thereof. The locking member is located between the lower recess and the side face. The locking member has a wedge-shaped cross section. The lower recess has an curved wall formed at the inside of the locking member. A first ridge extends between the top wall and the inside wall. The first ridge has an engaging face formed at the underside thereof and a contact face formed at a side thereof.

Preferably, the first ridge and the second ridge are formed between the top wall and the inside wall. The first ridge has the engaging face formed at the underside thereof and the contact face formed at the side thereof. The second ridge has an engaging face formed at an underside thereof and a contact face formed at a side thereof.

Preferably, a top bump is formed between the inside wall and the curved wall of the lower recess. A side curved face is connected between the outside of the top bump and the curved wall. A top curved face is connected between the top of the top bump and the inside wall.

Preferably, a notch is defined between the side curved face and the top curved face.

Preferably, the upright portion has multiple grooves defined in the top face thereof.

Preferably, the top face of the connector has a main groove and a groove is defined in an inner end of the main groove.

Preferably, the top face of the connector has a central groove which allows the locking piece to be resiliently deformed.

Preferably, the bottom face of the base board has multiple grooves extending along a longitudinal direction of the connector.

Preferably, the outside of the locking member has an curved guide face which is located between a top most point of the locking member and the side face.

Preferably, the distance between the two side faces of the two locking pieces of the upright portion of the connector is smaller than that between the side faces of the bottom face of the base board.

Preferably, a space is defined between the base board of the connector and the upright portion. Another space is defined between the upright portion and the locking piece.

Preferably, a curved face is formed between the side face of the locking piece of the connector and the top wall. Another curved face is formed between the engaging face of the first ridge of the connector and the contact face.

Preferably, two sides of the side face of the base board of the connector are recessed sides.

Preferably, a curved face is formed between the first surface of the panel and the end face.

Preferably, a curved face is formed between end face of the top protrusion of the panel and the bottom face.

Preferably, a curved face is formed between the engaging face of the first stepped portion of the panel and the contact face. Another curved face is formed between the tongue top face of the tongue of the panel and the tongue outer face.

Preferably, a buffering layer is attached to the engaging slot of the connector and the buffering layer is made by a material that is softer than that of the connector.

Preferably, the buffering layer is attached on the curved wall, the side curved face, the top curved face, the inside wall, the engaging face and the top wall.

Preferably, the buffering layer is attached on the side face of the locking piece.

Preferably, the top face of the locking piece of the connector has a buffering plate extending from the center thereof.

Preferably, the method for connecting the panels by using the connectors system the following steps:

step a: The panel having the tongue are moved toward the connector having the engaging slot on the same plane with the panel. The outer curved face of the tongue of the panel contacts the base board of the connector.

step b: The panel are moved and the outer curved face of the tongue of the panel is lifted upward by the base board of the connector.

step c: The panel is moved and the lowest point of the lower protrusion of the tongue is moved over the highest point of the locking member of the connector. The lower protrusion of the tongue is moved into the lower recess of the engaging slot of the connector.

step d: The panel is moved and the tongue outer face of the tongues contacts the contact face of the first ridge of the connector until the panel is not able to move further. The lower protrusion of the tongue is located within the lower recess of the engaging slot of the connector. The inner curved face of the lower protrusion of the tongue contacts the curved wall of the lower recess of the connector.

step e: The side of the first surface of the panel that is lifted up is pressed toward the second surface so as to engage the tongue of the panel with the engaging slot of the connector.

The panels of the present invention does not need to be lift up so that the same tongue can be installed to the long side and the short side of the panel, and the same groove can be defined in the long side and the short side of the panel. In other words, the manufacturers need only one blade/tool to make the groove in the long side and the short side of the panel. The connector is extruded as long as the shape of the connector is formed correspondent to the groove of the panel. The connector can be made by engineering plastic, polymer material, wood and metal alloy. The connector is extruded and cut into pieces as desired. The panels of the present invention can be assembled to show different patterns and arrangements. The engagement of the tongues and the grooves are made by pressing the panels so that no hammering action is needed to one side of the panels, so that the panels are not damaged by hammering.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
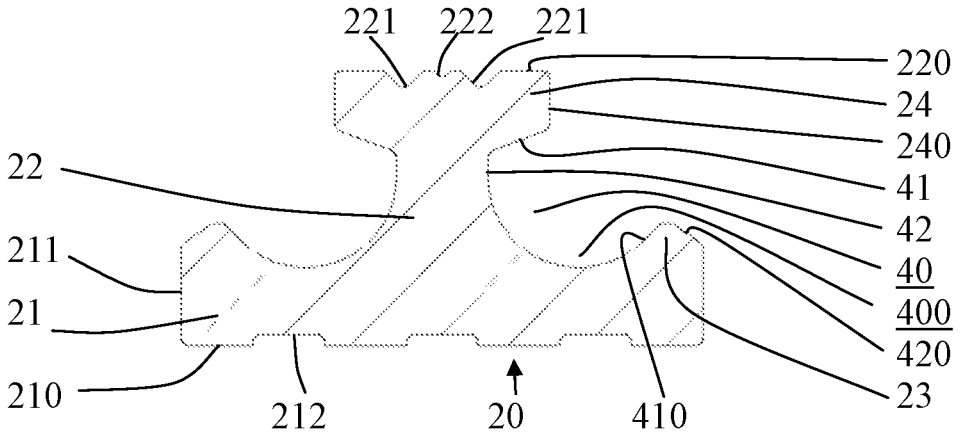
FIG. 1 is a cross sectional view of the connector of the present invention.
Figure 2:
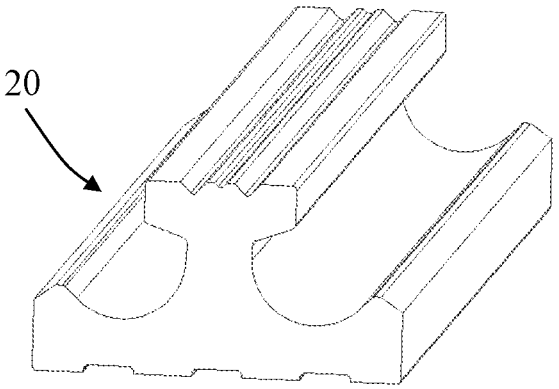
FIG. 2 is a perspective view to show the connector of the present invention.

Referring to FIGS. 1 to 2, the first embodiment of the connector 20 for connecting the panels 10 of the present invention is an elongate connector 20 which is an inverted T-shaped connected when viewed from either end thereof. The left portion and the right portion of the connector 20 are symmetric to each other. The connector 20 comprises a base board 21 on the lower end thereof, and an upright portion 22 extends from the base board 21. The base board 21 has a bottom face 210 and two side faces 211. The base board 21 of the connector 20 has a locking member 23 on the top of each of the two sides thereof. A locking piece 24 extends laterally from each of two sides of the upright portion 22. The locking pieces 24 each have a side face 240. The upright portion 22 has a top face 220, in this embodiment, there are two grooves 221 defined in the top face 220, and another groove 222 is located between the two grooves 221, wherein the two grooves 221 is deeper than the groove 222. An engaging slot 40 is defined between the locking piece 24 of the upright portion 22 and the locking member 23 of the base board 21. The engaging slot 40 defines a top wall 41 in the bottom of the locking piece 24. The upright portion 22 has an inside wall 42 formed in each of two sides thereof. The base board 21 has a lower recess 400 defined in the top face of each of two sides thereof. The locking member 23 is located between the lower recess 400 and the side face 211. The locking member 23 has a wedge-shaped cross section. The lower recess 400 has a curved wall 410 formed at the inside thereof and facing the locking member 23.

Three grooves 212 are defined along the longitudinal direction in the bottom face 210 of the base board 21.

Figure 3:
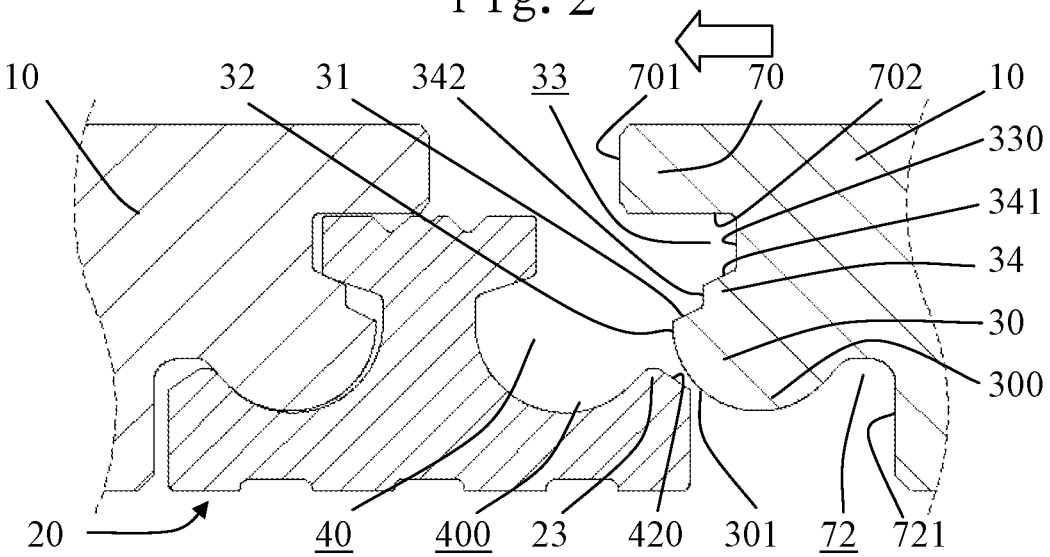
FIGS. 3, 4, 5, 6, 8 are cross sectional views to show the actions to connect the panels by the connector.
Figure 4:
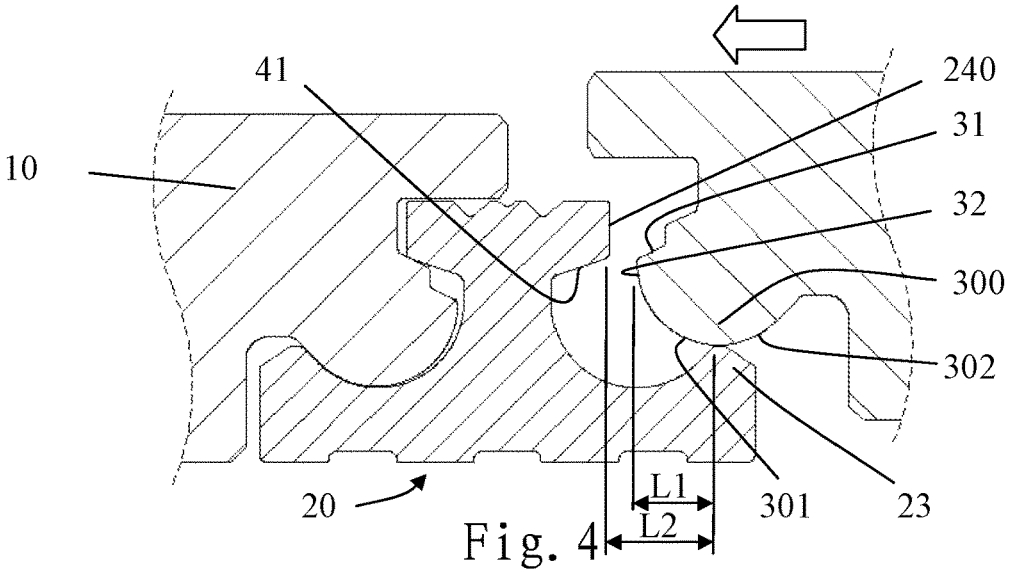

FIG. 3 shows the panel 10 of the present invention and comprises a first surface and a second surface which is located corresponding to the first surface. At least two of the three sides of the panel 10 each have a tongue 30. Only one side of the two panels 10 are shown for convenience of description of the connection between the connector 20 and the panels 10. The panel 10 has a groove 33 defined in the side having the tongue 30, the groove 33 has an inner side 330. A top protrusion 70 extends outward from the side having the groove 33. The top protrusion 70 has an end face 701 and a bottom face 702. The second surface of each panel 10 has a slot 72 defined in one side thereof. The slot 72 has an inside 721 which faces the side having the slot 72. A tongue 30 is formed between the groove 33 and the slot 72. The tongue 30 has a lower protrusion 300. The tongue 30 has a tongue top face 31 which faces the groove 33, and the tongue 30 has a tongue outer face 32 which faces the side having the groove 33. The tongue outer face 32 does not protrude beyond the end face 701 of the top protrusion 70 so that the surface of the panel 10 is not affected and the material for the panel 10 not wasted. A first stepped portion 34 is formed between the tongue top face 31 and the inner side 330. The first stepped portion 34 has an engaging face 341 on the top thereof. The first stepped portion 34 has a contact face 342 which faces the side of the panel 10. The tongue 30 is engaged with the engaging slot 40 of the connector 20. The tongue 30 has a lower protrusion 300 for being received in the engaging slot 40 of the connector 20. The lower protrusion 300 of the tongue 30 is engaged with the lower recess 400 of the connector 20. As shown in FIG. 4, an outer curved face 301 is formed between the outside of the lower protrusion 300 and the tongue outer face 32. An inner curved face 302 is formed on the inside of the lower protrusion 300 and faces the slot 72.

In this embodiment, the outer curved face 301 and the inner curved face 302 are both a curved face.

FIG. 1 shows that the distance between the side faces 240 of the two locking pieces 24 of the upright portion 22 of the connector 20 is smaller than that between the side faces 211 of the base board 21.

An inclined guide face 420 is formed on the outside of the locking member 23 and located between the highest point of the locking member 23 and the side face 211 of the base board 21.

As shown in FIGS. 3 to 6, and 8, the assembling actions of the first embodiment of the present invention are disclosed. FIG. 3 shows that the panel 10 on the left is connected to the connector 20, and the panel 10 on the right having the tongue 30 is moved toward the connector 20 with the engaging slot 40 on the same plane with the panel 10.

When the panel 10 contacts the connector 20 on the same plane, the outer curved face 301 of the tongue 30 contacts the guide face 420 of the locking member 23 of the engaging slot 40.

When the panel 10 contacts the connector 20 on the same plane, the at least one side of the contact position is an inclined face or a curved face, so that the curved face guides the panel 10 to change its height relative to the side of the connector 20. FIG. 3 shows that the panel 10 having the tongue 30 on the right is guided by the curved face and lifted up.

When the panel 10 having the tongue 30 is moved toward the connector 20 having the engaging slot 40, the outer curved face 301 of the tongue 30 contacts the guide face 420 of the locking member 23 of the engaging slot 40 to lift the panel 10.

When the lowest point of the lower protrusion 300 of the panel 10 having the tongue 30 moves to the highest point of the locking member 23 of the connector 20 having the engaging slot 40, as shown in FIG. 4, the panel 10 cannot be lifted up anymore.

The horizontal distance L1 between a vertical extension line of the lowest point of the lower protrusion 300 of the tongue 30 of the panel 10 and a vertical extension line of the highest point of the tongue outer face 32 of the lower protrusion 300 is smaller than the horizontal distance L2 between a vertical extension line of the highest point of the locking member 23 of the connector 20 and a vertical extension line of the lowest point of the side face 240. As shown in FIG. 4, $L1<L2$.

Figure 5:
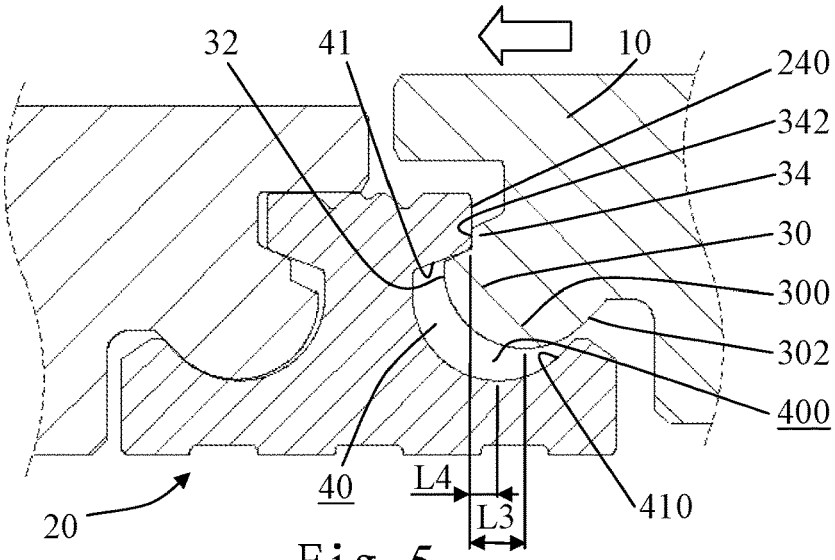

When the panel 10 having the tongue 30 is continuously moved toward the connector 20 having the engaging slot 40, the lower protrusion 300 of the tongue 30 is moved into the lower recess 400 of the engaging slot 40 of the connector 20. The inner curved face 302 of the lower protrusion 300 of the tongue 30 contacts the curved wall 410 of the lower recess 400 of the connector 20. The contact face 342 of the first stepped portion 34 of the tongue 30 contacts the side face 240 of the connector 20 as shown in FIG. 5, so that the panel 10 with the tongue 30 cannot be moved toward the connector 20 having the engaging slot 40 on the same plane. Because of L1<L2, during the process of moving the panel 10 having the tongue 30 toward the connector 20 having the engaging slot 40, when the contact face 342 of the first stepped portion 34 of the tongue 30 contacts the side face 240 of the connector 20, the lower protrusion 300 of the tongue 30 is moved into the lower recess 400 of the engaging slot 40 of the connector 20. Therefore, the connection between the panels 10 and the connector 20 can be completed by pressing the panel 10.

FIG. 5 is used to describe the steps for moving the panels 10 toward the connector 20. The panel 10 on the right is moved downward a little bit due to the gravity to allow the inner curved face 302 of the lower protrusion 300 of the tongue 30 to contact the curved wall 410 of the lower recess 400 of the connector 20. Before that the contact face 342 of the first stepped portion 34 of the tongue 30 of the panel 10 contacts the side face 240 of the connector 20, the panel 10 contacts the connector 20 by the curved face which makes the movement of the panel 10 be easy without using any tool to force the panel 10 to move.

The horizontal distance L3 between a vertical extension line of the lowest point of the lower protrusion 300 of the tongue 30 of the panel 10 and a vertical extension line of the contact face 342 of the first stepped portion 34 of the tongue 30 is larger than the horizontal distance L4 between a vertical extension line of the lowest point of the curved wall 410 of the engaging slot 40 and a vertical extension line of the lowest point of the side face 240. As shown in FIG. 5, L3>L4.

When the panel 10 having the tongue 30 is continuously moved toward the connector 20 having the engaging slot 40, and the contact face 342 of the first stepped portion 34 of the tongue 30 is in contact with the side face 240 of the panel 20, the lower protrusion 300 of the tongue 30 is moved into the lower recess 400 of the engaging slot 40 of the connector 20 as shown in FIG. 5. Because of L3>L4, the lowest point of the lower protrusion 300 of the tongue 30 is not yet in contact with the lowest point of the curved wall 410 of the engaging slot 40 of the connector 20. Therefore, the connection between the panels 10 and the connector 20 can be completed by pressing the panel 10.

Figure 6:
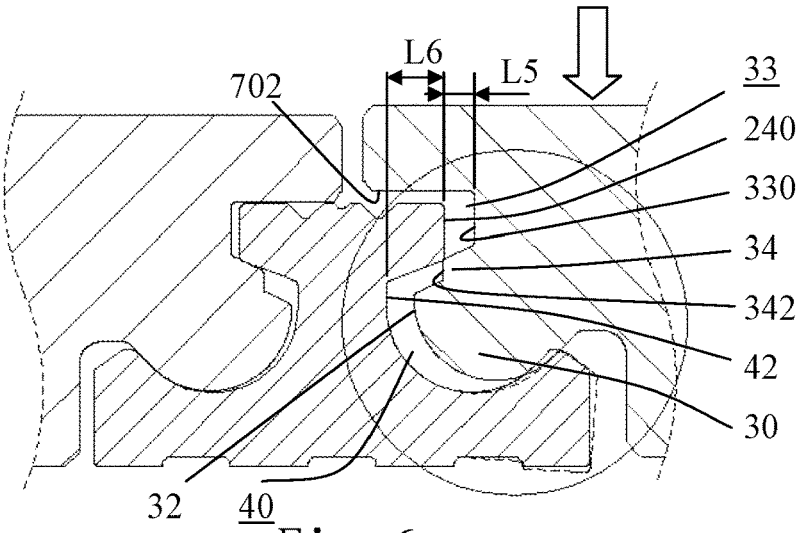

The horizontal distance L5 between a vertical extension line of the outside of the contact face 342 of the first stepped portion 34 and the vertical line of the inner side 330 of the panel 10 is smaller than the horizontal distance L6 between a vertical extension line of an outside of the side face 240 and the vertical line of the highest point of the inside wall 42 of the engaging slot 42. As shown in FIG. 6, L5<L6.

Figure 7:
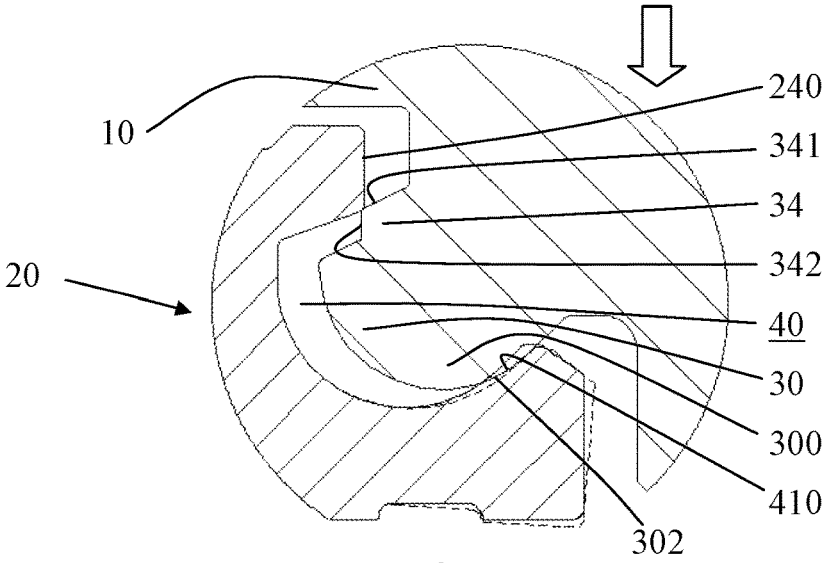
FIG. 7 is an enlarged view of the circled portion in FIG. 6.

By pressing the lifted portion of the panel 10 at the contact portion between the panel 10 and the connector 20 as shown by the arrow head in FIGS. 6 and 7, the contact face 32 of the first stepped portion 34 contacts the side face of the connector, so that the panel 10 and the connector 20 cannot be moved toward on the same plane. The inner curved face 302 of the lower protrusion 300 of the tongue 30 pushes the curved wall 410 of the engaging slot 40 to deform the material below the engaging slot 40 such that the tongue 30 is able to move downward and into the engaging slot 40.

Figure 8:
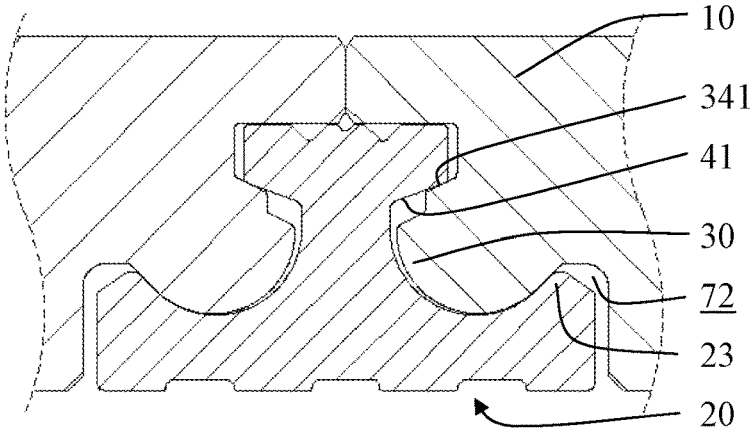

As shown in FIG. 6, when the panel 10 with the tongue 30 is pressed downward, the material below the engaging slot 40 is deformed which is shown by the dotted line and the solid line in FIG. 7. When the material below the engaging slot 40 is deformed to allow the tongue 30 to move downward relative to the engaging slot 40, the contact face 342 of the first stepped portion 40 is offset from the side face 240 of the connector 20, the lower protrusion 300 of the tongue 30 is engaged with the lower recess 400 of the engaging slot 40 by the guidance of the inner curved face 302 of the lower protrusion 300 and the curved wall 410 of the engaging slot 40. The locking member 23 is locked in the slot 72. The material below the engaging slot 40 bounces back by the natural flexibility thereof, the tongue top face 31 of the tongue 30 contacts the underside of the top wall 41 of the engaging slot 40. The tongue 30 is then engaged with the engaging slot 40 so that the panel 10 does not disengaged from the connector 20 as shown in FIG. 8.

The locking member 23 is locked in the slot 72, and the inner curved face 302 of the lower protrusion 300 of the tongue 30 contacts the curved wall 410 of the engaging slot 40, the tongue 30 is engaged with the engaging slot 40 because that the material below the engaging slot 40 is deformed. After the tongue 30 is engaged with the engaging slot 40, the material below the engaging slot 40 returns to its initial status, the distance between the outside of the contact face 342 of the first stepped portion 34 and any point of the contact area between the curved wall 410 and the inner curved face 302 is larger than the distance between the intersection point between the side face 240 of the top wall 41 and the side face 240 to the correspondent contact portion of the curved wall 410. The tongue 30 of the first embodiment cannot be engaged with the engaging slot 40 if the material below the engaging slot 40 is not deformed, so that the panel 10 is securely connected with the connector 20.

As shown in FIGS. 3 to 6 and 8, the tongue 30 of the panel 10 is engaged with the engaging slot 40 of the connector 20 by pressing the panel 10. The assembler does not need to apply a huge force from the other side of the panel 10 so that the other side of the panel 10 is not damaged.

The first embodiment of the present invention uses the pressing force to deform the material below the engaging slot 40 to let the inner curved face 302 of the tongue 30 and the curved wall 410 of the engaging slot 40 to guide the tongue 30 to be engaged with the engaging slot 40. The assembler can either press the panel by hands or feet along the direction shown in FIGS. 6 and 7 to complete the engagement.

Figure 9:
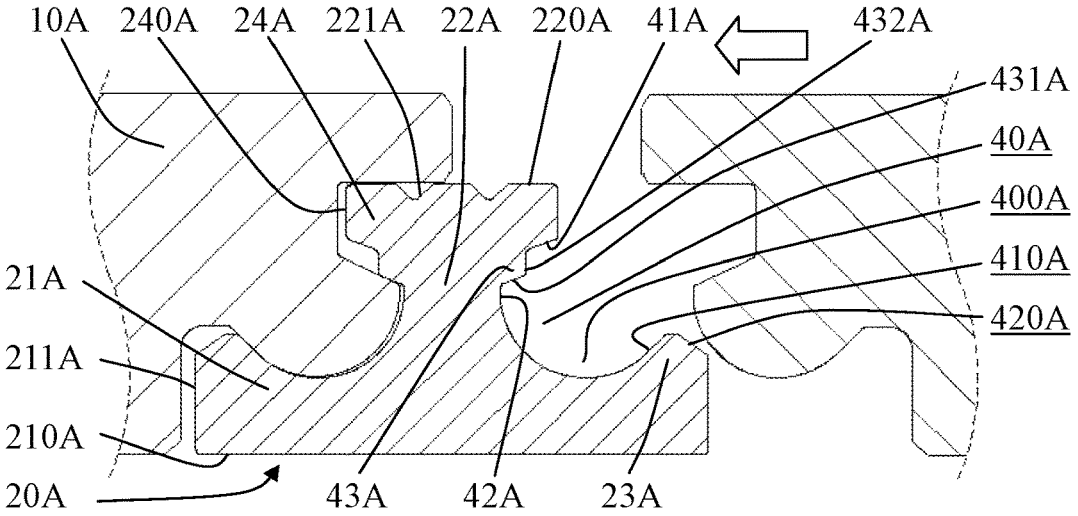
FIGS. 9, 10, 11, 12, 14 are cross sectional views to show the actions to connect the panels by the connector of the second embodiment of the present invention.

For the second embodiment of the present invention, referring to FIG. 9, the connector 20A for connecting the panels 10A of the present invention is an elongate connector 20A comprises a base board 21A on the lower end thereof, and an upright portion 22A extends from the base board 21A. The base board 21A has a bottom face 210A and two side faces 211A. The base board 21A of the connector 20A has a locking member 23A on the top of each of the two sides thereof. A locking piece 24A extends laterally from each of two sides of the upright portion 22A. The locking pieces 24A each have a side face 240A. The upright portion 22A has a top face 220A. In this embodiment, there are two grooves 221A defined in the top face 220A. An engaging slot 40A is defined between the locking piece 24A of the upright portion 22A and the locking member 23A of the base board 21A. The engaging slot 40A defines a top wall 41A in the bottom of the locking piece 24A. The upright portion 22A has an inside wall 42A formed in each of two sides thereof. The base board 21A has a lower recess 400A defined in the top face of each of two sides thereof. The locking member 23A is located between the lower recess 400A and the side face 211A. The locking member 23A has a wedge-shaped cross section. The lower recess 400A has a curved wall 410A formed at the inside thereof and facing the locking member 23A. A first ridge 43A extends between the top wall 41A and the inside wall 42A, the first ridge 43A has an engaging face 431A at the underside thereof, and a contact face 432A is formed on a side of the first ridge 43A.

Figure 10:
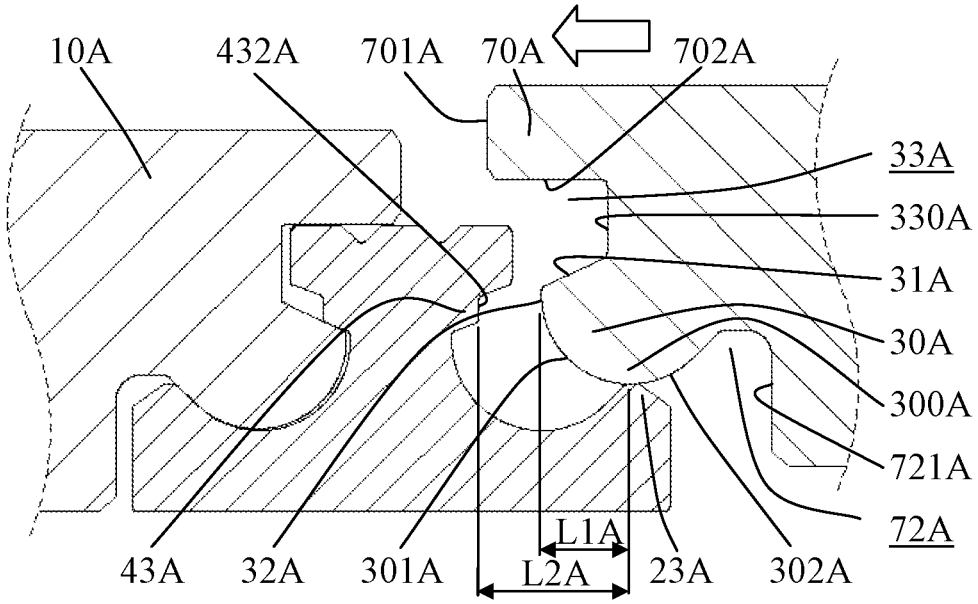

FIG. 10 shows the second embodiment of the panel 10A of the present invention and comprises a first surface and a second surface which is located corresponding to the first surface. At least two of the three sides each have a tongue 30A. The panel 10A has a groove 33A defined in the side having the tongue 30A, the groove 33A has an inner side 330A. A top protrusion 70A extends outward from the side having the groove 33A. The top protrusion 70A has an end face 701A and a bottom face 702A. The second surface of the panel 10 has a slot 72A defined in one side thereof. The slot 72A has an inside 721A which faces the side having the slot 72A. A tongue 30A is formed between the groove 33A and the slot 72A. The tongue 30A has a tongue top face 31A which faces the groove 33A, and the tongue 30A has a tongue outer face 32A which faces the side of the panel 10A having the groove 33A. The tongue outer face 32A does not protrude beyond the end face 701A of the top protrusion 70A. The tongue 30A is engaged with the engaging slot 40A when the panel 10A is connected with the connector 20A. The tongue 30A has a lower protrusion 300A which is engaged with the lower recess 400A of the connector 20A. An outer curved face 301A is formed on the outside of the lower protrusion 300A and the outer curved face 301A connects the tongue outer face 32A, An inner curved face 302A is formed on the inside of the lower protrusion 300A and faces the slot 72A.

In this embodiment, the outer curved face 301A and the inner curved face 302A are both a curved face.

FIG. 9 shows that the distance between the side faces 240A of the two locking pieces 24A of the upright portion 22A of the connector 20A is smaller than that between the side faces 211A of the base board 21A.

An inclined guide face 420A is formed on the outside of the locking member 23A and located between the highest point of the locking member 23A and the side face 211A.

As shown in FIGS. 9 to 12, and 14, the assembling actions of the second embodiment of the present invention are disclosed. FIG. 9 shows that the panel 10A on the left is connected to the connector 20A, and the panel 10A on the right having the tongue 30A is moved toward the connector 20A with the engaging slot 40A on the same plane with the panel 10A.

When the panel 10A contacts the connector 20A on the same plane, the outer inclined face 301A of the tongue 30A contacts the guide face 420A of the locking member 23A of the engaging slot 40A of the panel 10A.

When the panel 10A contacts the connector 20A on the same plane, the at least one side of the contact position is an inclined face or a curved face, so that the inclined face guides the panel 10A to change its height relative to the side of the connector 20A. FIG. 9 shows that the panel 10A having the tongue 30A is guided by the inclined face and lifted up.

When the panel 10A having the tongue 30A is continuously moved toward the connector 20A having the engaging slot 40A, the outer curved face 301A of the tongue 30A contacts the guide face 420A of the locking member 23A of the engaging slot 40A to lift the panel 10A.

When the lowest point of the lower protrusion 300A of the panel 10A having the tongue 30A moves to the highest point of the locking member 23A of the connector 20A having the engaging slot 40A, as shown in FIG. 10, the panel 10A cannot be lifted up anymore.

The horizontal distance L1A between a vertical extension line of the lowest point of the lower protrusion 300A of the tongue 30A of the panel 10A and a vertical extension line of the highest point of the tongue outer face 32A of the lower protrusion 300A is smaller than the horizontal distance L2A between a vertical extension line of the highest point of the locking member 23A of the connector 20A and a vertical extension line of the lowest point of the contact face 432A of the first ridge 43A. As shown in FIG. 10, L1A<L2A.

Figure 11:
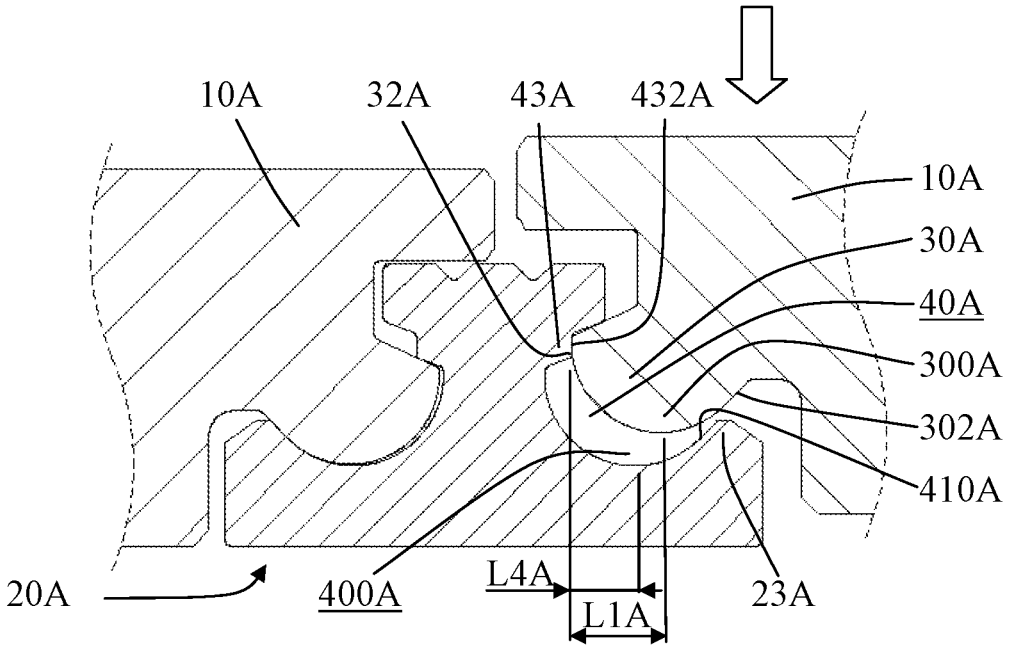

When the panel 10A having the tongue 30A is continuously moved toward the connector 20A having the engaging slot 40A, the lower protrusion 300A of the tongue 30A is moved into the lower recess 400A of the engaging slot 40A of the connector 20A. The inner curved face 302A of the lower protrusion 300A of the tongue 30A contacts the curved wall 410A of the lower recess 400A of the connector 20A. The contact face 432A of the first ridge 43A of the panel 10A contacts the tongue outer face 32A of the tongue 30A as shown in FIG. 11, so that the panel 10A with the tongue 30A cannot be moved toward the connector 20A having the engaging slot 40A on the same plane. Because of L1A<L2A, during the process of moving the panel 10A having the tongue 30A toward the connector 20A having the engaging slot 40A, when the contact face 432A of the first ridge 43A of the panel 10A contacts the tongue outer face 32A of the tongue 30A, the lower protrusion 300A of the tongue 30A is moved into the lower recess 400A of the engaging slot 40A of the connector 20A. Therefore, the connection between the panels 10A and the connector 20A can be completed by pressing the panel 10.

FIG. 11 is used to describe the steps for moving the panels 10A toward the connector 20A. The panel 10A on the right is moved downward a little bit due to the gravity to allow the inner curved face 302A of the lower protrusion 300A of the tongue 30A to contact the curved wall 410A of the lower recess 400A of the connector 20A. Before that the contact face 432A of the first ridge 43A of the panel 10A contacts the tongue outer face 32A of the tongue 30A, the panel 10A contacts the connector 20A by the curved face which makes the movement of the panel 10A be easy without using any tool to force the panel 10A to move.

The horizontal distance L1A between a vertical extension line of the lowest point of the lower protrusion 300A of the tongue 30A of the panel 10A and a vertical extension line of the highest point of the tongue outer face 32A of the tongue 30A is larger than the horizontal distance L4 between a vertical extension line of the lowest point of the curved wall 410A of the engaging slot 40A and a vertical extension line of the lowest point of the contact face 432 of the first ridge 43A. As shown in FIG. 11, L1A>L4A.

When the panel 10A having the tongue 30A is continuously moved toward the connector 20A having the engaging slot 40A, and the tongue outer face 32A of the tongue 30A contacts the contact face 432 of the first ridge 43A, the lower protrusion 300A of the tongue 30A is moved into the lower recess 400A of the engaging slot 40A of the connector 20A as shown in FIG. 11. Because of L1A>L4A, the lowest point of the lower protrusion 300A of the tongue 30A is not yet in contact with the lowest point of the curved wall 410A of the engaging slot 40A of the connector 20A. Therefore, the connection between the panels 10A and the connector 20A can be completed by pressing the panel 10A.

Figure 12:
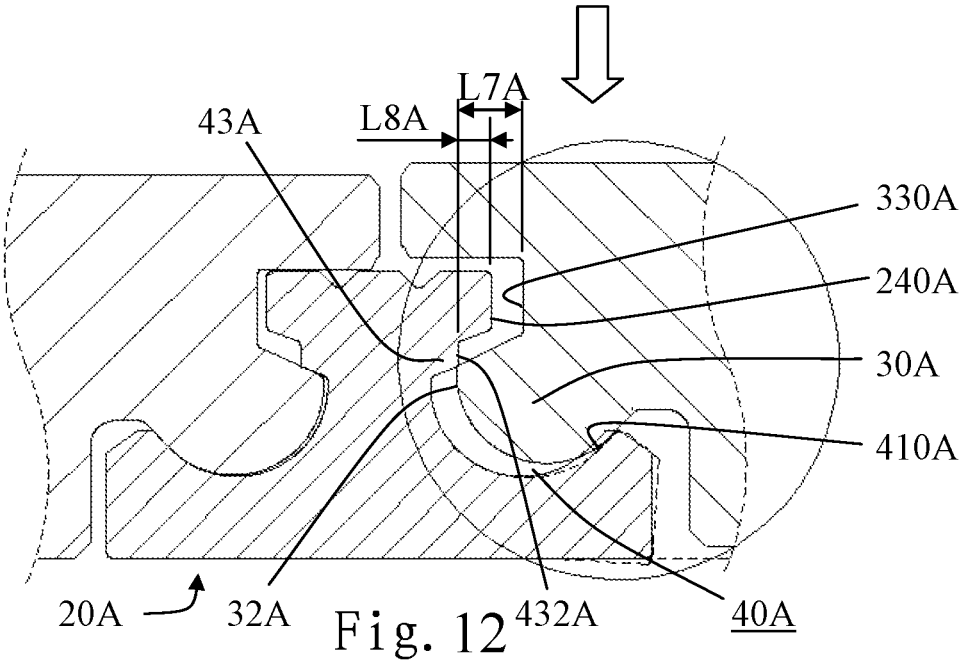

The horizontal distance L7A between a vertical extension line of the inner side 330A of the panel 10A and the vertical line of highest point of the tongue outer face 32A is larger than the horizontal distance L8A between a vertical extension line of an outside of the side face 240 of the connector 20A and the vertical line of the lowest point of the contact wall 432A of the first ridge 43A. As shown in FIG. 12, L7A>L8A.

By pressing the lifted portion of the panel 10A at the contact portion between the panel 10A and the connector 20A as shown by the arrow head in FIGS. 11 and 12, the contact face 32A of the tongue 30A contacts the contact face 432A of the first ridge 43A, so that the panel 10A and the connector 20A cannot be moved toward on the same plane. The inner curved face 302A of the lower protrusion 300A of the tongue 30A pushes the curved wall 410A of the engaging slot 40A to deform the material below the engaging slot 40A such that the tongue 30A is able to move downward and into the engaging slot 40A.

Figure 13:
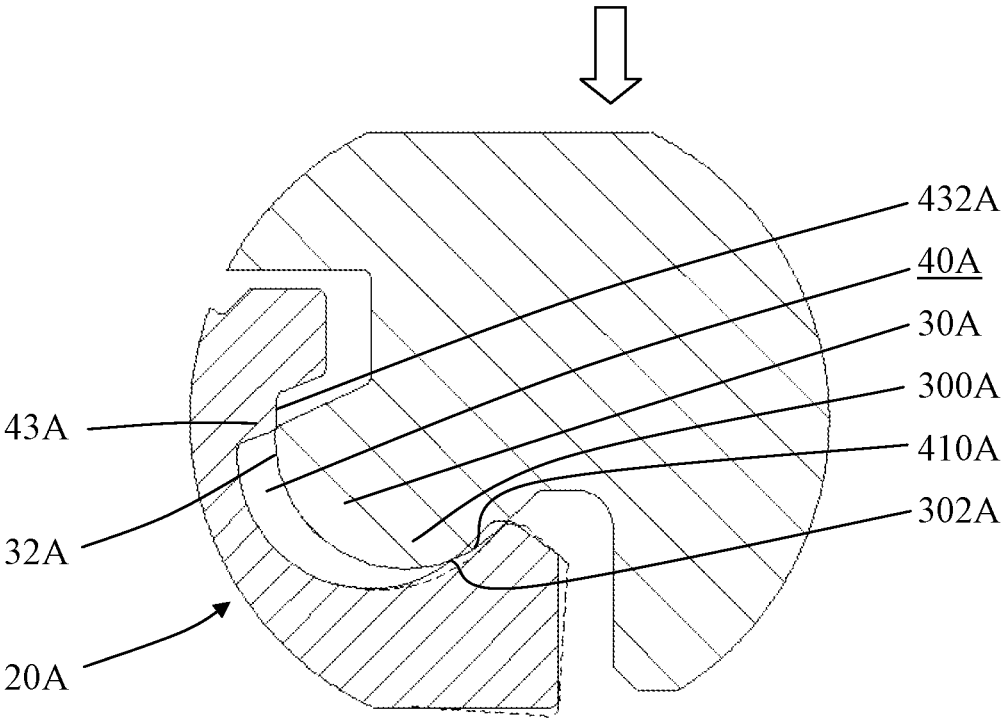
FIG. 13 is an enlarged view of the circled portion in FIG. 12.
Figure 14:
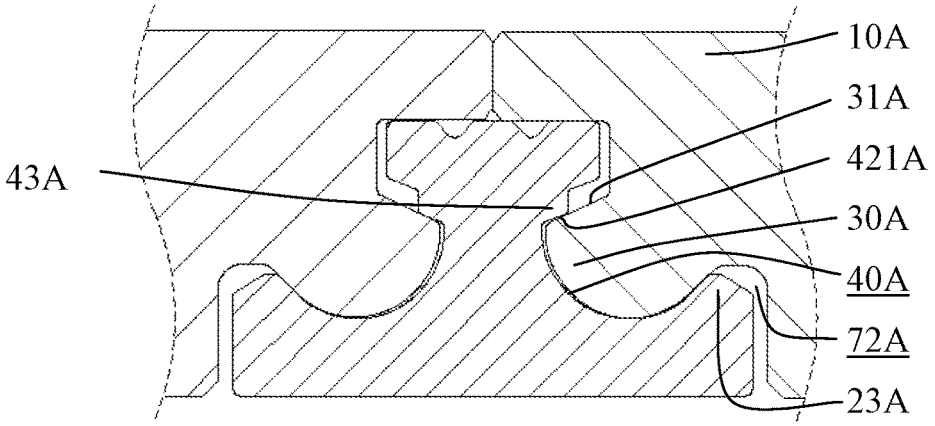

As shown in FIG. 12, when the panel 10A with the tongue 30A is pressed downward, the material below the engaging slot 40A is deformed which is shown by the dotted line and the solid line in FIG. 13. When the material below the engaging slot 40A is deformed to allow the tongue 30A to move downward relative to the engaging slot 40A, the tongue outer 32A of the panel 10A is offset from the contact face 432A of the first ridge 43A of the connector 20A, the lower protrusion 300A of the tongue 30A is engaged with the lower recess 400A of the engaging slot 40A by the guidance of the inner curved face 302A of the lower protrusion 300A and the curved wall 410A of the engaging slot 40A. The locking member 23A is locked in the slot 72A. The material below the engaging slot 40A bounces back by the natural flexibility thereof, the tongue top face 31A of the tongue 30A contacts the underside of the engaging face 431A of the first ridge 43A. The tongue 30A is then engaged with the engaging slot 40A so that the panel 10A does not disengaged from the connector 20A as shown in FIG. 14.

The locking member 23A is locked in the slot 72A, and the tongue top face 31A of the tongue 30A contacts the engaging face 431A of the first ridge 43A. The inner curved face 302A of the lower protrusion 300A of the tongue 30A contacts the curved wall 410A of the engaging slot 40A. The tongue 30A is engaged with the engaging slot 40A because that the material below the engaging slot 40A is deformed. After the tongue 30A is engaged with the engaging slot 40A, the material below the engaging slot 40A returns to its initial status, the distance between the outside of the tongue top face 31A of the tongue 30A and any point of the contact area between the curved wall 410A and the inner curved face 302A is larger than the distance between the intersection point between the engaging face 431A of the first ridge 43A of the engaging slot 40A and the contact face 432A to the correspondent contact portion of the curved wall 410A. The tongue 30A of the second embodiment cannot be engaged with the engaging slot 40A if the material below the engaging slot 40A is not deformed, so that the tongue 30A is securely connected with the engaging slot 40A.

The tongue 30A of the panel 10A is engaged with the engaging slot 40A of the connector 20A by pressing the panel 10A. The assembler does not need to apply a huge force to connect the panel 10A with the connector 20A, so that no huge force is applied to the other side of the panel 10A so that the other side of the panel 10A is not damaged.

The second embodiment of the present invention uses the pressing force to deform the material below the engaging slot 40A to let the inner curved face 302A of the tongue 30A and the curved wall 410A of the engaging slot 40A to guide the tongue 30A to be engaged with the engaging slot 40A. The assembler can either press the panel 10A by hands or feet along the direction shown in FIGS. 11 and 12 to complete the engagement.

Figure 15:
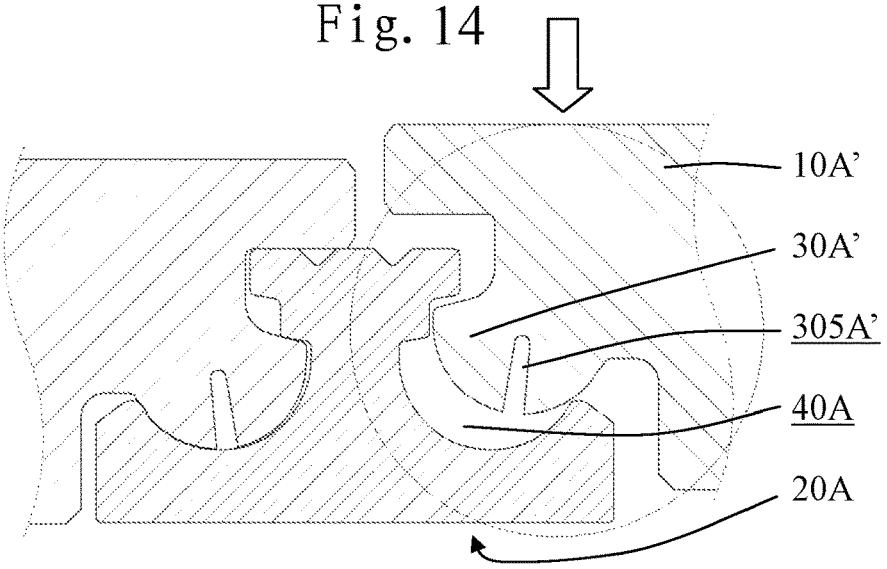
FIG. 15 is an end cross sectional view to show another embodiment based on the second embodiment of the present invention.
Figure 16:
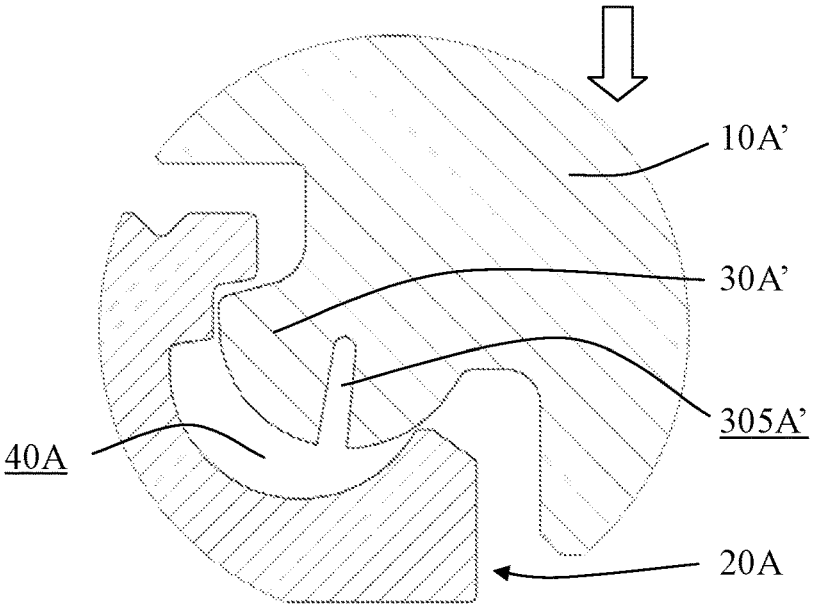
FIG. 16 is an enlarged view of the circled portion in FIG. 15.

FIG. 15 shows another embodiment based on the second embodiment of the present invention, wherein the tongue 30A' of the panel 10A' has a resilient slot 305A' defined in the underside thereof. As shown in FIG. 16, the tongue 30A' of the panel 10A' is moved to the engaging slot 40A of the connector 20A, and when pressing the panel 10A' to be connected with the connector 20A, the resilient slot 305A' provide a space for deformation of the tongue 30A' of the panel 10A'. Therefore, when the tongue 30A' of the panel 10A' is engaged with the engaging slot 40A of the connector 20A by way pressing, the material below the engaging slot 40A of the connector 20A is slightly deformed, the tongue 30A' is deformed in the resilient slot 305A', so that the tongue 30A' of the panel 10A' is easily engaged with the engaging slot 40A of the connector 20A.

Figure 17:
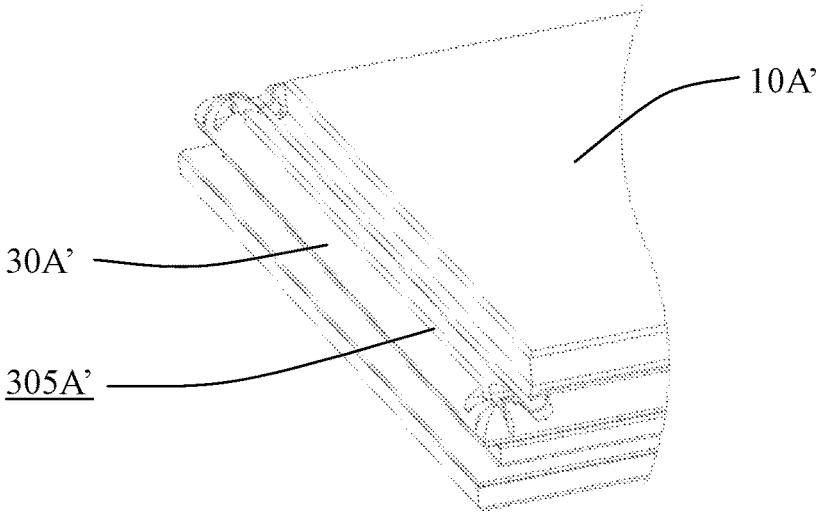
FIG. 17 shows the bottom of the panel in FIGS. 15 and 16.

FIG. 17 shows the underside of the panel 10A' disclosed in FIGS. 15 and 16. The tongue 30A' is disclosed.

Figure 18:
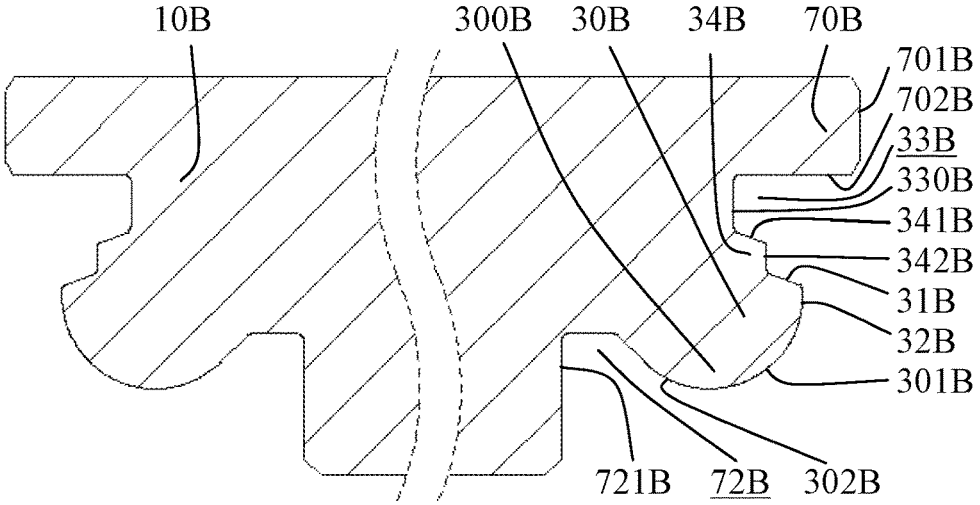
FIG. 18 is the end cross sectional view of the third embodiment of the panel of the present invention.
Figure 19:
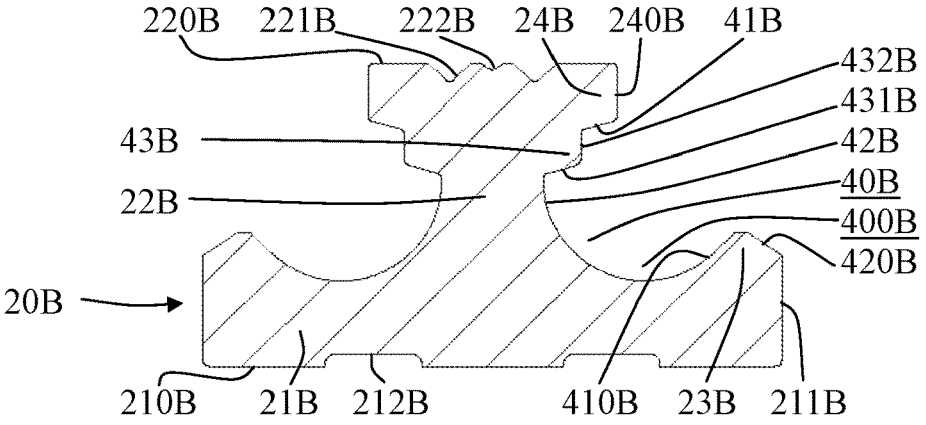
FIG. 19 is the end cross sectional view of the third embodiment of the connector of the present invention.

For the third embodiment of the present invention, as shown in FIGS. 18 and 19, the panel 10B is similar to the panel 10 in the first embodiment, and the connector 20B is similar to the connector 20A in the second embodiment.

As shown in FIG. 18, the panel 10B of the present invention comprises a first surface and a second surface which is located corresponding to the first surface. At least two of the three sides of the panel 10B each have a tongue 30B. The panel 10B has a groove 33B defined in the side having the tongue 30B, the groove 33B has an inner side 330B. A top protrusion 70B extends outward from the side having the groove 33B. The top protrusion 70B has an end face 701B and a bottom face 702B. The second surface of the panel 10B has a slot 72B defined in one side thereof. The slot 72B has an inside 721B which faces the side having the slot 72B. A tongue 30B is formed between the groove 33B and the slot 72B. The tongue 30B has a tongue top face 31B which faces the groove 33B, and the tongue 30B has a tongue outer face 32B which faces the side having the groove 33B. The tongue outer face 32B does not protrude beyond the end face 701B of the top protrusion 70B. A first stepped portion 34B is formed between the tongue top face 31B and the inner side 330B. The first stepped portion 34B has an engaging face 341B on the top thereof. The first stepped portion 34B has a contact face 342B which faces the side of the panel 10B. The tongue 30 has a lower protrusion 300B. An outer curved face 301B is formed between the outside of the lower protrusion 300B and the tongue outer face 32B. An inner curved face 302B is formed on the inside of the lower protrusion 300B and faces the slot 72B.

Each of the outer curved face 301B and the inner curved face 302B of the lower protrusion 300B of the panel 10B is a curved face.

FIG. 19 shows that the connector 20B for connecting the panels 10B of the third embodiment of the present invention comprises a base board 21B and an upright portion 22B extends from the base board 21B. The base board 21B has a bottom face 210B and two side faces 211B. The base board 21B of the connector 20B has a locking member 23B on the top of each of the two sides thereof. A locking piece 24B extends laterally from each of two sides of the upright portion 22B. The locking pieces 24B each have a side face 240B. The upright portion 22B has a top face 220B. In this embodiment, there are two grooves 221B defined in the top face 220B. A groove 222B is defined between the two grooves 221B wherein the two grooves 221B are deeper than the groove 222B. An engaging slot 40B is defined between the locking piece 24B of the upright portion 22B and the locking member 23B of the base board 21B. The engaging slot 40B defines a top wall 41B in the bottom of the locking piece 24B. The upright portion 22B has an inside wall 42B formed in each of two sides thereof. The base board 21B has a lower recess 400B defined in the top face of each of two sides thereof. The locking member 23B is located between the lower recess 400B and the side face 211B. The locking member 23B has a wedge-shaped cross section. The lower recess 400B has an curved wall 410B formed at the inside thereof and facing the locking member 23B. A first ridge 43B extends between the top wall 41B and the inside wall 42B, the first ridge 43B has an engaging face 431B at the underside thereof, and a contact face 432B is formed on a side of the first ridge 43B.

FIG. 19 shows that the distance between the side faces 240B of the two locking pieces 24B of the upright portion 22B of the connector 20B is smaller than that between the side faces 211B of the base board 21B.

An inclined guide face 420B is formed on the outside of the locking member 23B and located between the highest point of the locking member 23B and the upright portion 22B.

Two grooves 212B are defined in the bottom face 210B of the base board 21B and located along the longitudinal direction of the panel 20B.

Figure 20:
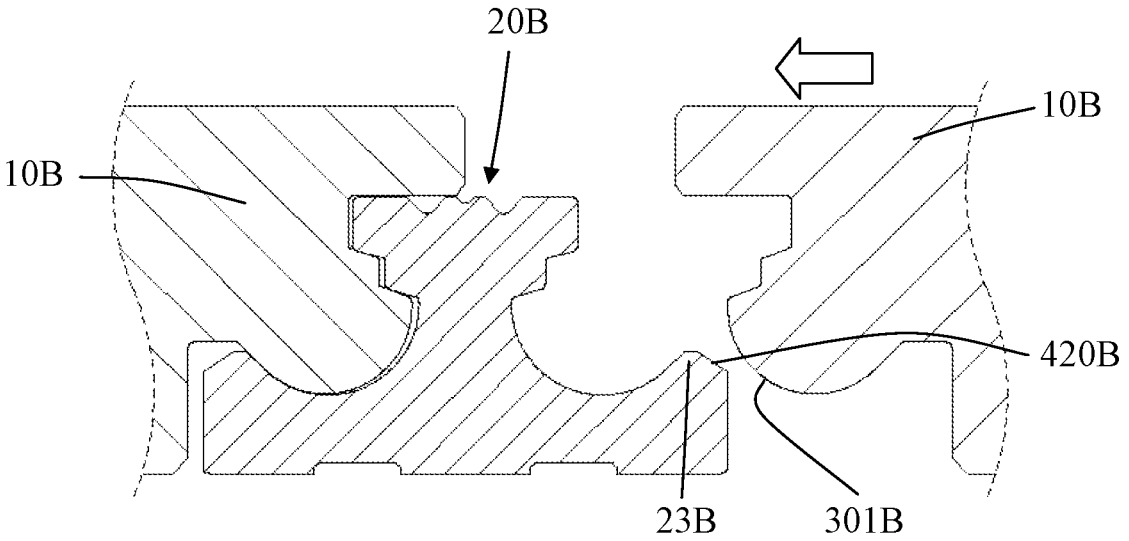
FIGS. 20, 21, 22, 23, 25 are cross sectional views to show the actions to connect the panels by the connector of the third embodiment of the present invention.

As shown in FIGS. 20 to 23, and 25, the assembling actions of the third embodiment of the present invention are disclosed. FIG. 20 shows that the panel 10B on the left is connected to the connector 20B, and the panel 10B on the right having the tongue 30B on the right is moved toward the connector 20B with the engaging slot 40B on the same plane with the panel 10B.

When the panel 10B contacts the connector 20B on the same plane, the outer curved face 301B of the tongue 30B contacts the guide face 420B of the locking member 23B of the engaging slot 40B of the connector 20B.

When the panel 10B contacts the connector 20B on the same plane, the at least one side of the contact position is an inclined face or a curved face, so that the curved face guides the panel 10B to change its height relative to the side of the connector 20B. FIG. 20 shows that the panel 10B having the tongue 30B is guided by the curved face and lifted up.

When the panel 10B having the tongue 30B is continuously moved toward the connector 20B having the engaging slot 40B, the outer curved face 301B of the tongue 30B contacts the guide face 420B of the locking member 23B of the engaging slot 40B to lift the panel 10B.

Figure 21:
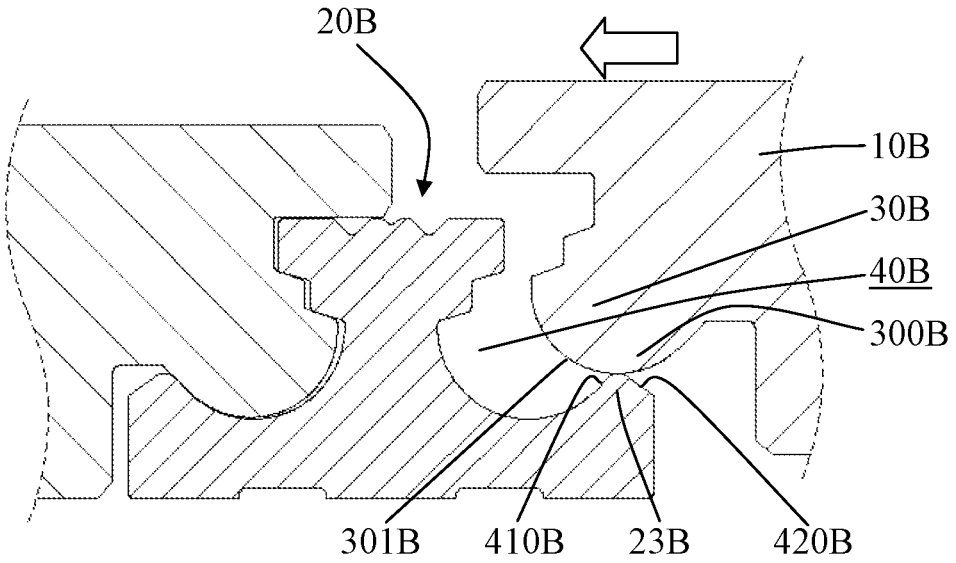

When the lowest point of the lower protrusion 300B of the panel 10B having the tongue 30B moves to the highest point of the locking member 23B of the connector 20B having the engaging slot 40B, as shown in FIG. 21, the panel 10B cannot be lifted up anymore.

Figure 22:
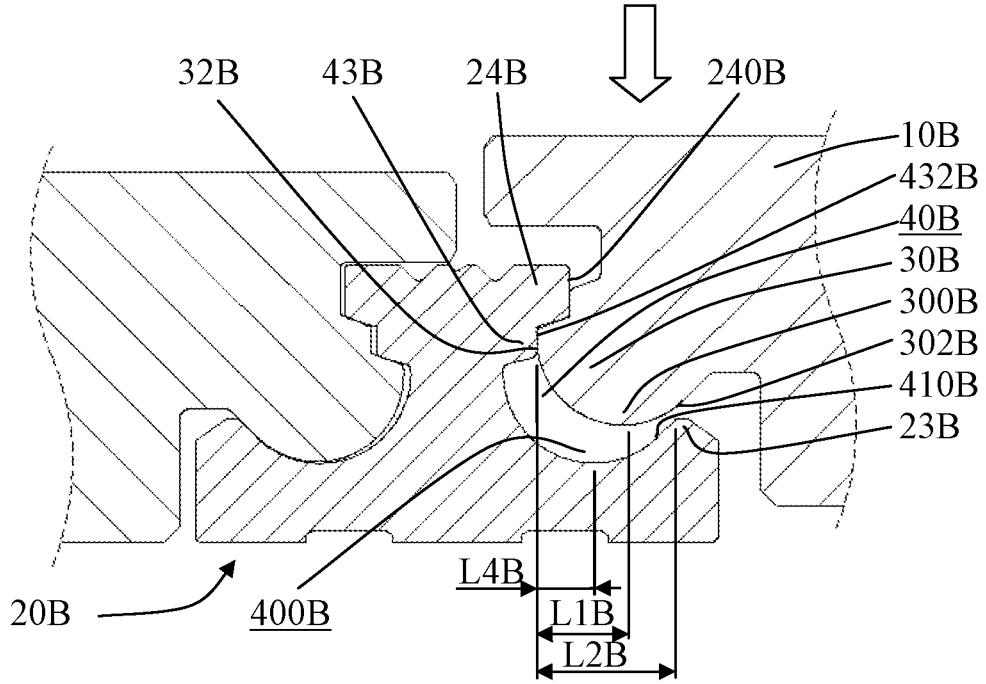

The horizontal distance L1B between a vertical extension line of the lowest point of the lower protrusion 300B of the tongue 30B of the panel 10B and a vertical extension line of the highest point of the tongue outer face 32B of the lower protrusion 300B is smaller than the horizontal distance L2B between a vertical extension line of the highest point of the locking member 23B of the connector 20B and a vertical extension line of the lowest point of the contact face 432B of the first ridge 43B. As shown in FIG. 22, L1B<L2B.

When the panel 10B having the tongue 30B is continuously moved toward the connector 20B having the engaging slot 40B, the lower protrusion 300B of the tongue 30B is moved into the lower recess 400B of the engaging slot 40B of the connector 20B. The inner curved face 302B of the lower protrusion 300B of the tongue 30B contacts the curved wall 410B of the lower recess 400B of the connector 20B. The contact face 432B of the first ridge 43B of the panel 10B contacts the tongue outer face 32B of the tongue 30B as shown in FIG. 22, so that the panel 10B with the tongue 30B cannot be moved toward the connector 20B having the engaging slot 40B on the same plane. Because of L1B<L2B, during the process of moving the panel 10B having the tongue 30B toward the connector 20B having the engaging slot 40B, when the contact face 432B of the first ridge 43B of the panel 10B contacts the tongue outer face 32B of the tongue 30B, and the contact face 342B of the first ridge 34B contacts the side face 240B of the locking piece 24B, the lower protrusion 300B of the tongue 30B is moved into the lower recess 400B of the engaging slot 40B of the connector 20B. Therefore, the connection between the panels 10B and the connector 20B can be completed by pressing the panel 10B.

FIG. 22 is used to describe the steps for moving the panels 10B toward the connector 20B. The panel 10B on the right is moved downward a little bit due to the gravity to allow the inner curved face 302B of the lower protrusion 300B of the tongue 30B to contact the curved wall 410B of the lower recess 400B of the connector 20B. Before that the contact face 432B of the first ridge 43B of the panel 10B contacts the tongue outer face 32B of the tongue 30B, and before the contact face 342B of the first ridge 34B contacts the side face 240B of the locking piece 24B, the panel 10B contacts the connector 20B by the curved face which makes the movement of the panel 10B be easy without using any tool to force the panel 10B to move.

The horizontal distance L1B between a vertical extension line of the lowest point of the lower protrusion 300B of the tongue 30B of the panel 10B and a vertical extension line of the highest point of the tongue outer face 32B of the tongue 30B is larger than the horizontal distance L4B between a vertical extension line of the lowest point of the curved wall 410B of the engaging slot 40B and a vertical extension line of the lowest point of the contact face 432B of the first ridge 43B. As shown in FIG. 22, L1B>L4B.

When the panel 10B having the tongue 30B is continuously moved toward the connector 20B having the engaging slot 40B, and the tongue outer face 32B of the tongue 30B contacts the contact face 432B of the first ridge 43B, the lower protrusion 300B of the tongue 30B is moved into the lower recess 400B of the engaging slot 40B of the connector 20B as shown in FIG. 22. Because of L1B>L4B, the lowest point of the lower protrusion 300B of the tongue 30B is not yet in contact with the lowest point of the curved wall 410B of the engaging slot 40B of the connector 20B. Therefore, the connection between the panels 10B and the connector 20B can be completed by pressing the panel 10B.

Figure 23:
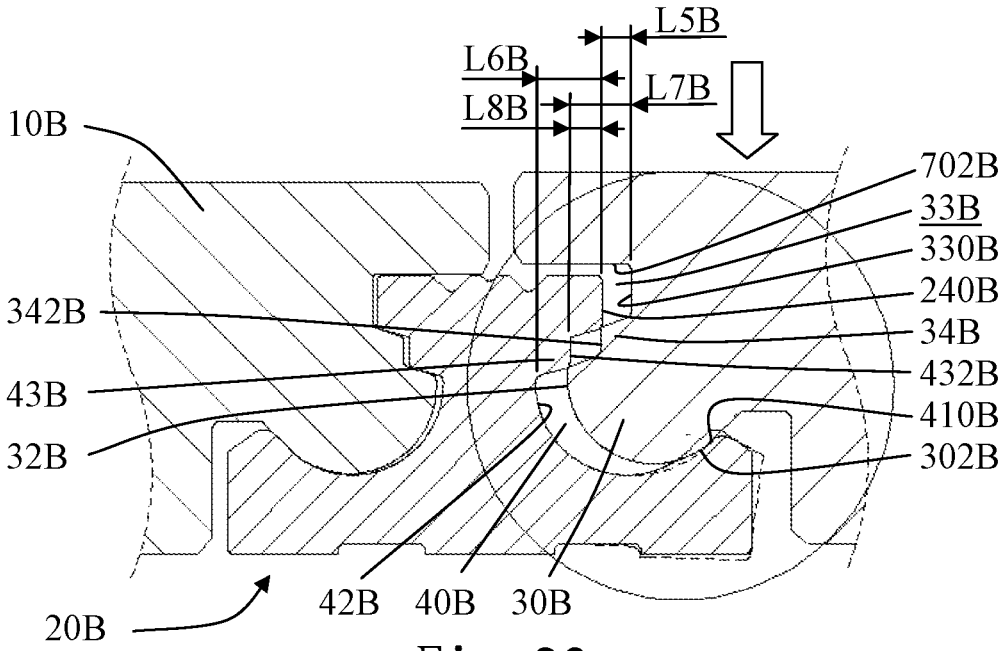

The horizontal distance L5B between a vertical extension line of the inner side 330B of the panel 10B and the vertical line of the outside of the contact face 342B of the first stepped portion 34B is smaller than the horizontal distance L6B between a vertical extension line of the outside of the side face 240B of the engaging slot 40B of the connector 20B and the vertical line of the highest point of the inside wall 42B of the engaging slot 40B. As shown in FIG. 23, L5B<L6B.

The horizontal distance L7B between a vertical extension line of the inner side 330B of the panel 10B and the vertical line of highest point of the tongue outer face 32B is larger than the horizontal distance L8B between a vertical extension line of an outside of the side face 240B of the connector 20B and the vertical line of the lowest point of the contact wall 432B of the first ridge 43B. As shown in FIG. 23, L7B>L8B.

By pressing the lifted portion of the panel 10B at the contact portion between the panel 10B and the connector 20B as shown by the arrow head in FIG. 23, the contact face 32B of the tongue 30B contacts the contact face 432B of the first ridge 43B, and the contact face 342B of the first stepped portion 34B contacts the side face 240B, so that the panel 10B and the connector 20B cannot be moved toward on the same plane. The inner curved face 302B of the lower protrusion 300B of the tongue 30B pushes the curved wall 410B of the engaging slot 40B to deform the material below the engaging slot 40B such that the tongue 30B is able to move downward and into the engaging slot 40B.

Figure 24:
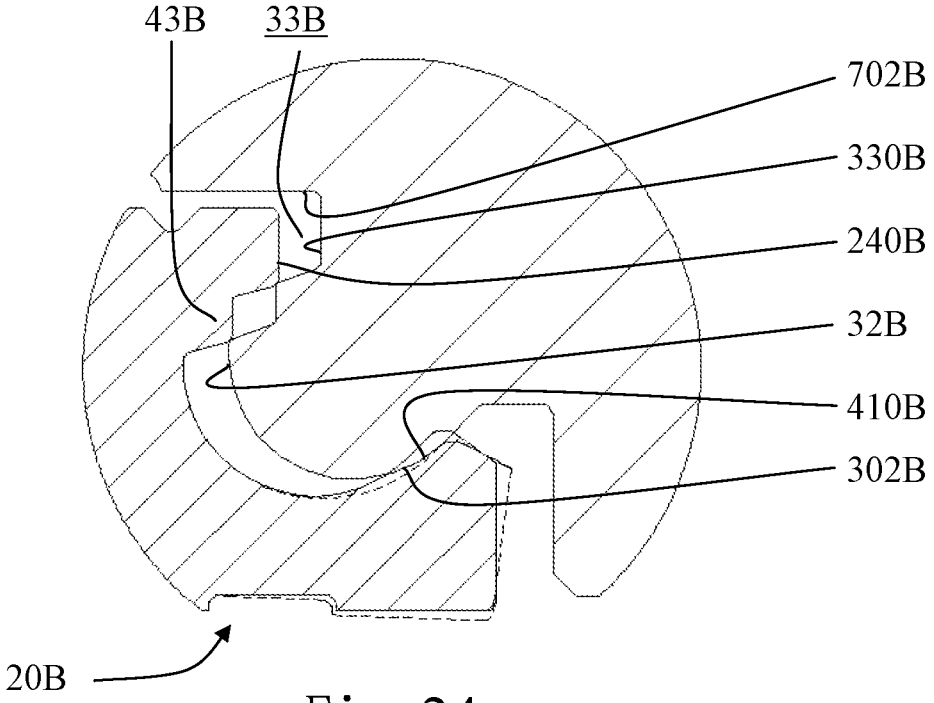
FIG. 24 is an enlarged view of the circled portion in FIG. 23.
Figure 25:
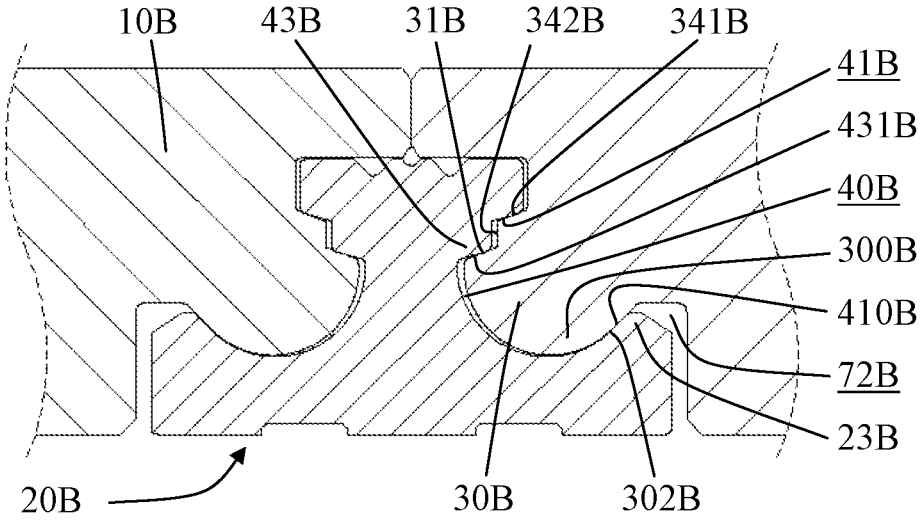

As shown in FIG. 23, when the panel 10B with the tongue 30B is pressed downward, the material below the engaging slot 40B is deformed which is shown by the dotted line and the solid line in FIG. 24. When the material below the engaging slot 40B is deformed to allow the tongue 30B to move downward relative to the engaging slot 40B, the tongue outer 32B of the tongue 30B is offset from contact face 432B of the first ridge 43B of the engaging slot 40B, and the contact face 342B of the first stepped portion 34B is offset from the side face 240B, the lower protrusion 300B of the tongue 30B is engaged with the lower recess 400B of the engaging slot 40B by the guidance of the inner curved face 302B of the lower protrusion 300B and the curved wall 410B of the engaging slot 40B. The locking member 23B is locked in the slot 72B. The material below the engaging slot 40B bounces back by the natural flexibility thereof, the tongue top face 31B of the tongue 30B contacts the underside of the engaging face 431B of the first ridge 43B. The engaging face 341B of the first stepped portion 34B of the tongue 30B contacts the underside of the top wall 41B of the locking piece 24B of the engaging face 341B of the first stepped portion 34B. The tongue 30B is then engaged with the engaging slot 40B so that the panel 10B does not disengaged from the connector 20B as shown in FIG. 25.

The tongue top face 31B of the tongue 30B contacts the engaging face 431B of the first ridge 43B. The engaging face 341B of the first stepped portion 34B of the tongue 30B contacts the top wall 41B of the locking piece 24B of the engaging face 341B of the first stepped portion 34B. The locking member 23B is engaged with the slot 72B. The inner curved face 302B of the lower protrusion 300B of the tongue 30B contacts the curved wall 410B of the engaging slot 40B. The tongue 30B is engaged with the engaging slot 40B because that the material below the engaging slot 40B is deformed. After the tongue 30B is engaged with the engaging slot 40B, the material below the engaging slot 40B returns to its initial status, the distance between the outside of the tongue top face 31B of the tongue 30B and any point of the contact area between the curved wall 410B and the inner curved face 302B is larger than the distance between the intersection point between the engaging face 431B of the first ridge 43B of the engaging slot 40B and the contact face 432B to the correspondent contact portion of the curved wall 410B. The tongue 30B of the second embodiment cannot be engaged with the engaging slot 40B if the material below the engaging slot 40B is not deformed, so that the tongue 30B is securely connected with the engaging slot 40B.

Figure 26:
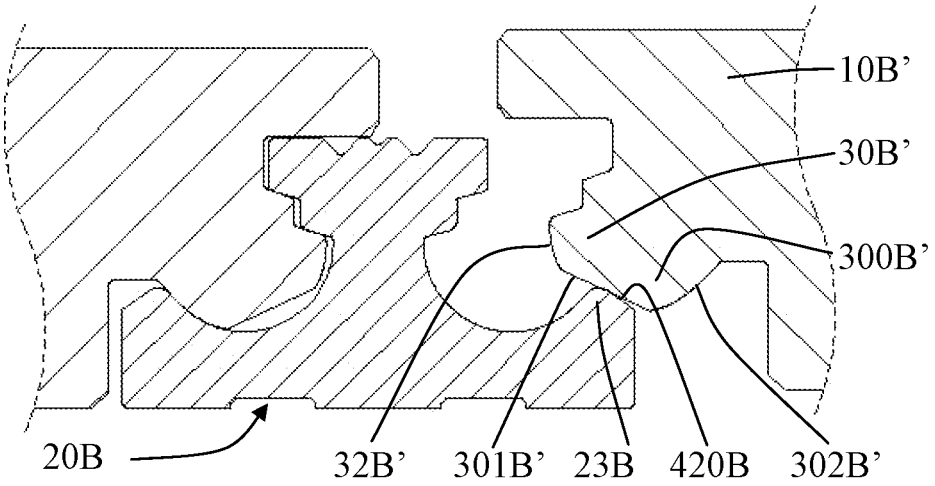
FIG. 26 is an end cross sectional view to show another embodiment based on the third embodiment of the present invention.

FIG. 26 shows another embodiment based on the third embodiment of the present invention, wherein the connector 20B is similar to that of the third embedment, and the panel 10B' has an curved face connected between the outer curved face 301B' of the lower protrusion 300B' of the tongue 30B' and the inner curved face 302B' of the tongue outer face 32B'.

Figure 27:
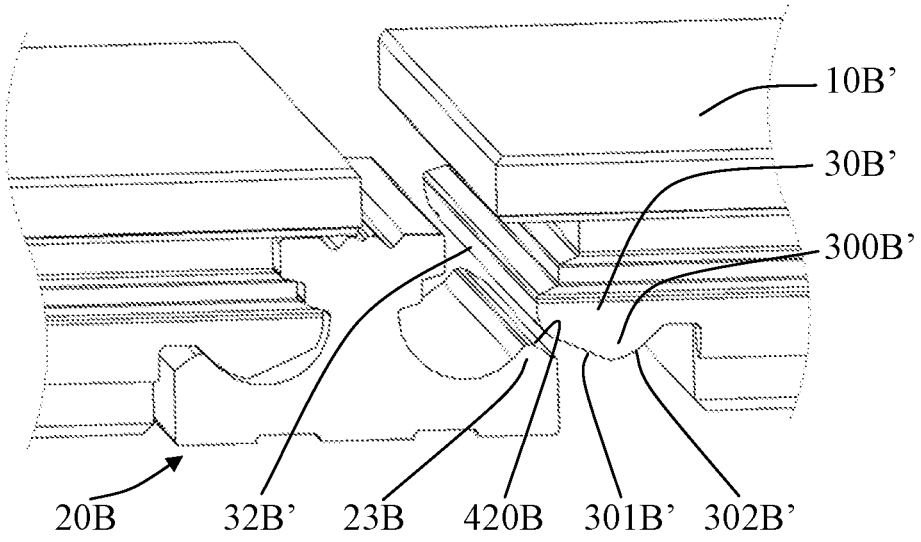
FIG. 27 is a perspective view to show the embodiment in FIG. 26.

FIG. 27 shows that when the panel 10B' is moved toward the connector 20B the outer curved face 301B' contacts the connector 20B, and the panel 10B' is lifted along the guide face 420B of the locking member 23B of the connector 20B.

Figure 28:
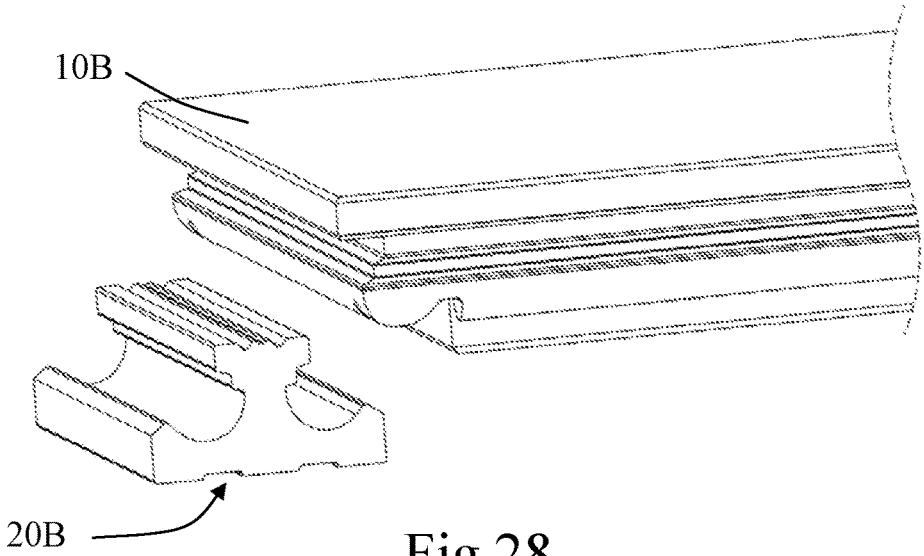
FIGS. 28 to 30 are perspective view to show the connection of the third embodiment of the panels and the connector of the present invention.
Figure 29:
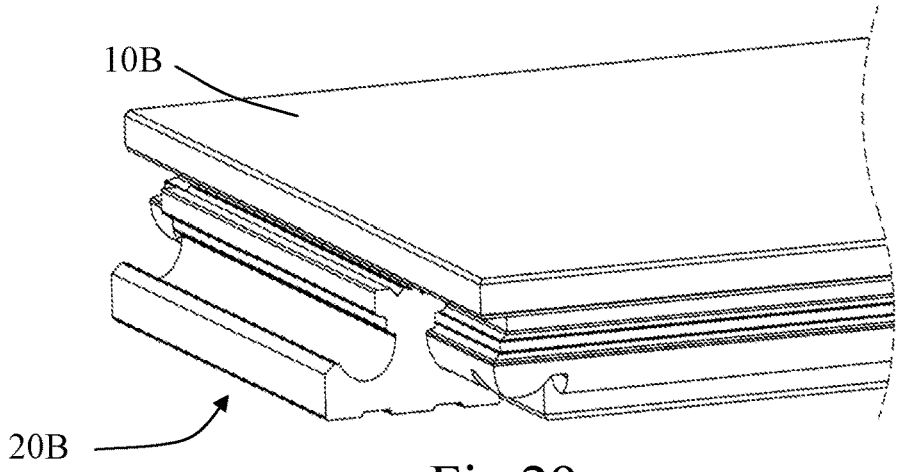
Figure 30:
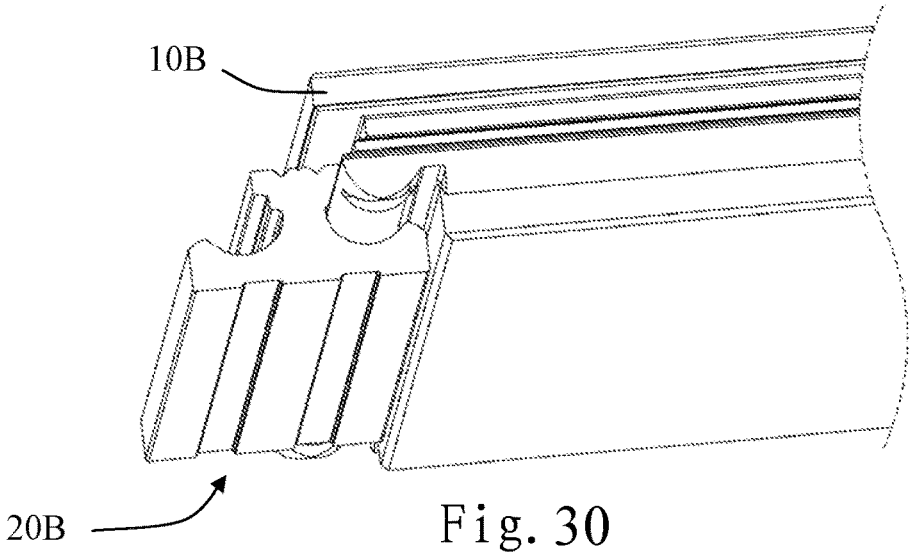

FIGS. 28 to 30 shows the actions to connect the panel 10B with the connector 20B, wherein the panel 10B is connected to the connector 20B by way of pressing.

For the fourth embodiment, the fourth embodiment is a further embedment based on the third embodiment.

Figure 31:
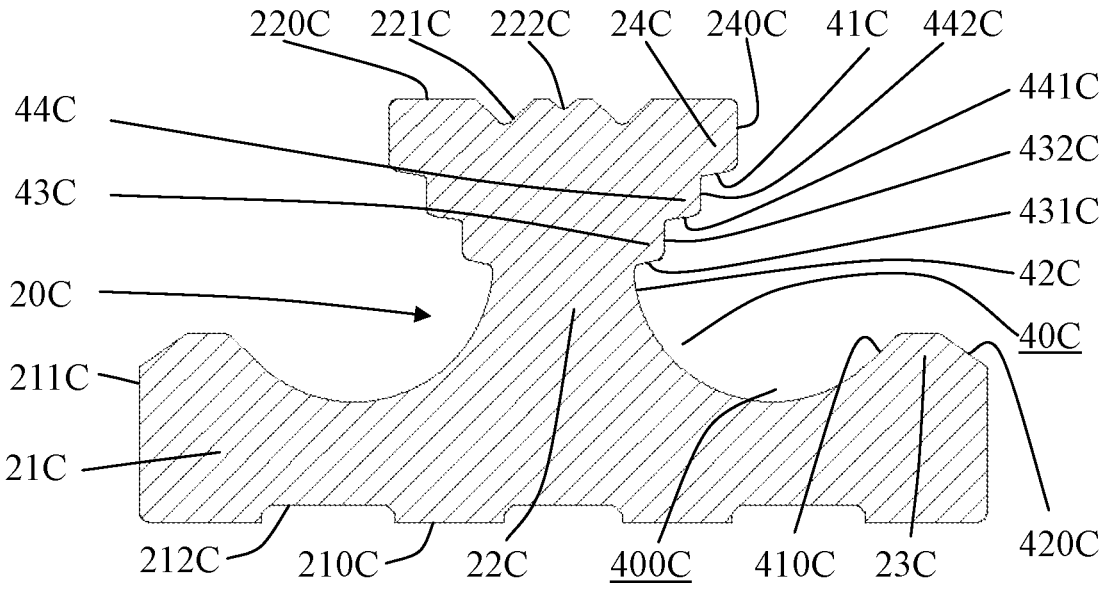
FIG. 31 is the end cross sectional view of the fourth embodiment of the connector of the present invention.

As shown in FIG. 31, the connector 20C for connecting the panels 10C of the fourth embodiment of the present invention comprises a base board 21C and an upright portion 22C extends from the base board 21C. The base board 21C has a bottom face 210C and two side faces 211C. The base board 21C of the connector 20C has a locking member 23C on the top of each of the two sides thereof. A locking piece 24C extends laterally from each of two sides of the upright portion 22C. The locking pieces 24C each have a side face 240C. The upright portion 22C has a top face 220C. In this embodiment, there are two grooves 221C defined in the top face 220C. A groove 222C is defined between the two grooves 221C wherein the two grooves 221C are deeper than the groove 222C. An engaging slot 40C is defined between the locking piece 24C of the upright portion 22C and the locking member 23C of the base board 21C. The engaging slot 40C defines a top wall 41C in the bottom of the locking piece 24C. The upright portion 22C has an inside wall 42C formed in each of two sides thereof. The base board 21C has a lower recess 400C defined in the top face of each of two sides thereof. The locking member 23C is located between the lower recess 400C and the side face 211C. The locking member 23C has a wedge-shaped cross section. The lower recess 400C has an curved wall 410C formed at the inside thereof and facing the locking member 23C. A first ridge 43B and a second ridge 44C extend between the top wall 41C and the inside wall 42D, the first ridge 43C has an engaging face 431C at the underside thereof, and a contact face 432C is formed on a side of the first ridge 43C. The second ridge 44C has an engaging face 441C at the underside thereof, and a contact face 442C is formed on a side of the second ridge 44C.

Two grooves 212C are defined in the bottom face 210C of the base board 21C and located along the longitudinal direction of the panel 20C.

FIG. 31 shows that the distance between the side faces 240C of the two locking pieces 24C of the upright portion 22C of the connector 20C is smaller than that between the side faces 211C of the base board 21C.

An inclined guide face 420C is formed on the outside of the locking member 23C and located between the highest point of the locking member 23C and the side face 211C.

Figure 32:
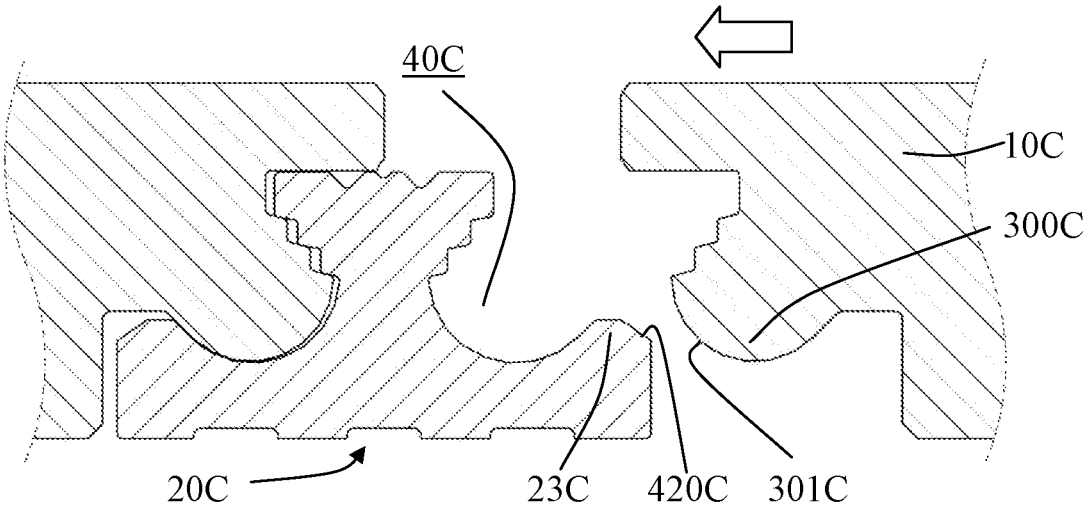
FIGS. 32 to 36 and 38 are cross sectional views to show the actions to connect the panels by the connector of the fourth embodiment of the present invention.
Figure 33:
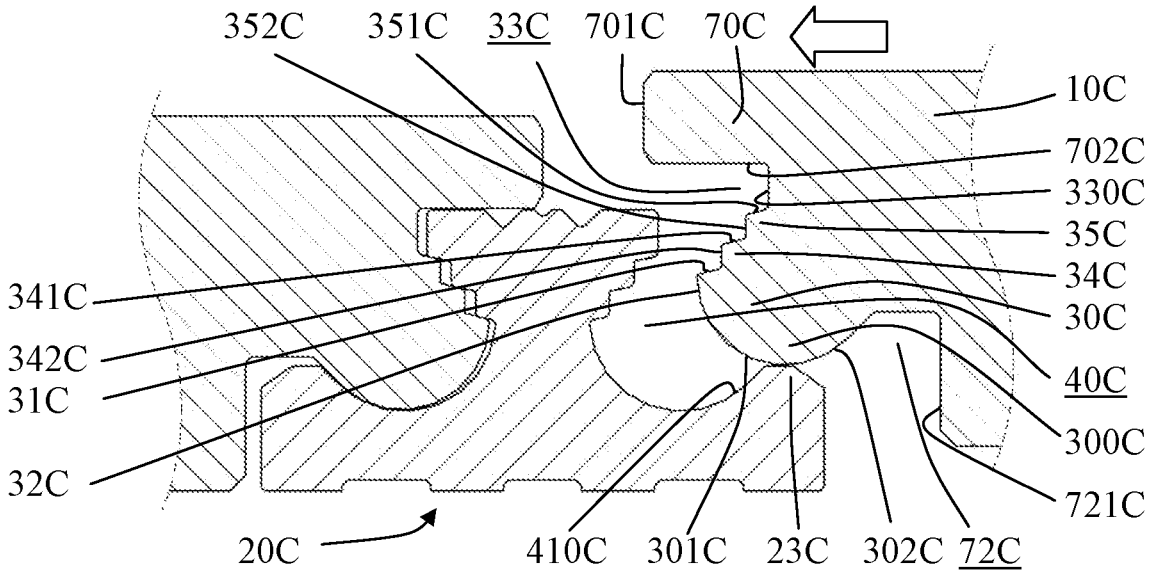

As shown in FIGS. 32, 33, the panel 10C of the present invention comprises a groove 33C defined in the side having the tongue 30C, the groove 33C has an inner side 330C. A top protrusion 70C extends outward from the side having the groove 33C. The top protrusion 70C has an end face 701C and a bottom face 702C. The second surface of the panel 10C has a slot 72C defined in one side thereof. The slot 72C has an inside 721C which faces the side having the slot 72C. A tongue 30C is formed between the groove 33C and the slot 72C. The tongue 30C has a tongue top face 31C which faces the groove 33C, and the tongue 30C has a tongue outer face 32C which faces the side having the groove 33C. The tongue outer face 32C does not protrude beyond the end face 701C of the top protrusion 70C. A first stepped portion 34C and a second stepped portion 35C are formed between the tongue top face 31C and the inner side 330C. The first stepped portion 34C has an engaging face 341C on the top thereof. The first stepped portion 34C has a contact face 342C which faces the side of the panel 10C. The second stepped portion 35C has an engaging face 351C on the top thereof. The second stepped portion 35C has a contact face 352C which faces the side of the panel 10C. The tongue 30C is engaged with the engaging slot 40C when the panel 10C is connected to the connector 20C. The tongue 30C has a lower protrusion 300C. An outer curved face 301C is formed between the outside of the lower protrusion 300C and the tongue outer face 32C. An inner curved face 302C is formed on the inside of the lower protrusion 300C and faces the slot 72C.

Each of the outer curved face 301C and the inner curved face 302C of the lower protrusion 300C of the panel 10B of the fourth embodiment is a curved face.

As shown in FIGS. 32 to 36, and 38, the assembling actions of the fourth embodiment of the present invention are disclosed. FIG. 32 shows that the panel 10C on the left is connected to the connector 20C, and the panel 10C on the right having the tongue 30C is moved toward the connector 20C with the engaging slot 40C on the same plane with the panel 10C.

When the panel 10C contacts the connector 20C on the same plane, the outer curved face 301C of the tongue 30C contacts the guide face 420CB of the locking member 23C of the engaging slot 40C of the panel 10C.

When the panel 10C contacts the connector 20C on the same plane, the at least one side of the contact position is an inclined face or a curved face, so that the curved face guides the panel 10C to change its height relative to the side of the connector 20C. FIG. 32 shows that the panel 10C having the tongue 30C of the fourth embodiment is guided by the curved face and lifted up.

When the panel 10C having the tongue 30C is continuously moved toward the connector 20C having the engaging slot 40C, the outer curved face 301C of the tongue 30C contacts the guide face 420C of the locking member 23C of the engaging slot 40C to lift the panel 10C.

When the lowest point of the lower protrusion 300C of the panel 10CB having the tongue 30 moves to the highest point of the locking member 23 of the connector 20 having the engaging slot 40C, as shown in FIG. 33, the panel 10C cannot be lifted up anymore.

Figure 34:
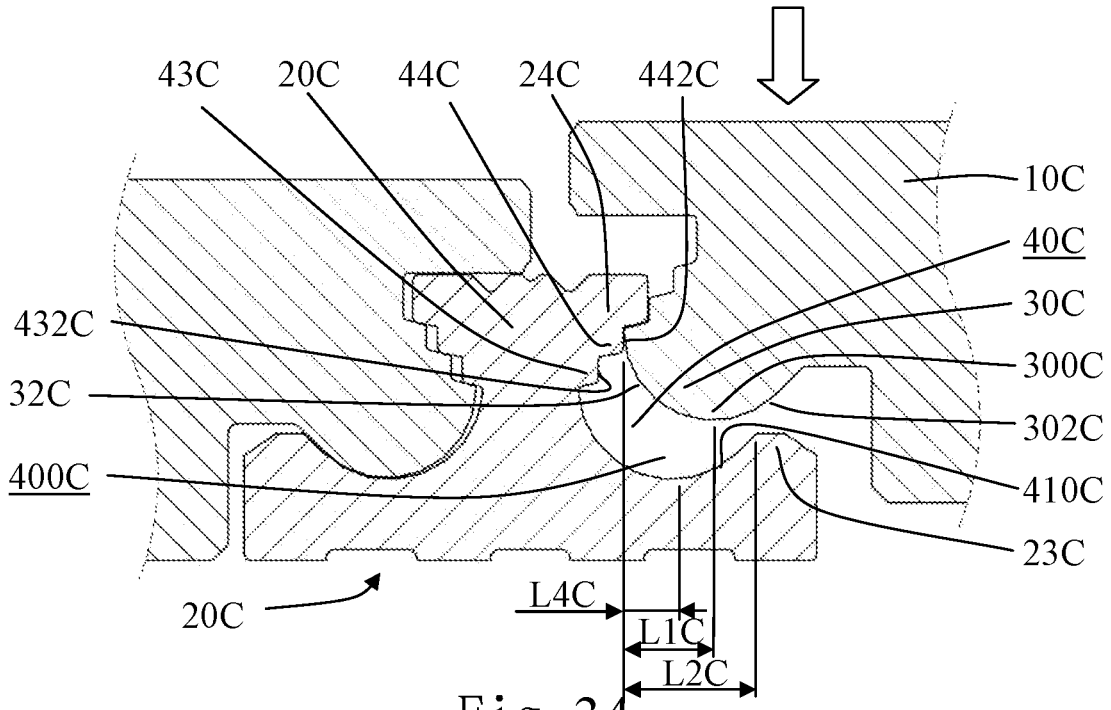

The horizontal distance L1C between a vertical extension line of the lowest point of the lower protrusion 300C of the tongue 30C of the panel 10C and a vertical extension line of the highest point of the tongue outer face 32C of the lower protrusion 300C is smaller than the horizontal distance L2C between a vertical extension line of the highest point of the locking member 23C of the connector 20C and a vertical extension line of the lowest point of the contact face 442C of the second ridge 44C. As shown in FIG. 34, L1C<L2C.

Figure 35:
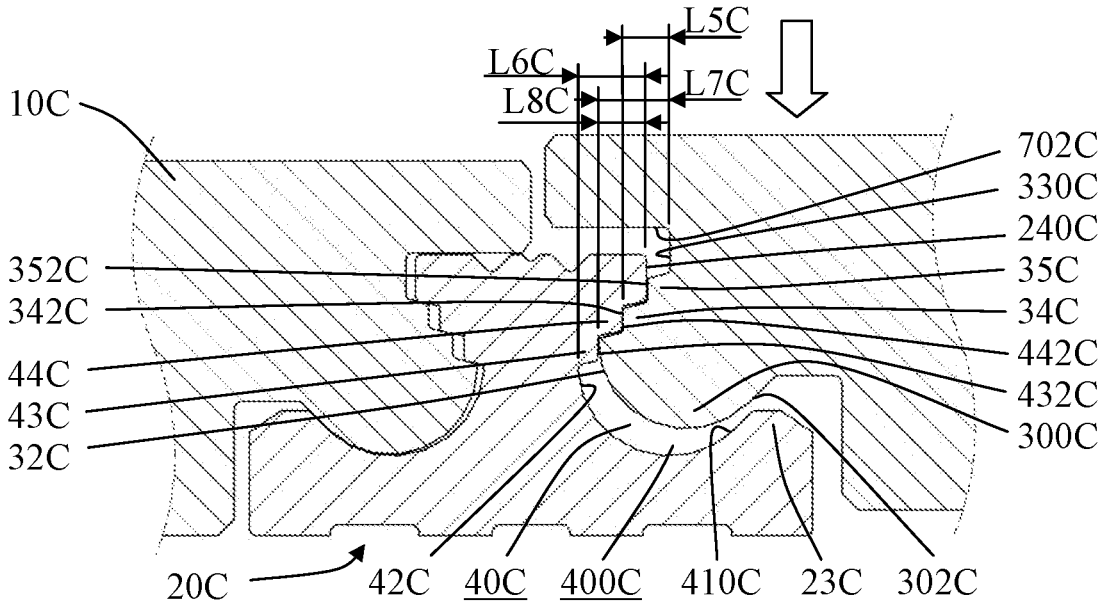

When the panel 10C having the tongue 30C is continuously moved toward the connector 20C having the engaging slot 40C, the lower protrusion 300C of the tongue 30C is moved into the lower recess 400C of the engaging slot 40C of the connector 20C. The inner curved face 302C of the lower protrusion 300C of the tongue 30C contacts the curved wall 410C of the lower recess 400C of the connector 20C. The contact face 432C of the first ridge 43C of the panel 10C contacts the tongue outer face 32C of the tongue 30C. The contact face 442C of the second ridge 44C contacts the contact face 342 of the first stepped portion 34C, and the contact face 352C of the second stepped portion 35 contacts the side face 240 as shown in FIG. 35, so that the panel 10C with the tongue 30C cannot be moved toward the connector 20C having the engaging slot 40C on the same plane. Because of L1C<L2C, during the process of moving the panel 10C having the tongue 30C toward the connector 20C having the engaging slot 40C, when the contact face 432C of the first ridge 43C of the panel 10C contacts the tongue outer face 32C of the tongue 30, and the contact face 342C of the first steeped portion 34C contacts contact face 442C of the second ridge 44C and the contact face 352C of the second stepped portion 35C contacts the side face 240C of the locking piece 24C, the lower protrusion 300C of the tongue 30C is moved into the lower recess 400C of the engaging slot 40C of the connector 20C. Therefore, the connection between the panels 10C and the connector 20C can be completed by pressing the panel 10C.

FIGS. 34 and 35 are used to describe the steps for moving the panels 10C toward the connector 20C. The panel 10C on the right is moved downward a little bit due to the gravity to allow the inner curved face 302C of the lower protrusion 300C of the tongue 30C to contact the curved wall 410C of the lower recess 400C of the connector 20C. Before that the contact face 432C of the first ridge 43C of the panel 10C contacts the tongue outer face 32C of the tongue 30C and/or the contact face 342C of the first ridge 34C contacts contact faced 442C of the second ridge 44C and/or the contact face 352C of the second stepped portion 35C contacts the side face 240C of the locking piece 24C, the panel 10C contacts the connector 20C by the curved face which makes the movement of the panel 10C be easy without using any tool to force the panel 10C to move.

The horizontal distance L1C between a vertical extension line of the lowest point of the lower protrusion 300C of the tongue 30C of the panel 10C and a vertical extension line of the highest point of the tongue outer face 32C of the tongue 30C is larger than the horizontal distance L4C between a vertical extension line of the lowest point of the curved wall 410C of the engaging slot 40C and a vertical extension line of the lowest point of the contact face 442 of the second ridge 44C. As shown in FIG. 34, L1C>L4C.

When the panel 10C having the tongue 30C is continuously moved toward the connector 20C having the engaging slot 40C, and the tongue outer face 32C of the tongue 30C contacts the contact face 442C of the second ridge 44C, the lower protrusion 300C of the tongue 30C is moved into the lower recess 400C of the engaging slot 40C of the connector 20C as shown in FIG. 34. Because of L1C>L4C, the lowest point of the lower protrusion 300C of the tongue 30C is not yet in contact with the lowest point of the curved wall 410C of the engaging slot 40C of the connector 20C. Therefore, the connection between the panels 10C and the connector 20C can be completed by pressing the panel 10C.

The horizontal distance L5C between a vertical extension line of the inner side 330C of the panel 10C and the vertical line of the outside of the contact face 342C of the first stepped portion 34C is smaller than the horizontal distance L6C between a vertical extension line of the outside of the side face 240C of the engaging slot 40C of the connector 20C and the vertical line of the highest point of the inside wall 42C of the engaging slot 40C. As shown in FIG. 35, L5C<L6C.

The horizontal distance L7C between a vertical extension line of the inner side 330C of the panel 10C and the vertical line of highest point of the tongue outer face 32C is larger than the horizontal distance L8C between a vertical extension line of an outside of the side face 240C of the connector 20C and the vertical line of the lowest point of the contact wall 432C of the first ridge 43C. As shown in FIG. 35, L7C>L8C.

By pressing the lifted portion of the panel 10C at the contact portion between the panel 10C and the connector 20C as shown by the arrow head in FIG. 35, the contact face 32C of the tongue 30C contacts the contact face 432C of the first ridge 43C, the contact face 342C of the first stepped portion 34C contacts the contact face 442C of the second ridge 44C, and the contact face 352C of the second stepped portion 35C contacts the side face 240*c*, so that the panel 10C and the connector 20C cannot be moved toward on the same plane. The inner curved face 302C of the lower protrusion 300C of the tongue 30C pushes the curved wall 410C of the engaging slot 40C to deform the material below the engaging slot 40C such that the tongue 30C is able to move downward and into the engaging slot 40C.

Figure 36:
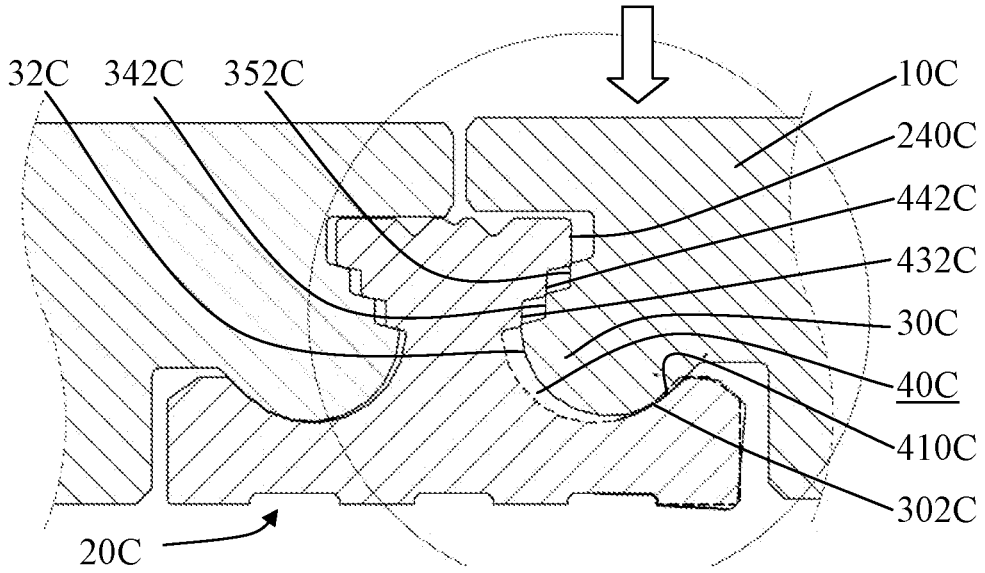
Figure 37:
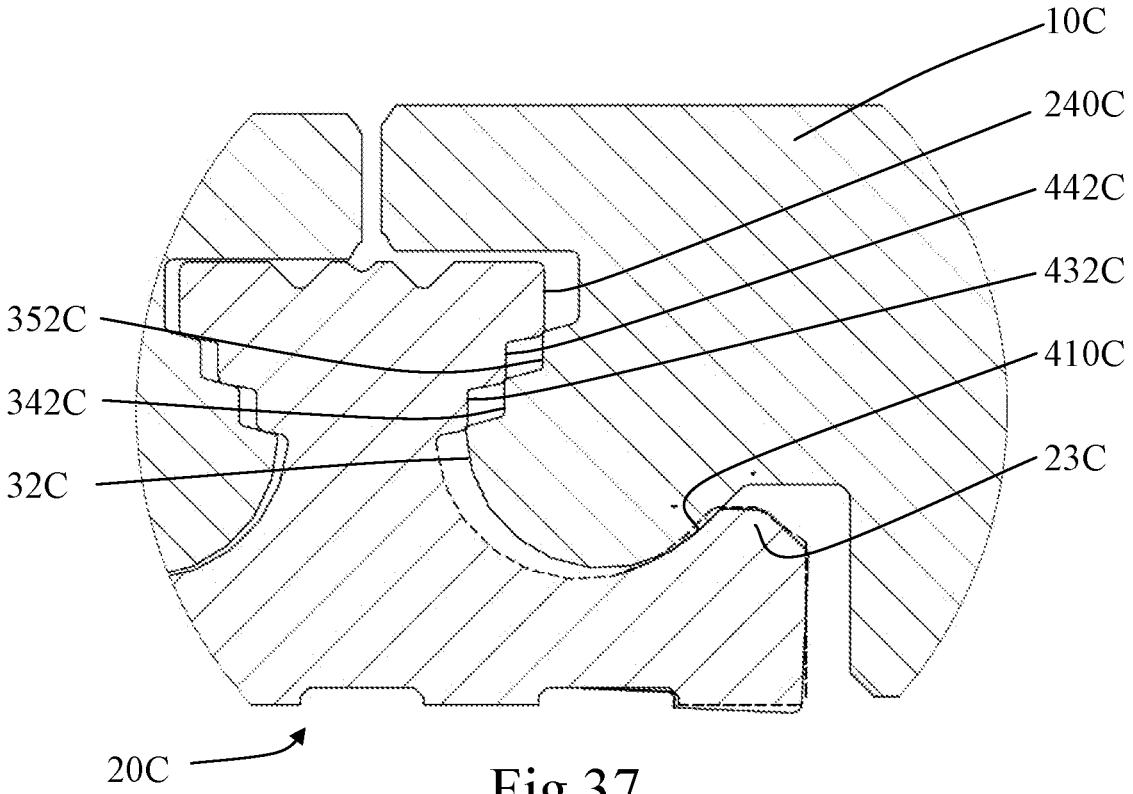
FIG. 37 is an enlarged view of the circled portion in FIG. 36.
Figure 38:
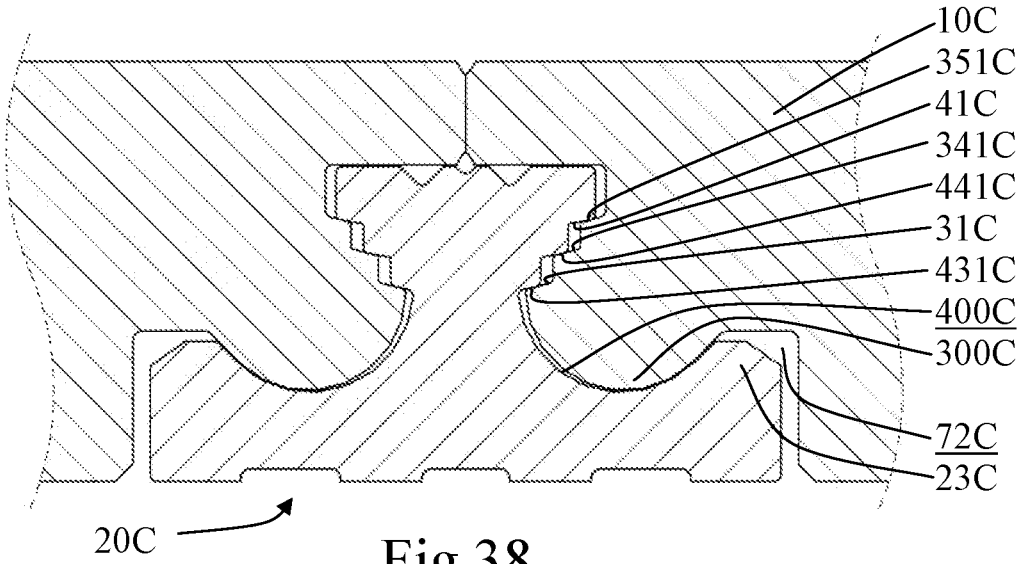

As shown in FIG. 36, when the panel 10C with the tongue 30C is pressed downward, the material below the engaging slot 40C is deformed which is shown by the dotted line and the solid line in FIG. 37. When the material below the engaging slot 40C is deformed to allow the tongue 30C to move downward relative to the engaging slot 40C, the tongue outer 32C of the tongue 30C is offset from contact face 432C of the first ridge 43C of the engaging slot 40C, the contact face 342C of the first stepped portion 34C is offset from the contact face 442C of the second ridge 44C, and the contact face 352C of the second stepped portion 35C is offset from the side face 240C, the lower protrusion 300C of the tongue 30C is engaged with the lower recess 400C of the engaging slot 40C by the guidance of the inner curved face 302C of the lower protrusion 300C and the curved wall 410C of the engaging slot 40C. The locking member 23C is locked in the slot 72C. The material below the engaging slot 40C bounces back by the natural flexibility thereof, the tongue top face 31C of the tongue 30C contacts the underside of the engaging face 431C of the first ridge 43C. The engaging face 341C of the first stepped portion 34C of the tongue 30C contacts the underside of the engaging face 441 of the second ridge 44C, and the engaging face 351C of the second stepped portion 35C contacts the underside of the top wall 41C of the engaging slot 40C. The tongue 30C is then engaged with the engaging slot 40C so that the panel 10C does not disengaged from the connector 20C as shown in FIG. 38.

Figure 39:
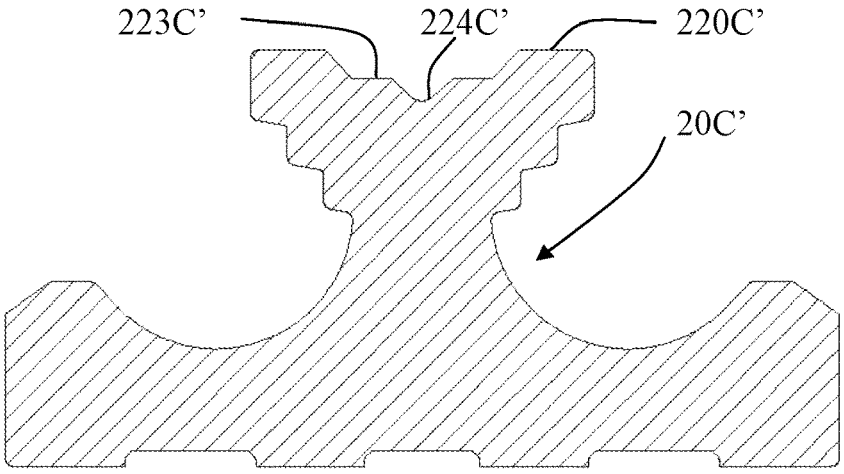
FIG. 39 is an end cross sectional view to show another embodiment of the connector based on the fourth embodiment of the present invention.
Figure 40:
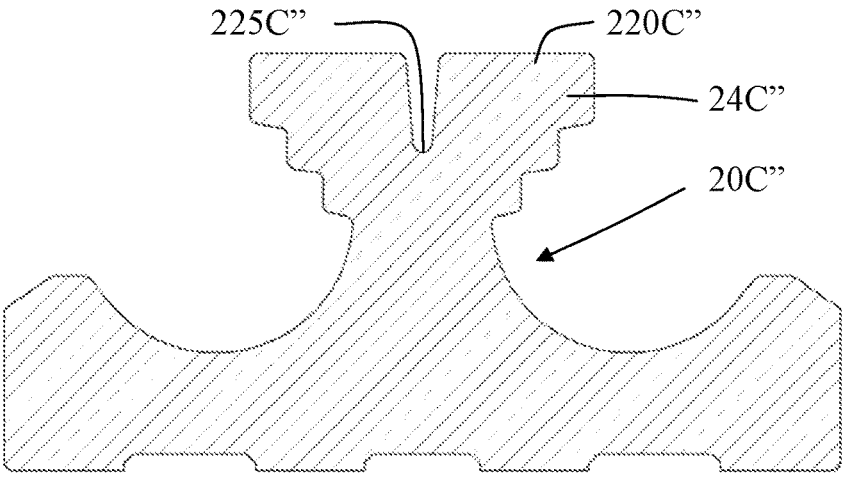
FIG. 40 is an end cross sectional view to show yet another embodiment of the connector based on the fourth embodiment of the present invention.
Figure 41:
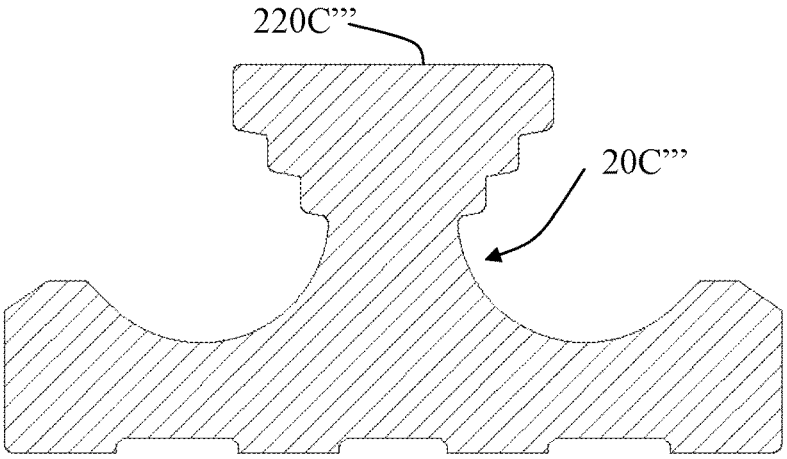
FIG. 41 is an end cross sectional view to show a further embodiment of the connector based on the fourth embodiment of the present invention.

FIGS. 39 to 40 show the alternative embodiment of the connector based on the fourth embodiment, the top face of the connector is different from that of the fourth embodiment. As shown in FIG. 39, the top face 220C' of the connector 20C' has a main groove 223C' and a groove 224C' is defined in the inner end of the main groove 223C'. As shown in FIG. 40, the top face 220C" of the connector 20C" has a central groove 225C" which allows the locking piece 24C" to be resiliently deformed. The top face 220C" of the connector 20C" in FIG. 41 is a flat surface.

For the fifth embodiment of the present invention, which is based on the third embodiment.

Figure 42:
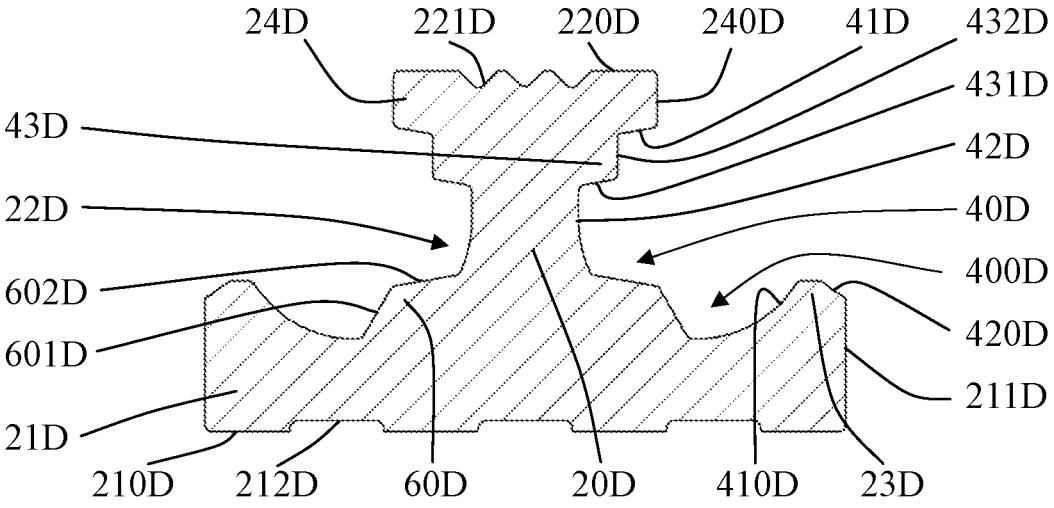
FIG. 42 is a cross sectional view of the fifth embodiment of the connector of the present invention.

FIG. 42 shows that the connector 20D for connecting the panels 10D of the third embodiment of the present invention comprises a base board 21D and an upright portion 22D extends from the base board 21D. The base board 21D has a bottom face 210D and two side faces 211D. The base board 21D of the connector 20D has a locking member 23D on the top of each of the two sides thereof. A locking piece 24D extends laterally from each of two sides of the upright portion 22D. The locking pieces 24D each have a side face 240D. The upright portion 22D has a top face 220D. In this embodiment, there are three grooves 221D defined in the top face 220D. An engaging slot 40D is defined between the locking piece 24D of the upright portion 22D and the locking member 23D of the base board 21D. The engaging slot 40D defines a top wall 41D in the bottom of the locking piece 24D. The upright portion 22D has an inside wall 42D formed in each of two sides thereof. The base board 21D has a lower recess 400D defined in the top face of each of two sides thereof. The locking member 23D is located between the lower recess 400D and the side face 211D. The locking member 23D has a wedge-shaped cross section. The lower recess 400D has an curved wall 410D formed at the inside thereof and facing the locking member 23D. A first ridge 43D extends between the top wall 41D and the inside wall 42D, the first ridge 43D has an engaging face 431D at the underside thereof, and a contact face 432D is formed on a side of the first ridge 43D. A top bump 60D is formed between the inside wall 42D and the curved wall 410D of the lower recess 400D. A side curved face 601D is connected between the outside of the top bump 60D and the curved wall 410D of the lower recess 400D. A top curved face 602D is defined between the top of the top bump 60D and the inside wall 42D.

FIG. 42 shows that the distance between the side faces 240D of the two locking pieces 24D of the upright portion 22D of the connector 20D is smaller than that between the side faces 211D of the base board 21D.

An inclined guide face 420D is formed on the outside of the locking member 23D and located between the highest point of the locking member 23D and the side face 211D.

Three grooves 212D are defined in the bottom face 210D of the base board 21D and located along the longitudinal direction of the panel 20D.

Figure 43:
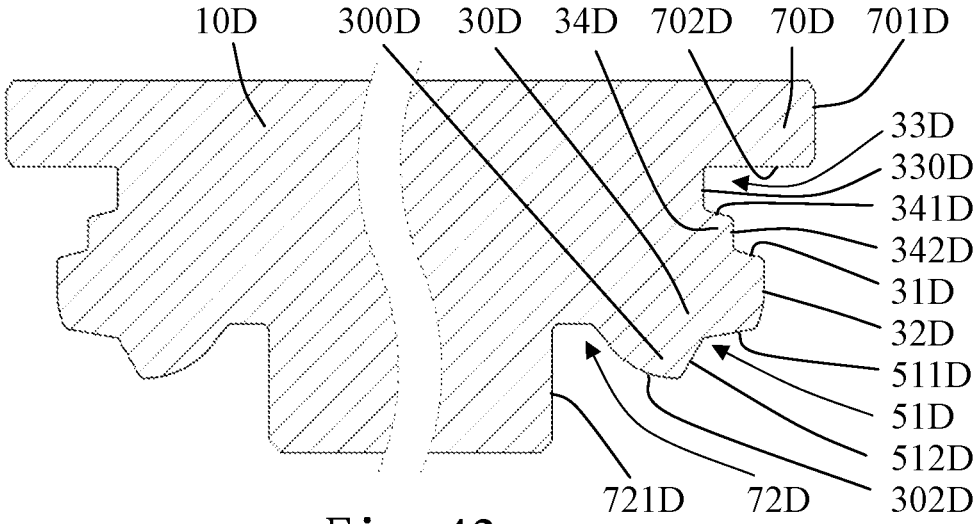
FIG. 43 is an end cross sectional view of the fifth embodiment of the panel of the present invention.

As shown in FIG. 43, the panel 10D of the present invention comprises a groove 33D defined in the side having the tongue 30D, the groove 33D has an inner side 330D. A top protrusion 70D extends outward from the side having the groove 33D. The top protrusion 70D has an end face 701D and a bottom face 702D. The second surface of the panel 10D has a slot 72D defined in one side thereof. The slot 72D has an inside 721D which faces the side having the slot 72D. A tongue 30D is formed between the groove 33D and the slot 72D. The tongue 30D has a tongue top face 31D which faces the groove 33D, and the tongue 30D has a tongue outer face 32D which faces the side having the groove 33D. The tongue outer face 32D does not protrude beyond the end face 701D of the top protrusion 70D. The tongue 30D is engaged with the engaging slot 40D of the connector 20D when the panel 10D is connected to the connector 20D. The tongue 30D has a lower protrusion 300D which is received in the lower recess 400D of the connector 20D. An inner curved wall 302D is formed at the inside of the lower protrusion 300D and faces the slot 72D. A first stepped portion 34D is formed between the tongue top face 31D and the inner side 330D. The first stepped portion 34D has an engaging face 341D on the top thereof. The first stepped portion 34D has a contact face 342D which faces the side of the panel 10D. A top recess 51D is formed between the tongue outer face 32D and the inner curved wall 302D of the lower protrusion 300D. A top inclined face 511D is connected between the outside of the top recess 51D and the tongue outer face 32D. An outer inclined face 512D is connected between the inside of the top recess 51D and the inner curved wall 302D.

Figure 44:
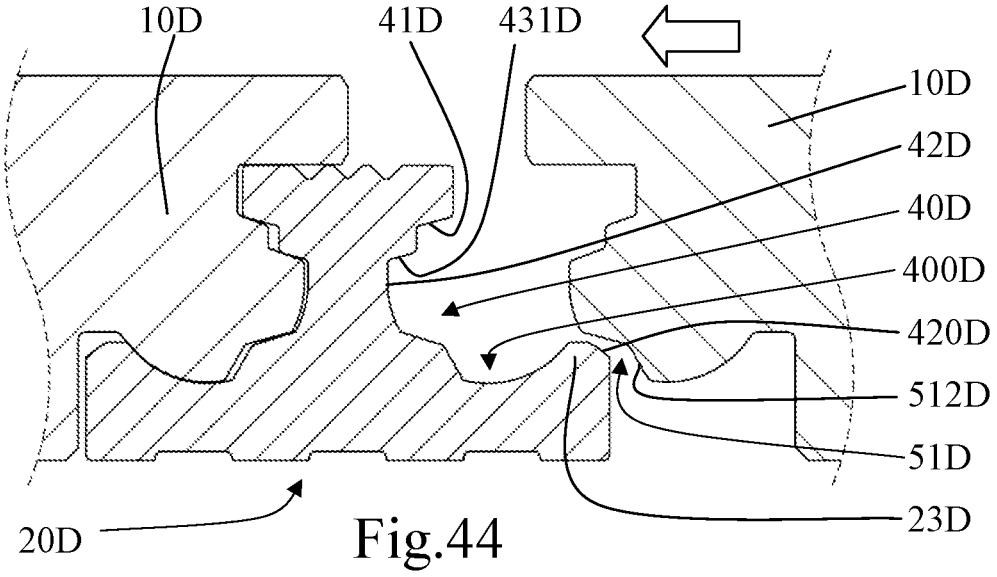
FIGS. 44 to 48 are cross sectional views to show the actions to connect the panels by the connector of the fifth embodiment of the present invention.

As shown in FIGS. 44 to 48, the assembling actions of the fifth embodiment of the present invention are disclosed. FIG. 44 shows that the panel 10D on the left is connected to the connector 20D, and the panel 10D on the right having the tongue 30D on the right is moved toward the connector 20D with the engaging slot 40D on the same plane with the panel 10D.

When the panel 10D contacts the connector 20D on the same plane, the outer inclined face 512D of the top recess 51D contacts the guide face 420D of the locking member 23D of connector 20D.

When the panel 10D contacts the connector 20D on the same plane, the at least one side of the contact position is an inclined face or a curved face, so that the inclined face guides the panel 10D to change its height relative to the side of the connector 20D. The panel 10D having the tongue 30D is guided by the curved face and lifted up.

When the panel 10D having the tongue 30D is continuously moved toward the connector 20D having the engaging slot 40D, the outer inclined face 512D of the top recess 51D of the tongue 30D contacts the guide face 420D of the locking member 23D of the engaging slot 40D to lift the panel 10D.

When the lowest point of the lower protrusion 300D of the panel 10D having the tongue 30D moves to the highest point of the locking member 23D of the connector 20D having the engaging slot 40D, the panel 10D cannot be lifted up anymore.

Figure 45:
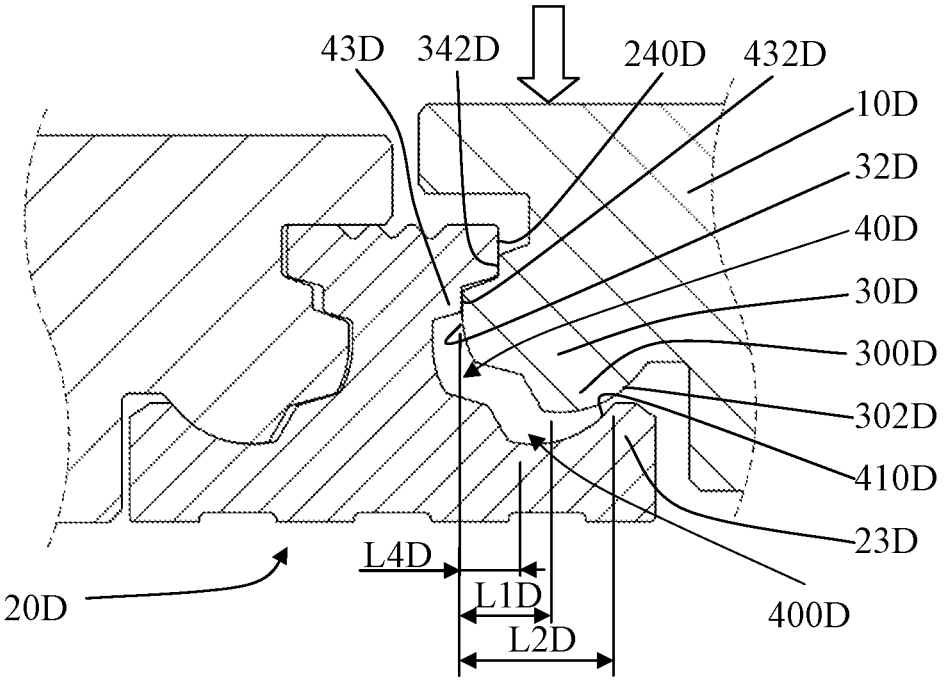

The horizontal distance L1D between a vertical extension line of the lowest point of the lower protrusion 300D of the tongue 30D of the panel 10D and a vertical extension line of the highest point of the tongue outer face 32D of the lower protrusion 300D is smaller than the horizontal distance L2D between a vertical extension line of the highest point of the locking member 23D of the connector 20D and a vertical extension line of the lowest point of the contact face 432D of the first ridge 43D. As shown in FIG. 45, L1D<L2D.

When the panel 10D having the tongue 30D is continuously moved toward the connector 20D having the engaging slot 40D, the lower protrusion 300D of the tongue 30D is moved into the lower recess 400D of the engaging slot 40D of the connector 20D. The inner curved face 302D of the lower protrusion 300D of the tongue 30D contacts the curved wall 410D of the lower recess 400D of the connector 20D. The contact face 432D of the first ridge 43D of the panel 10D contacts the tongue outer face 32D of the tongue 30D. The contact face 342D of the first stepped portion 34D contacts the side face 240D as shown in FIG. 45, so that the panel 10D with the tongue 30D cannot be moved toward the connector 20D having the engaging slot 40D on the same plane. Because of L1D<L2D, during the process of moving the panel 10D having the tongue 30D toward the connector 20D having the engaging slot 40D, when the contact face 432D of the first ridge 43D of the panel 10D contacts the tongue outer face 32D of the tongue 30D, and the contact face 342D of the first ridge 34D contacts the side face 240D of the locking piece 24D, the lower protrusion 300D of the tongue 30D is moved into the lower recess 400D of the engaging slot 40D of the connector 20D. Therefore, the connection between the panels 10D and the connector 20D can be completed by pressing the panel 10D.

FIG. 45 is used to describe the steps for moving the panels 10D toward the connector 20D. The panel 10D on the right is moved downward a little bit due to the gravity to allow the inner curved face 302D of the lower protrusion 300D of the tongue 30D to contact the curved wall 410D of the lower recess 400D of the connector 20D. Before that the tongue outer face 32D of the panel 10D contacts the contact face 432D of the first ridge 43D of the connector 20D, and/or before the contact face 342D of the first ridge 34D contacts the side face 240D of the locking piece 24D, the panel 10D contacts the connector 20D by the curved face which makes the movement of the panel 10D be easy without using any tool to force the panel 10D to move.

The horizontal distance L1D between a vertical extension line of the lowest point of the lower protrusion 300D of the tongue 30D of the panel 10D and a vertical extension line of the highest point of the tongue outer face 32D of the tongue 30D is larger than the horizontal distance L4D between a vertical extension line of the lowest point of the curved wall 410D of the engaging slot 40D and a vertical extension line of the lowest point of the contact face 432D of the first ridge 43D. As shown in FIG. 45, L1B>L4B.

Figure 46:
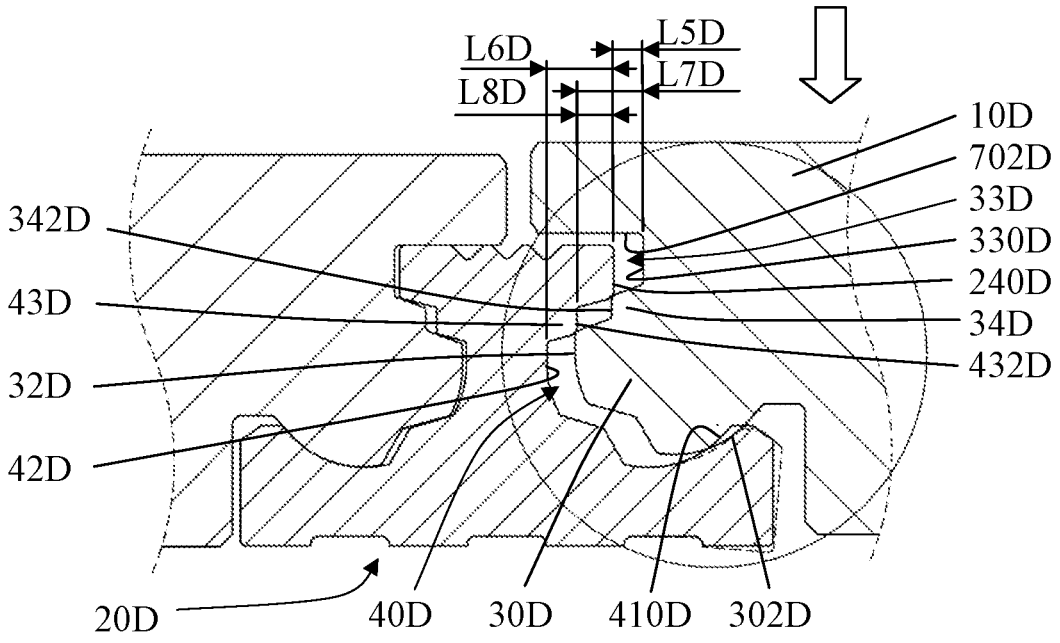

When the panel 10D having the tongue 30D is continuously moved toward the connector 20D having the engaging slot 40D, and the tongue outer face 32D of the tongue 30D contacts the contact face 432D of the first ridge 43D, and/or the contact face 342D of the first stepped portion 34D of the panel 10D contacts the side face 240D of the connector 20D, the lower protrusion 300D of the tongue 30D is moved into the lower recess 400D of the engaging slot 40D of the connector 20D as shown in FIG. 46. Because of L1D>L4D, the lowest point of the lower protrusion 300D of the tongue 30D is not yet in contact with the lowest point of the curved wall 410D of the top recess 51D. Therefore, the connection between the panels 10D and the connector 20D can be completed by pressing the panel 10D.

The horizontal distance L5D between a vertical extension line of the inner side 330D of the panel 10D and the vertical line of the outside of the contact face 342D of the first stepped portion 34D is smaller than the horizontal distance L6D between a vertical extension line of the outside of the side face 240D of the engaging slot 40D of the connector 20D and the vertical line of the highest point of the inside wall 42D of the engaging slot 40D. As shown in FIG. 46, L5D<L6D.

The horizontal distance L7D between a vertical extension line of the inner side 330D of the panel 10D and the vertical line of highest point of the tongue outer face 32D is larger than the horizontal distance L8D between a vertical extension line of an outside of the side face 240D of the connector 20D and the vertical line of the lowest point of the contact wall 432D of the first ridge 43D. As shown in FIG. 46, L7D>L8D.

By pressing the lifted portion of the panel 10D at the contact portion between the panel 10D and the connector 20D as shown by the arrow head in FIG. 46, the contact face 32D of the tongue 30D contacts the contact face 432D of the first ridge 43D, and the contact face 342D of the first stepped portion 34D contacts the side face 240D, so that the panel 10D and the connector 20D cannot be moved toward on the same plane. The inner curved face 302D of the lower protrusion 300D of the tongue 30D pushes the curved wall 410D of the engaging slot 40D to deform the material below the engaging slot 40D such that the tongue 30D is able to move downward and into the engaging slot 40D.

Figure 47:
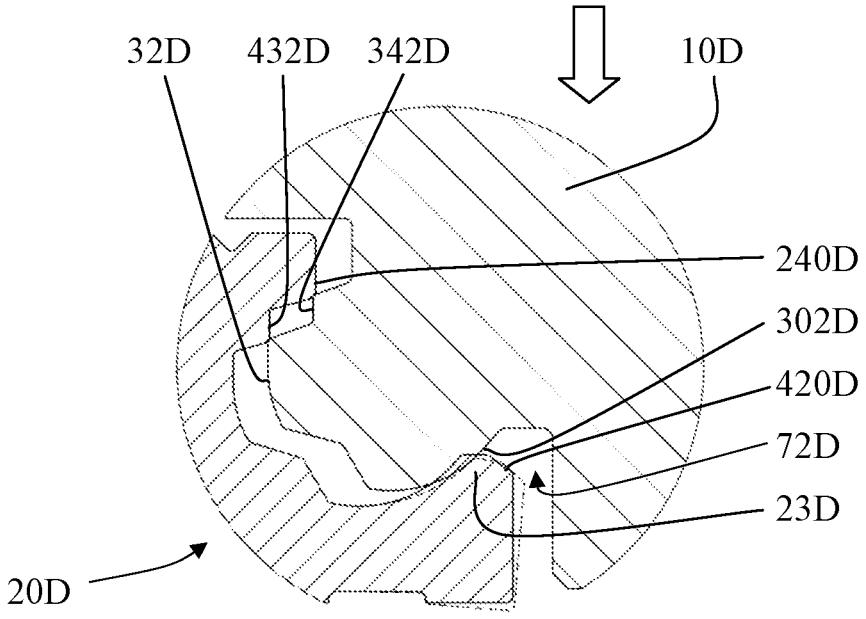
Figure 48:
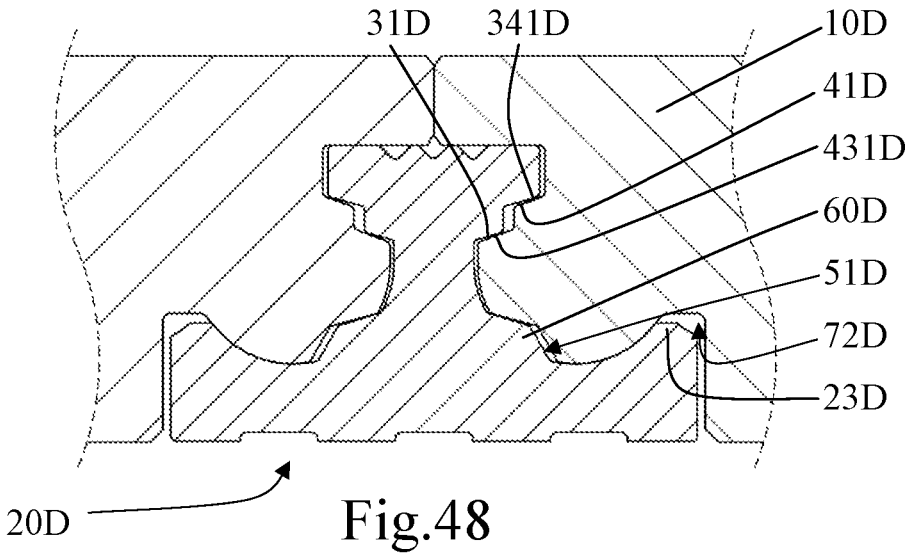

As shown in FIG. 46, when the panel 10D with the tongue 30D is pressed downward, the material below the engaging slot 40D is deformed which is shown by the dotted line and the solid line in FIG. 47. When the material below the engaging slot 40D is deformed to allow the tongue 30D to move downward relative to the engaging slot 40D, the tongue outer 32D of the tongue 30D is offset from contact face 432D of the first ridge 43D of the engaging slot 40D, and the contact face 342D of the first stepped portion 34D is offset from the side face 240D, the lower protrusion 300D of the tongue 30D is engaged with the lower recess 400D of the engaging slot 40D by the guidance of the inner curved face 302D of the lower protrusion 300D and the curved wall 410D of the engaging slot 40D. The top bump 60D is engaged with the top recess 51D of the tongue 30D. The locking member 23D is locked in the slot 72D. The material below the engaging slot 40D bounces back by the natural flexibility thereof, the tongue top face 31D of the tongue 30D contacts the underside of the engaging face 431D of the first ridge 43D. The engaging face 341D of the first stepped portion 34D of the tongue 30D contacts the underside of the top wall 41D of the locking piece 24D. The tongue 30D is then engaged with the engaging slot 40D so that the panel 10D does not disengaged from the connector 20D as shown in FIG. 48.

The tongue top face 31D of the first stepped portion 34D contacts the engaging face 431D of the first ridge 43D. The engaging face 341D of the first stepped portion 34D of the tongue 30D contacts the top wall 41D of the locking piece 24D. The locking member 23D is engaged with the slot 72D. The top bump 60D is engaged with the top recess 51D of the tongue 30D. The inner curved face 302D of the lower protrusion 300D of the tongue 30D contacts the curved wall 410D of the engaging slot 40D. The tongue 30D is engaged with the engaging slot 40D because that the material below the engaging slot 40D is deformed. After the tongue 30D is engaged with the engaging slot 40D, the material below the engaging slot 40D returns to its initial status, the distance between the outside of the engaging face 341D of the first stepped portion 34D and any point of the contact area between the curved wall 410D and the inner curved face 302D is larger than the distance between the intersection point between the engaging face 431D of the first ridge 43D of the engaging slot 40D and the contact face 432D to the correspondent contact portion of the curved wall 410D. The tongue 30D of the fifth embodiment cannot be engaged with the engaging slot 40D if the material below the engaging slot 40D is not deformed, so that the tongue 30D is securely connected with the engaging slot 40D.

Figure 49:
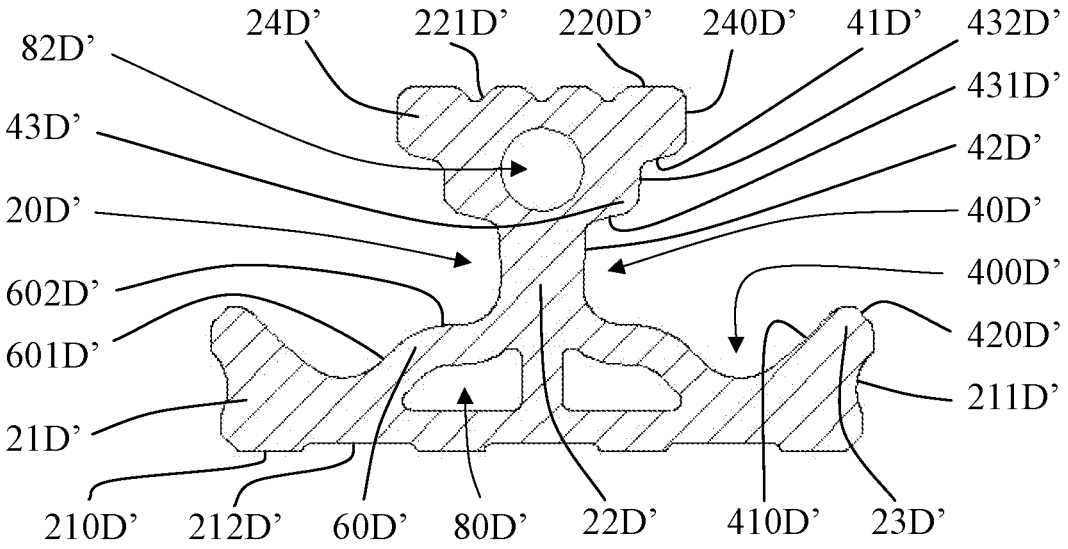
FIG. 49 is an end cross sectional view to show another embodiment of the connector based on the fifth embodiment of the present invention.

FIG. 49 shows another embodiment base on the fifth embodiment, wherein the connector 20D' of this embodiment is the same as that in the fifth embodiment, and comprises a base board 21D' and an upright portion 22D' extends from the base board 21D'. The base board 21D' has a bottom face 210D' and two side faces 211D'. The base board 21D' of the connector 20D' has a locking member 23D' on the top of each of the two sides thereof. A locking piece 24D' extends laterally from each of two sides of the upright portion 22D'. The locking pieces 24D' each have a side face 240D'. The upright portion 22D' has a top face 220D'. In this embodiment, there are three grooves 221D' defined in the top face 220D'. An engaging slot 40D' is defined between the locking piece 24D' of the upright portion 22D' and the locking member 23D' of the base board 21D'. The engaging slot 40D' defines a top wall 41D' in the bottom of the locking piece 24D'. The upright portion 22D' has an inside wall 42D' formed in each of two sides thereof. The base board 21D' has a lower recess 400D' defined in the top face of each of two sides thereof. The locking member 23D' is located between the lower recess 400D' and the side face 211D'. The locking member 23D' has a wedge-shaped cross section. The lower recess 400D' has an curved wall 410D' formed at the inside thereof and facing the locking member 23D'. A first ridge 43D' extends between the top wall 41D' and the inside wall 42D', the first ridge 43D' has an engaging face 431D' at the underside thereof, and a contact face 432D' is formed on a side of the first ridge 43D'. A top bump 60D' is formed between the inside wall 42D' and the curved wall 410D' of the lower recess 400D'. A side curved face 601D' is connected between the outside of the top bump 60D' and the curved wall 410D' of the lower recess 400D'. A top curved face 602D' is defined between the top of the top bump 60D' and the inside wall 42D'.

The distance between the side faces 240D' of the two locking pieces 24D' of the upright portion 22D' of the connector 20D' is smaller than that between the side faces 211D' of the base board 21D'.

An inclined guide face 420D' is formed on the outside of the locking member 23D' and located between the highest point of the locking member 23D' and the side face 211D' of the base board 21D'.

Three grooves 212D' are defined in the bottom face 210D' of the base board 21D' and located along the longitudinal direction of the panel 20D'.

The side faces 211D' of the base board 21D' of the connector 20D' are two recessed walls which save the use of material and also increase flexibility of the locking member 23D' of the base board 21D'.

An inclined face is connected between the side face 240D' of the locking piece 24D' of the connector 20D' and the top face 220D'.

An inclined face is connected between the side face 240D' of the locking piece 24D' of the connector 20D' and the top wall 41D'.

An inclined face is connected between the engaging face 431D' of the first ridge 43D' of the connector 20D' and the contact face 432D'.

The inclined faces mentioned above provide a good transition of the engagement between the panel 10D' and the connector 20D', so that the connection between the panel 10D' and the connector 20D' is smooth with less interference.

A space 80D' is defined between the base board 21D' of the connector 20D' and the upright portion 22D', another space 82D' is defined between the upright portion 22D' and the locking piece 24D'. The two spaces 80D', 82D' save the use of material and make the connector 20D' be light in weight.

Figure 50:
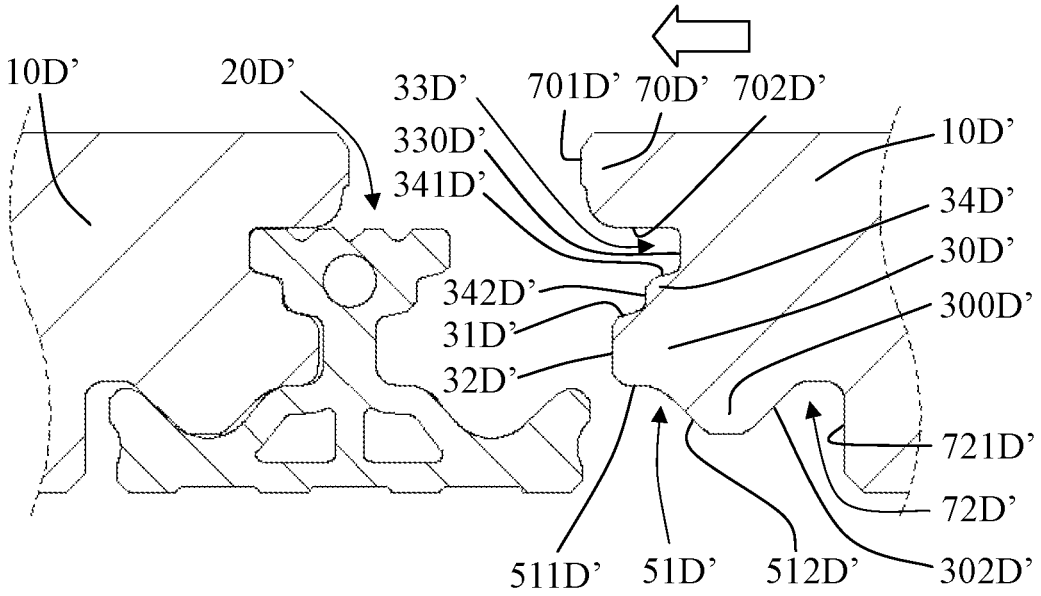
FIGS. 50 to 53 and 55 are cross sectional views to show the actions to connect the panels by the connector of the embodiment in FIG. 49.
Figure 51:
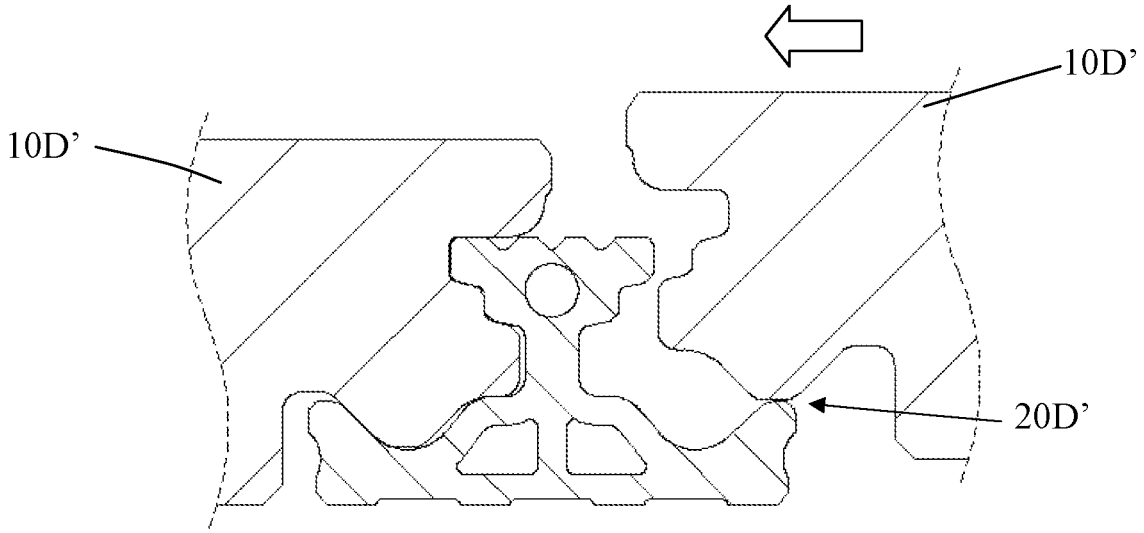
Figure 52:
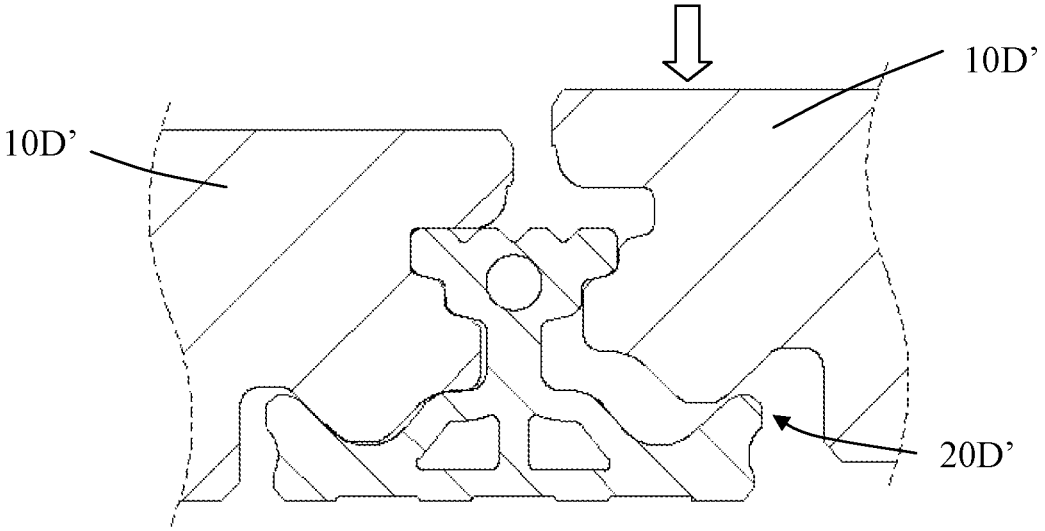
Figure 53:
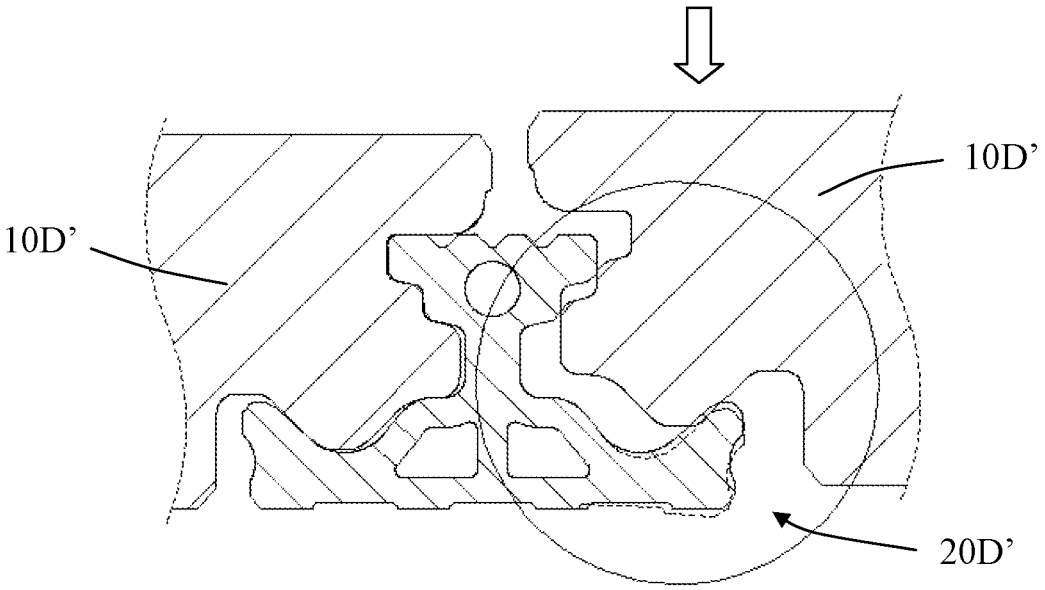

As shown in FIG. 50 which shows another embodiment based on the fifth embodiment, wherein the panel 10D' has a first surface, a second surface located corresponding to the first surface, and a side. The panel 10D' comprises a groove 33D' defined in the side having the tongue 30D', the groove 33D' has an inner side 330D'. A top protrusion 70D' extends outward from the side having the groove 33D'. The top protrusion 70D' has an end face 701D' and a bottom face 702D'. The second surface of each panel 10D' has a slot 72D' defined in one side thereof. The slot 72D' has an inside 721D' which faces the side having the slot 72D'. A tongue 30D' is formed between the groove 33D' and the slot 72D'. The tongue 30D' has a tongue top face 31D' which faces the groove 33D', and the tongue 30D' has a tongue outer face 32D' which faces the side having the groove 33D'. The tongue outer face 32D' does not protrude beyond the end face 701D' of the top protrusion 70D'. The tongue 30D' is engaged with the engaging slot 40D' of the connector 20D' when the panel 10D' is connected to the connector 20D'. The tongue 30D' has a lower protrusion 300D' which is received in the lower recess 400D' of the connector 20D'. An inner curved wall 302D' is formed at the inside of the lower protrusion 300D' and faces the slot 72D'. A first stepped portion 34D' is formed between the tongue top face 31D' and the inner side 330D'. The first stepped portion 34D' has an engaging face 341D' on the top thereof. The first stepped portion 34D' has a contact face 342D' which faces the side of the panel 10D'. A top recess 51D' is formed between the tongue outer face 32D' and the inner curved wall 302D' of the lower protrusion 300D'. A top inclined face 511D' is connected between the outside of the top recess 51D' and the tongue outer face 32D'. An outer inclined face 512D' is connected between the top inclined face 511D' and the outer inclined face 512D'.

An inclined face is formed between the first surface of the panel 10D' and the end face 701D'.

A curved face is formed between end face 701D' of the top protrusion 70D' of the panel 10D' and the bottom face 702D'.

An inclined face is formed between the engaging face 341D' of the first stepped portion 34D' of the panel 10D' and the contact face 342D'.

Another inclined face is formed between the tongue top face 31D' of the tongue 30D' of the panel 10D' and the tongue outer face 32D'.

The inner curved wall 302D' of the lower protrusion 300D' is an curved wall. The outer inclined face 512D' and the top inclined face 511D' each are an inclined face.

Figure 54:
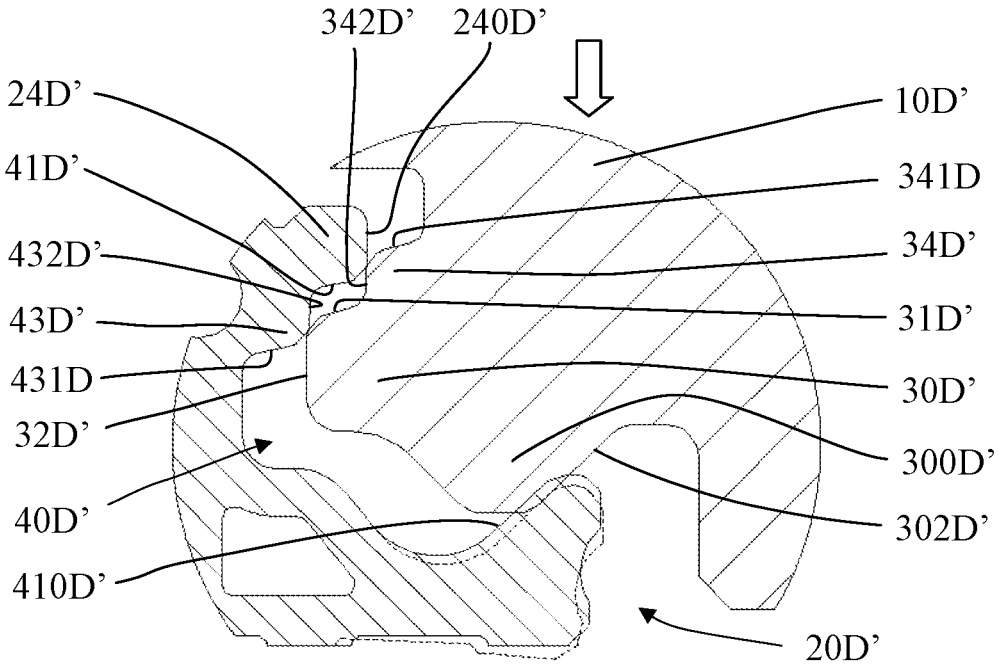
FIG. 54 is an enlarged view of the circled portion in FIG. 53.
Figure 55:
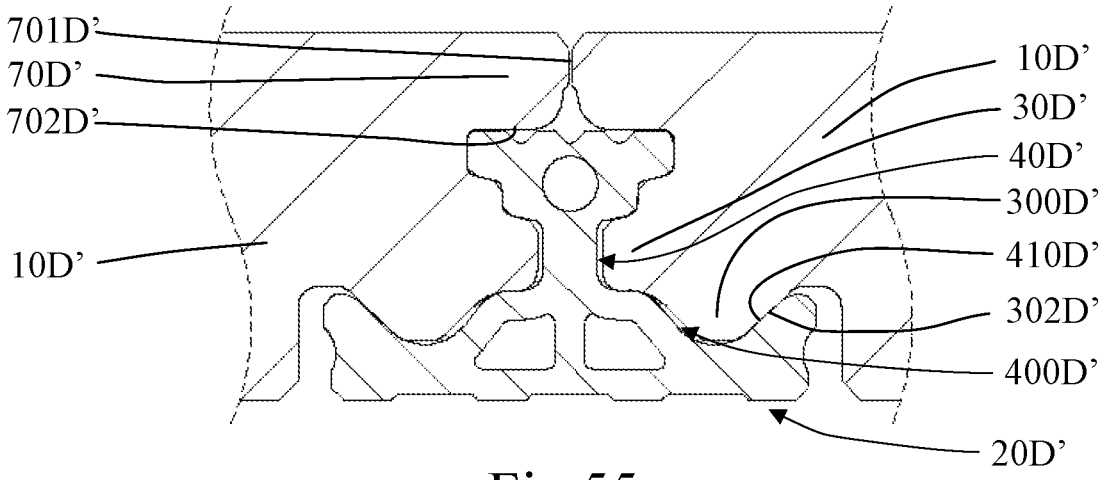

FIGS. 50 to 53 and 55 is an embodiment based on the fifth embodiment disclosed in FIG. 49, the steps for connecting the panels 10D' and the connector 20D' are the same as those in the fifth embodiment, and will not describe again. FIG. 54 shows that when the panel 10D' having the tongue 30D' is pressed downward along the arrow head, the material below the engaging slot 40D' is deformed which is shown by the dotted line and the solid line in FIG. 54. When the material below the engaging slot 40D' is deformed, the tongue 30D' to move downward relative to the engaging slot 40D', and the tongue outer 32D' of the tongue 30D' is offset from contact face 432D' of the first ridge 43D', and the contact face 342D' of the first stepped portion 34D' is offset from the side face 240D', the lower protrusion 300D' of the tongue 30D' is engaged with the lower recess 400D' of the engaging slot 40D' by the guidance of the inner curved face 302D' of the lower protrusion 300D' and the curved wall 410D' of the engaging slot 40D'. The top bump 60D' is engaged with the top recess 51D' of the tongue 30D'. The locking member 23D' is locked in the slot 72D'. The material below the engaging slot 40D' bounces back by the natural flexibility thereof, the engaging face 341D of the first stepped portion 34D' contacts the underside of the top wall 41D' of the locking piece D'. The tongue top face 31D' of the tongue 30D' of the tongue 30D contacts the underside of the engaging face 431D' of the first ridge 43D'. The tongue 30D' is then engaged with the engaging slot 40D' so that the panel 10D' does not disengaged from the connector 20D' as shown in FIG. 55. When the material below the engaging slot 40D' is deformed, the tongue 30D' to move downward relative to the engaging slot 40D', and the tongue outer 32D' of the tongue 30D' is offset from contact face 432D' of the first ridge 43D', and the contact face 342D' of the first stepped portion 34D' is offset from the side face 240D', because the inclined face is formed between the engaging face 341D' of the first stepped portion 34D' of the panel 10D' and the contact face 342D', the inclined face is formed between the side face 240D' of the locking piece 24D' of the panel 10D' and the top wall 41D', the inclined face is formed between the tongue top face 31D' of the tongue 30D' of the panel 10D' and the tongue outer face 32D', and the inclined face is formed between the engaging face 431D' of the first ridge 43D' of the connector 20D' and the contact face 432D', so that the panel 10D' can easily move relative to the connector 20D' without interference by the corners.

FIG. 55 shows that the two panels 10D' are connected to the connector 20D'. When the two panels 10D' are disengaged from the connector 20D', the side of the panel 10D' that is located remote from the connector 20D' is lifted to let the lower protrusion 300D' of the tongue 30D' push the curved wall 410D' to deform the connector 20D' as shown in FIG. 54. The lower protrusion 300D' of the tongue 30D' is then disengaged from the lower recess 400D' of the connector 20D', and the tongue 30D' is disengaged from the engaging slot 40D'. When the side of each of the two panels 10D' that is located remote from the connector 20D' simultaneously, the top protrusions 70D' of the two panels 10D' contact each other to form the fulcrum about which the panels 10D' are pivoted. At this situation, the inclined face is formed between the first surface of the panel 10D' and the end face 701D', so that the side of the first surface of the panel 10D' is avoided from being damaged when the panel 10D' is pivoted. The curved face is formed between the end face 701D' of the top protrusion 70D' of the panel 10D' and the bottom face 702D', the curved face avoids the panel 10D' from being interfered by the top face 220D' of the connector 20D' when the panel 10D' is pivoted.

Figure 56:
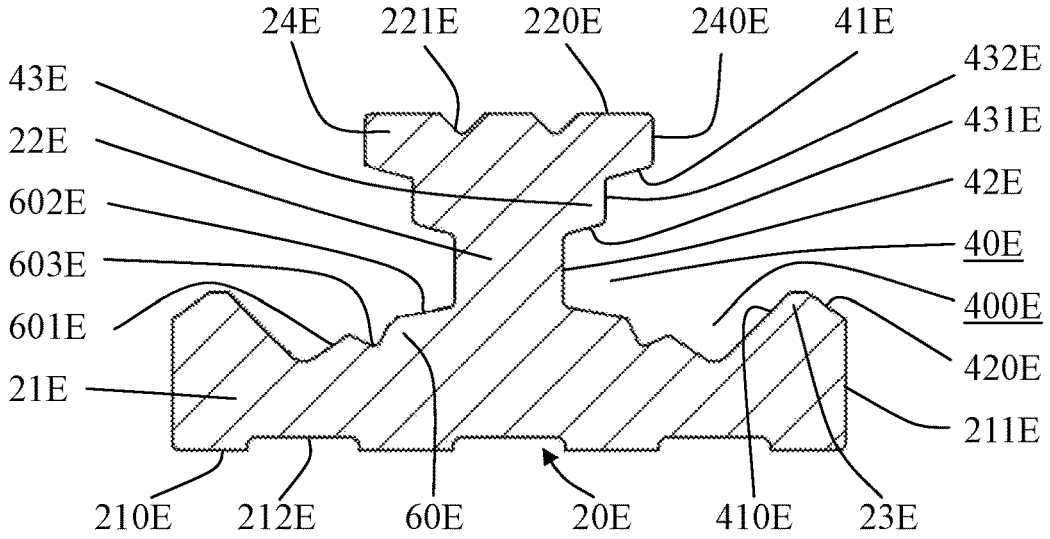
FIG. 56 is an end cross sectional view of the sixth embodiment of the connector of the present invention.

For the sixth embodiment, the sixth embodiment is based on the third embodiment, wherein the connector 20E is disclosed in FIG. 56 and comprises a base board 21E and an upright portion 22E extends from the base board 21E. The base board 21E has a bottom face 210E and two side faces 211E. The base board 21E of the connector 20E has a locking member 23E on the top of each of the two sides thereof. A locking piece 24E extends laterally from each of two sides of the upright portion 22E. The locking pieces 24E each have a side face 240E. The upright portion 22E has a top face 220E. In this embodiment, there are two grooves 221E defined in the top face 220E. An engaging slot 40E is defined between the locking piece 24E of the upright portion 22E and the locking member 23E of the base board 21E. The engaging slot 40E defines a top wall 41E in the bottom of the locking piece 24E. The upright portion 22E has an inside wall 42E formed in each of two sides thereof. The base board 21E has a lower recess 400E defined in the top face of each of two sides thereof. The locking member 23E is located between the lower recess 400E and the side face 211E. The locking member 23E has a wedge-shaped cross section. The lower recess 400E has an curved wall 410E formed at the inside thereof and facing the locking member 23E. A first ridge 43E extends between the top wall 41E and the inside wall 42E, the first ridge 43E has an engaging face 431E at the underside thereof, and a contact face 432E is formed on a side of the first ridge 43E. A top bump 60E is formed between the inside wall 42E and the curved wall 410E of the lower recess 400E. A side inclined face 601E is connected between the outside of the top bump 60E and the curved wall 410E of the lower recess 400E. A top curved face 602E is defined between the top of the top bump 60E and the inside wall 42E. A notch 603E is formed between the side curved face 601E and the top curved face 602E.

FIG. 56 shows that the distance between the side faces 240E of the two locking pieces 24E of the upright portion 22E of the connector 20E is smaller than that between the side faces 211E of the base board 21E.

An inclined guide face 420E is formed on the outside of the locking member 23E and located between the highest point of the locking member 23E and the side face 211E.

Two grooves 212E are defined in the bottom face 210E of the base board 21E and located along the longitudinal direction of the panel 20E.

The curved wall 410E of the lower recess 400 that is located close to the inside of the locking member 23 is an curved wall.

The notch 603E between the side inclined face 601E and the top curved face 602E properly adjust the force to deform the base board 21E.

Figure 57:
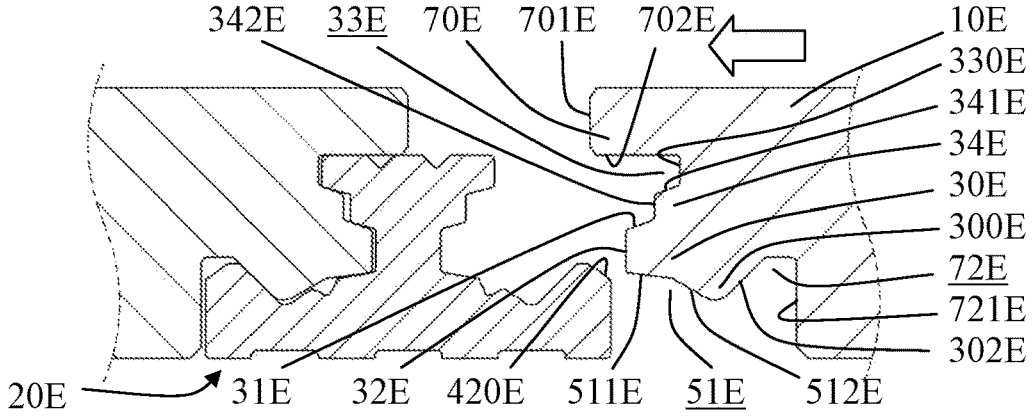
FIGS. 57 to 61 are cross sectional views to show the actions to connect the panels by the connector of the sixth embodiment of the present invention.

As shown in FIG. 57, the panel 10E of sixth embodiment of the present invention comprises a groove 33E defined in the side having the tongue 30E, the groove 33E has an inner side 330E. A top protrusion 70E extends outward from the side having the groove 33E. The top protrusion 70E has an end face 701E and a bottom face 702E. The second surface of the panel 10E has a slot 72E defined in one side thereof. The slot 72E has an inside 721E which faces the side having the slot 72E. A tongue 30E is formed between the groove 33E and the slot 72E. The tongue 30E has a tongue top face 31E which faces the groove 33E, and the tongue 30E has a tongue outer face 32E which faces the side having the groove 33E. The tongue outer face 32E does not protrude beyond the end face 701E of the top protrusion 70E. The tongue 30E is engaged with the engaging slot 40E of the connector 20E when the panel 10E is connected to the connector 20E. The tongue 30E has a lower protrusion 300E which is received in the lower recess 400E of the connector 20E. An inner curved wall 302E is formed at the inside of the lower protrusion 300E and faces the slot 72E. A first stepped portion 34E is formed between the tongue top face 31E and the inner side 330E. The first stepped portion 34E has an engaging face 341E on the top thereof. The first stepped portion 34E has a contact face 342E which faces the side of the panel 10E. A top recess 51E is formed between the tongue outer face 32E and the inner curved wall 302E of the lower protrusion 300E. A top inclined face 511E is connected between the outside of the top recess 51E and the tongue outer face 32E. An outer inclined face 512E is connected between the inside of the top recess 51E and the inner curved wall 302E.

Each of the inner curved face 302B of the lower protrusion 300B of the panel 10B, the top inclined face 511E and the outer inclined face 512E of the top recess 51E is an inclined face.

As shown in FIGS. 57 to 59, and 61, the assembling actions of the sixth embodiment of the present invention are disclosed. FIG. 57 shows that the panel 10E on the left is connected to the connector 20E, and the panel 10E on the right having the tongue 30E on the right is moved toward the connector 20E with the engaging slot 40E on the same plane with the panel 10E.

When the panel 10B contacts the connector 20B on the same plane, the outer inclined face 301B of the tongue 30B contacts the guide face 420B of the locking member 23B of the engaging slot 40B of the connector 20B.

When the panel 10E contacts the connector 20E on the same plane, the lower edge of the tongue 30E of the panel 10E contacts the guide face 420E of the locking member 23E of the connector 20E.

When the panel 10E contacts the connector 20E on the same plane, at least one side of the contact position is an inclined face or a curved face, so that the curved face guides the panel 10E to change its height relative to the side of the connector 20E. FIG. 57 shows that the panel 10E having the tongue 30E is guided by the inclined face and lifted up.

When the panel 10E having the tongue 30E is continuously moved toward the connector 20E having the engaging slot 40E, the top inclined face 511E and the outer inclined face 512E of the top recess 51E of the tongue 30E are cooperated with the guide face 420E of the locking member 23E of the tongue 20E to guide the panel 10E to be lifted up.

When the lowest point of the lower protrusion 300E of the panel 10E having the tongue 30E moves to the highest point of the locking member 23E of the connector 20E having the engaging slot 40E, the panel 10E cannot be lifted up anymore.

Figure 58:
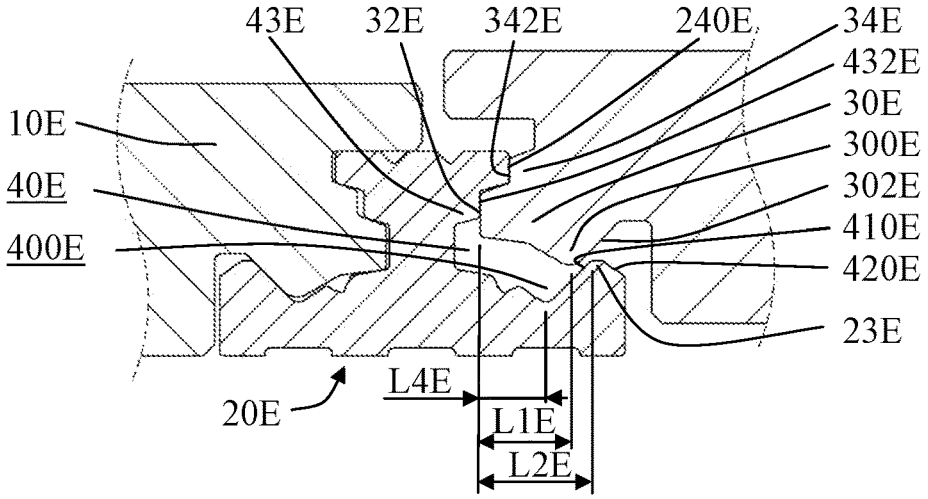

The horizontal distance L1E between a vertical extension line of the lowest point of the lower protrusion 300E of the tongue 30E of the panel 10E and a vertical extension line of the highest point of the tongue outer face 32E of the lower tongue 30E is smaller than the horizontal distance L2E between a vertical extension line of the highest point of the locking member 23E of the connector 20E and a vertical extension line of the lowest point of the contact face 432E of the first ridge 43E. As shown in FIG. 58, L1E<L2E.

When the panel 10E having the tongue 30E is continuously moved toward the connector 20E having the engaging slot 40E, the lower protrusion 300E of the tongue 30E is moved into the lower recess 400E of the engaging slot 40E of the connector 20E. The inner curved face 302E of the lower protrusion 300E of the tongue 30E contacts the curved wall 410E of the lower recess 400E of the connector 20E. The contact face 432E of the first ridge 43E of the panel 10E contacts the tongue outer face 32E of the tongue 30E, and the contact face 342E of the first stepped portion 34E contacts the side face 240E as shown in FIG. 58, so that the panel 10E with the tongue 30E cannot be moved toward the connector 20E having the engaging slot 40E on the same plane. Because of L1E<L2E, during the process of moving the panel 10E having the tongue 30E toward the connector 20E having the engaging slot 40E, when the contact face 432E of the first ridge 43E of the panel 10E contacts the tongue outer face 32E of the tongue 30E, and the contact face 342E of the first ridge 34E contacts the side face 240E of the locking piece 24E, the lower protrusion 300E of the tongue 30E is moved into the lower recess 400E of the engaging slot 40E of the connector 20E. Therefore, the connection between the panels 10E and the connector 20E can be completed by pressing the panel 10E.

FIG. 58 is used to describe the steps for moving the panels 10E toward the connector 20E. The panel 10E on the right is moved downward a little bit due to the gravity to allow the inner curved face 302E of the lower protrusion 300E of the tongue 30E to contact the curved wall 410E of the lower recess 400E of the connector 20E. Before that the contact face 432E of the first ridge 43E of the panel 10E contacts the tongue outer face 32E of the tongue 30E, and/or before the contact face 342E of the first ridge 34E contacts the side face 240E of the locking piece 24E, the panel 10E contacts the connector 20E by the inclined face which makes the movement of the panel 10E be easy without using any tool to force the panel 10E to move.

The horizontal distance L1E between a vertical extension line of the lowest point of the lower protrusion 300E of the tongue 30E of the panel 10E and a vertical extension line of the highest point of the tongue outer face 32E of the tongue 30E is larger than the horizontal distance L4E between a vertical extension line of the lowest point of the curved wall 410E of the engaging slot 40E and a vertical extension line of the lowest point of the contact face 432E of the first ridge 43E. As shown in FIG. 58, L1E>L4E.

When the panel 10E having the tongue 30E is continuously moved toward the connector 20E having the engaging slot 40E, and the tongue outer face 32E of the tongue 30E contacts the contact face 432E of the first ridge 43E, and/or the contact face 342B of the first stepped portion 34B of the panel 10E contacts the side face 240E of the connector 20E, the lower protrusion 300E of the tongue 30E is moved into the lower recess 400E of the engaging slot 40E of the connector 20E as shown in FIG. 58. Because of L1E>L4E, the lowest point of the lower protrusion 300E of the tongue 30E is not yet in contact with the lowest point of the curved wall 410E of the top recess 51E. Therefore, the connection between the panels 10E and the connector 20E can be completed by pressing the panel 10E.

Figure 59:
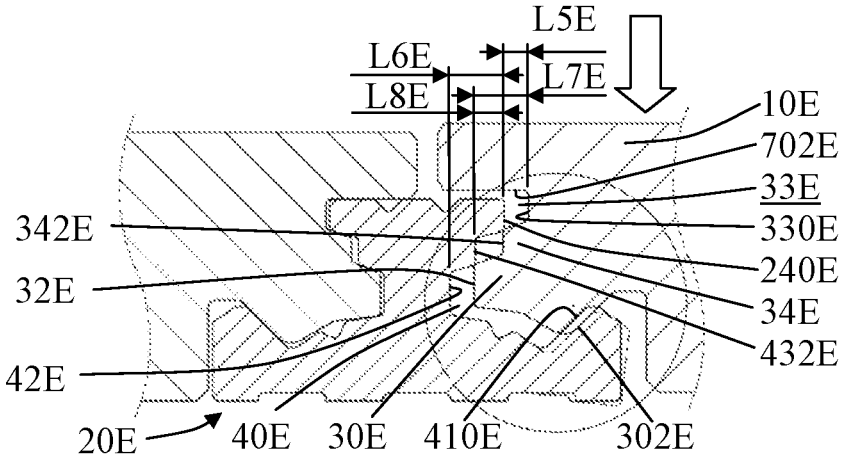

The horizontal distance L5E between a vertical extension line of the inner side 330E of the panel 10E and the vertical line of the outside of the contact face 342E of the first stepped portion 34E is smaller than the horizontal distance L6E between a vertical extension line of the outside of the side face 240E of the engaging slot 40E of the connector 20E and the vertical line of the highest point of the inside wall 42E of the engaging slot 40E. As shown in FIG. 59, L5E<L6E.

The horizontal distance L7E between a vertical extension line of the inner side 330E of the panel 10E and the vertical line of highest point of the tongue outer face 32E is larger than the horizontal distance L8E between a vertical extension line of an outside of the side face 240E of the connector 20E and the vertical line of the lowest point of the contact wall 432E of the first ridge 43E. As shown in FIG. 59, L7E>L8E.

By pressing the lifted portion of the panel 10E at the contact portion between the panel 10E and the connector 20E as shown by the arrow head in FIG. 59, the contact face 32E of the tongue 30E contacts the contact face 432E of the first ridge 43E, and the contact face 342E of the first stepped portion 34E contacts the side face 240E, so that the panel 10E and the connector 20E cannot be moved toward on the same plane. The inner curved face 302E of the lower protrusion 300E of the tongue 30E pushes the curved wall 410E of the engaging slot 40E to deform the material below the engaging slot 40E such that the tongue 30E is able to move downward and into the engaging slot 40E.

Figure 60:
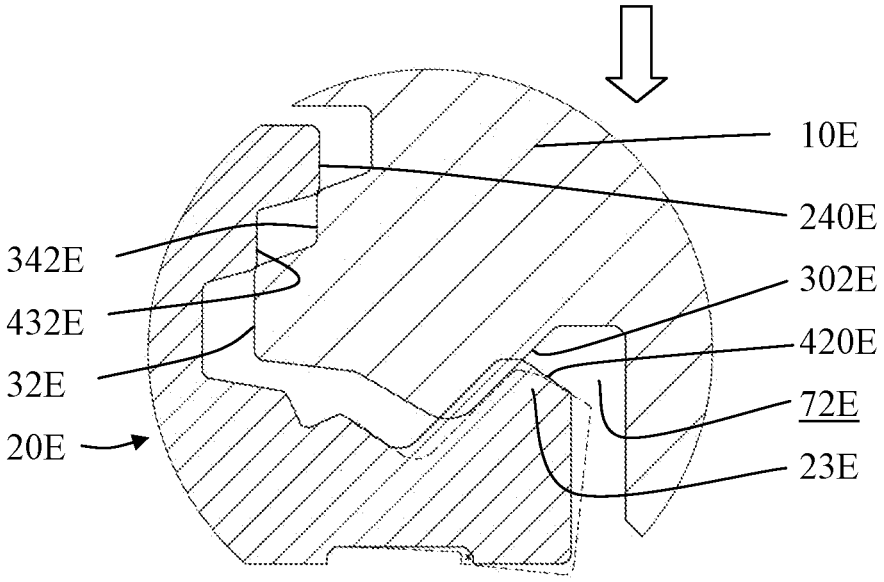
Figure 61:
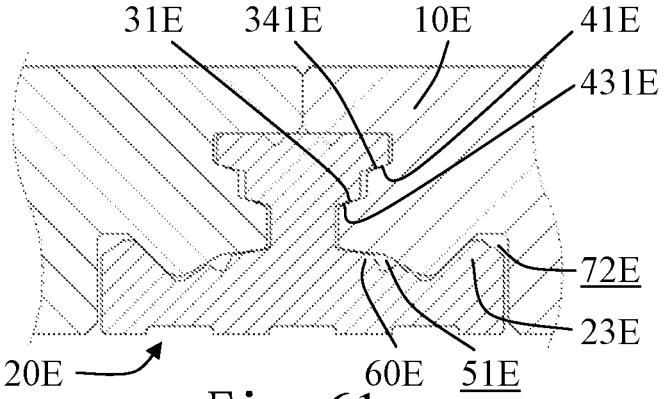

As shown in FIG. 59, when the panel 10E with the tongue 30E is pressed downward, the material below the engaging slot 40E is deformed which is shown by the dotted line and the solid line in FIG. 60. When the material below the engaging slot 40E is deformed to allow the tongue 30E to move downward relative to the engaging slot 40E, the tongue outer 32E of the tongue 30E is offset from contact face 432E of the first ridge 43E of the engaging slot 40E, and the contact face 342E of the first stepped portion 34E is offset from the side face 240E, the lower protrusion 300E of the tongue 30E is engaged with the lower recess 400E of the engaging slot 40E by the guidance of the inner curved face 302E of the lower protrusion 300E and the curved wall 410E of the engaging slot 40E. The top bump 60E is engaged with the top recess 51E of the tongue 30E. The locking member 23E is locked in the slot 72E. The material below the engaging slot 40E bounces back by the natural flexibility thereof, the engaging face 341E of the first stepped portion 34E contacts the underside of the top wall 41E of the locking piece 24E. The tongue top face 31E of the tongue 30E contacts the underside of the engaging face 431E of the first ridge 43E. The tongue 30E is then engaged with the engaging slot 40E so that the panel 10E does not disengaged from the connector 20E as shown in FIG. 61.

The tongue top face 31E of the tongue 30E contacts the engaging face 431E of the first ridge 43E. The engaging face 341E of the first stepped portion 34E of the tongue 30E contacts the top wall 41E of the locking piece 24E. The locking member 23E is engaged with the slot 72E. The inner curved face 302E of the lower protrusion 300E of the tongue 30E contacts the curved wall 410E of the engaging slot 40E. The tongue 30E is engaged with the engaging slot 40E because that the material below the engaging slot 40E is deformed. After the tongue 30E is engaged with the engaging slot 40E, the material below the engaging slot 40E returns to its initial status, the distance between the outside of the outside of the engaging face 341E of the first stepped portion 34E and any point of the contact area between the curved wall 410E and the inner curved face 302E is larger than the distance between the intersection point between the engaging face 431E of the first ridge 43E of the engaging slot 40E and the contact face 432E to the correspondent contact portion of the curved wall 410E. The tongue 30E of the second embodiment cannot be engaged with the engaging slot 40E if the material below the engaging slot 40E is not deformed, so that the tongue 30E is securely connected with the engaging slot 40E.

Figure 62:
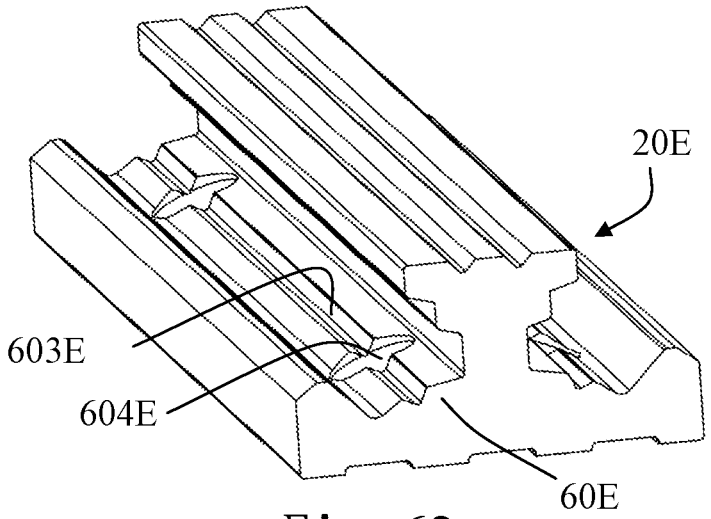
FIG. 62 is a perspective view to show the sixth embodiment of the connector of the present invention.
Figure 63:
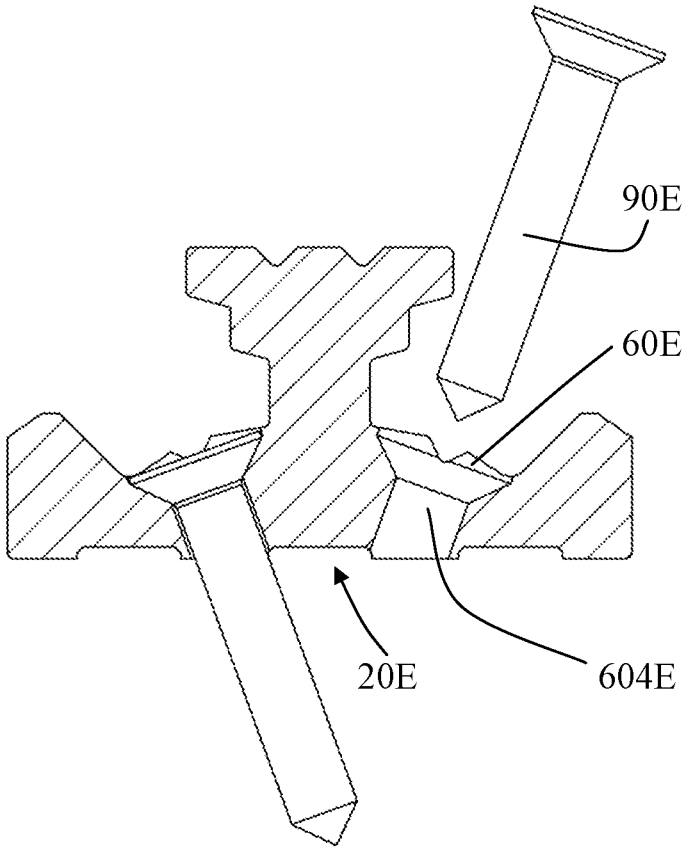
FIG. 63 shows the connector of the sixth embodiment of the present invention is secured by nails.

FIG. 62 shows that holes 604E are drilled in the top bump 60E of the connector 20E as needed, the holes 604E are drilled at the portions where the notch 603E is located. When drilling the holes 604E, the drill is easily guided to the notch 603E to easily drill the holes 604E. As shown in FIG. 63, the holes 604E are drilled for securing the connector 10E. The heads of the nails 90E are accommodated in the top bump 60E when the nails 90E are nailed.

Figure 64:
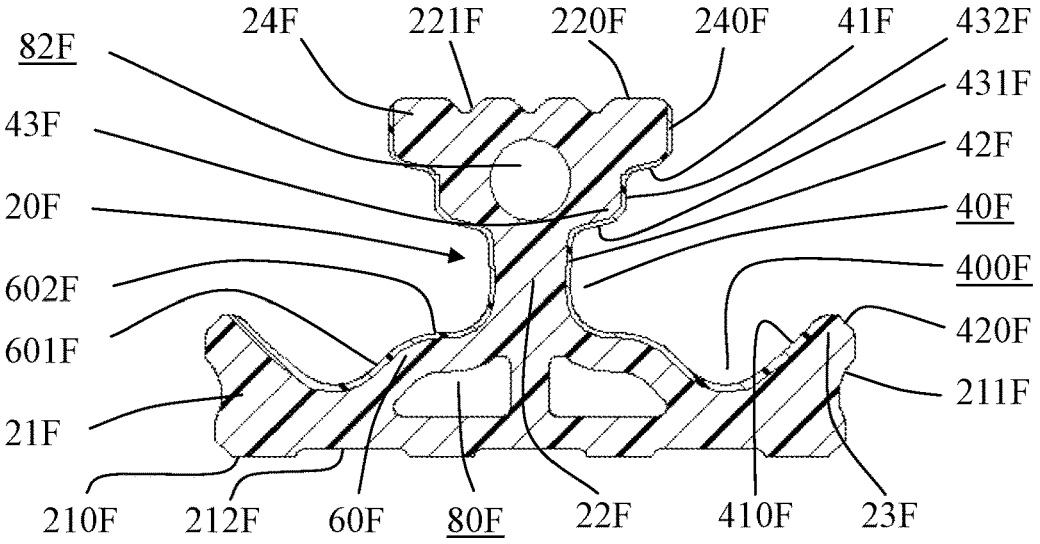
FIG. 64 is an end cross sectional view of the seventh embodiment of the connector of the present invention.

For the seventh embodiment, as shown in FIG. 64, the connector 20F for being connected with the panels 10F is the same as the connector 20D' in FIG. 49, and the connector 20F comprises a base board 21F and an upright portion 22F extends from the base board 21F. The base board 21F has a bottom face 210F and two side faces 211F. The base board 21F of the connector 20F has a locking member 23F on the top of each of the two sides thereof. A locking piece 24F extends laterally from each of two sides of the upright portion 22F. The locking pieces 24F each have a side face 240F. The upright portion 22F has a top face 220F. In this embodiment, there are three grooves 221F defined in the top face 220F. An engaging slot 40F is defined between the locking piece 24F of the upright portion 22F and the locking member 23F of the base board 21F. The engaging slot 40F defines a top wall 41F in the bottom of the locking piece 24F. The upright portion 22F has an inside wall 42F formed in each of two sides thereof. The base board 21F has a lower recess 400F defined in the top face of each of two sides thereof. The locking member 23F is located between the lower recess 400F and the side face 211F. The locking member 23F has a wedge-shaped cross section. The lower recess 400F has an curved wall 410F formed at the inside thereof and facing the locking member 23F. A first ridge 43F extends between the top wall 41F and the inside wall 42F, the first ridge 43F has an engaging face 431F at the underside thereof, and a contact face 432F is formed on a side of the first ridge 43F. A top bump 60F is formed between the inside wall 42F and the curved wall 410F of the lower recess 400F. A side inclined face 601F is connected between the outside of the top bump 60F and the curved wall 410F of the lower recess 400F. A top curved face 602F is defined between the top of the top bump 60F and the inside wall 42F.

The distance between the side faces 240F of the two locking pieces 24F of the upright portion 22F of the connector 20F is smaller than that between the side faces 211F of the base board 21F.

An inclined guide face 420F is formed on the outside of the locking member 23F and located between the highest point of the locking member 23F and the side face 211F.

Three grooves 212F are defined in the bottom face 210F of the base board 21F and located along the longitudinal direction of the panel 20F.

The side faces 211F of the base board 21F of the connector 20F are two recessed walls which save the use of material and also increase flexibility of the locking member 23F of the base board 21F.

An inclined face is connected between the side face 240F of the locking piece 24F of the connector 20F and the top face 220F.

An inclined face is connected between the side face 240F of the locking piece 24F of the connector 20F and the top wall 41F.

An inclined face is connected between the engaging face 431F of the first ridge 43F of the connector 20F and the contact face 432F.

The connector 20F is made by plastic and a space 80F is defined between the base board 21F of the connector 20F and the upright portion 22F, another space 82F is defined between the upright portion 22F and the locking piece 24F. The two spaces 80F, 82F save the use of material and make the connector 20F be light in weight.

A buffering layer is attached to the surface of the engaging slot 40F of the connector 20F, and the buffering layer is also attached on the surface of each of the curved wall 410F, the side inclined face 601F, the top curved face 602F, the inside wall 42F, the engaging face 431F and the top wall 41F. Besides, the buffering layer is also attached on the surface of the side face 240F of the locking piece 24F. The buffering layer is made by the material that is softer than that of the connector 20F so that the connector 20F is able to be deformed as desired when the panel 10F is connected with the connector 20F. After the panels 10F are connected with the connector 20F, the buffering layer provides a buffering feature between the panels 10F and the connector 20F to reduce the friction between the panels 10F and the connector 20F to solve the problems of shrinking and expanding due to change of temperature or the problems of shifting due to pushing to generate noise.

The buffering layer is made by soft material so that the buffering layer can be made with the connector 20F by way of double-layer extruding.

Figure 65:
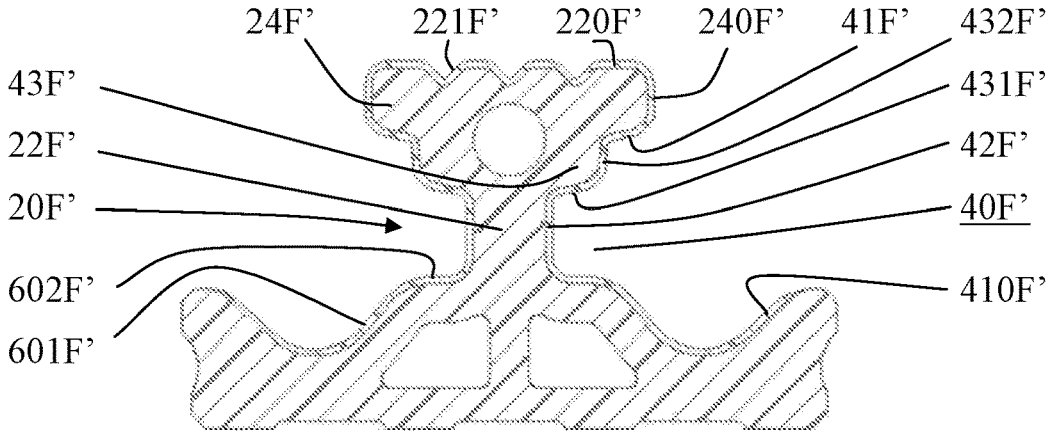
FIG. 65 is an end cross sectional view to show another embodiment of the connector based on the seventh embodiment of the present invention.

FIG. 65 discloses another embodiment which is based on the seventh embodiment, wherein the connector 20F' is the same as the connector 20F disclosed in the FIG. 64, the only difference is that the buffering layer on the surface of the engaging slot 40F' is also attached on the surface of each of the curved wall 410F', the side inclined face 601F', the top curved face 602F', the inside wall 42F', the engaging face 431F', contact face 432F', the top wall 41F' and the side face 240F'. Furthermore, the buffering layer is attached on the surface of each of the top face 220F' of the upright portion 22F' and the groove 221F' of the top face 220F'.

Figure 66:
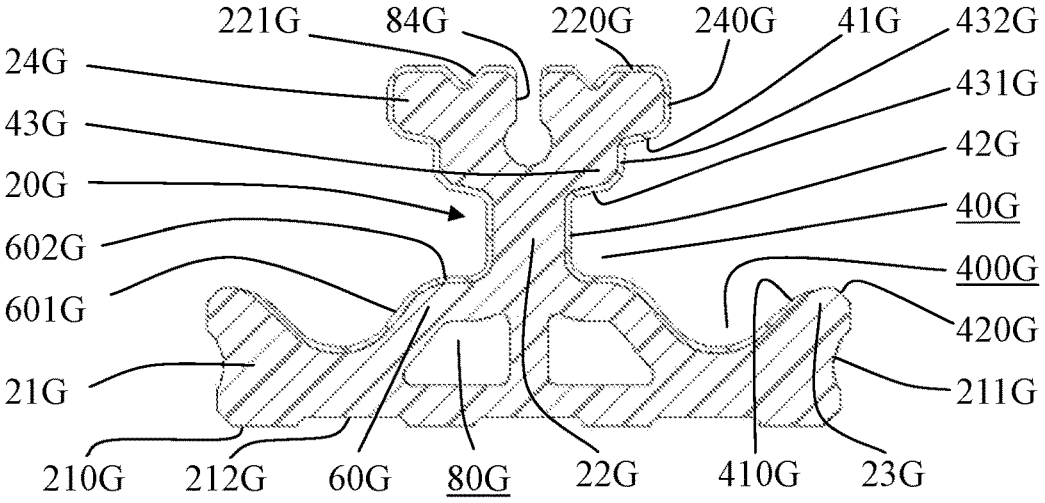
FIG. 66 is an end cross sectional view of the eighth embodiment of the connector of the present invention.

FIG. 66 discloses the eighth embodiment, wherein the connector 20G basically the same as the connector 20F' in FIG. 65, and comprises a base board 21G and an upright portion 22G extends from the base board 21G. The base board 21G has a bottom face 210G and two side faces 211G. The base board 21G of the connector 20G has a locking member 23G on the top of each of the two sides thereof. A locking piece 24G extends laterally from each of two sides of the upright portion 22G. The locking pieces 24G each have a side face 240G. The upright portion 22G has a top face 220G. In this embodiment, there are two grooves 221G defined in the top face 220G. An engaging slot 40G is defined between the locking piece 24G of the upright portion 22G and the locking member 23G of the base board 21G. The engaging slot 40G defines a top wall 41G in the bottom of the locking piece 24G. The upright portion 22G has an inside wall 42G formed in each of two sides thereof. The base board 21G has a lower recess 400G defined in the top face of each of two sides thereof. The locking member 23G is located between the lower recess 400G and the side face 211G. The locking member 23G has a wedge-shaped cross section. The lower recess 400G has an curved wall 410G formed at the inside thereof and facing the locking member 23G. A first ridge 43G extends between the top wall 41G and the inside wall 42G, the first ridge 43G has an engaging face 431G at the underside thereof, and a contact face 432G is formed on a side of the first ridge 43G. A top bump 60G is formed between the inside wall 42G and the curved wall 410G of the lower recess 400G. A side inclined face 601G is connected between the outside of the top bump 60G and the curved wall 410G of the lower recess 400G. A top curved face 602G is defined between the top of the top bump 60G and the inside wall 42G.

The distance between the side faces 240G of the two locking pieces 24G of the upright portion 22G of the connector 20G is smaller than that between the side faces 211G of the base board 21G.

An inclined guide face 420G is formed on the outside of the locking member 23G and located between the highest point of the locking member 23G and the side face 211G.

Three grooves 212G are defined in the bottom face 210G of the base board 21G and located along the longitudinal direction of the panel 20G.

The side faces 211G of the base board 21G of the connector 20G are two recessed walls which save the use of material and also increase flexibility of the locking member 23G of the base board 21G.

An inclined face is connected between the side face 240G of the locking piece 24G of the connector 20G and the top face 220G.

An inclined face is connected between the side face 240G of the locking piece 24G of the connector 20G and the top wall 41G.

An inclined face is connected between the engaging face 431G of the first ridge 43G of the connector 20G and the contact face 432G.

The connector 20G is made by plastic and a space 80G is defined between the base board 21G of the connector 20G and the upright portion 22G. The space 80G saves the use of material and make the connector 20G be light in weight.

The top face 220G of the upright portion 22G of the connector 20G has a central groove 84G which allows the locking piece 24G and the first ridge 43G to be resiliently deformed. The central groove 84G is designed to increase the flexibility of the locking piece 24G and the first ridge 43G, so that when the tongue is engaged with the engaging slot 40G of the connector 20G, the material under the engaging slot 40 is deformed, and the locking piece 24G and the first ridge 43G are also deformed. This make the connection between the panels and the connector 20G be easy and convenient. The central groove 84G also saves the use of material of the connector 20G to decrease the weight of the connector 20G.

A buffering layer is attached to the surface of the engaging slot 40G of the connector 20G, and the buffering layer is also attached on the surface of each of the curved wall 410G, the side inclined face 601G, the top curved face 602G, the inside wall 42G, the engaging face 431G, the contact face 432G, the top wall 41G, the side face 240G and the top face 220G of the upright portion 22G. Besides, the buffering layer is attached to the surface of the groove 221G of the top face 220G The buffering layer is made by the material that is softer than that of the connector 20G so that the connector 20G is able to be deformed as desired when the panel 10G is connected with the connector 20G. After the panels 10G are connected with the connector 20G, the buffering layer provides a buffering feature between the panels 10G and the connector 20G to reduce the friction between the panels 10G and the connector 20G to solve the problems of shrinking and expanding due to change of temperature or the problems of shifting due to pushing to generate noise.

The buffering layer is made by soft material so that the buffering layer can be made with the connector 20G by way of double-layer extruding.

Figure 67:
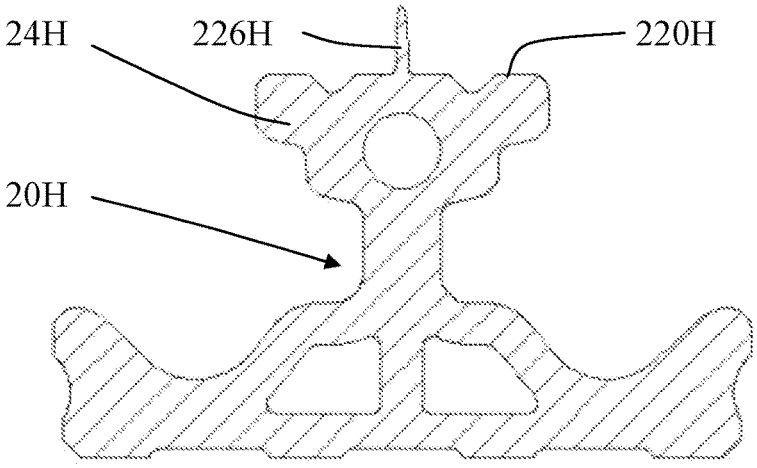
FIG. 67 is an end cross sectional view of the ninth embodiment of the connector of the present invention.
Figure 68:
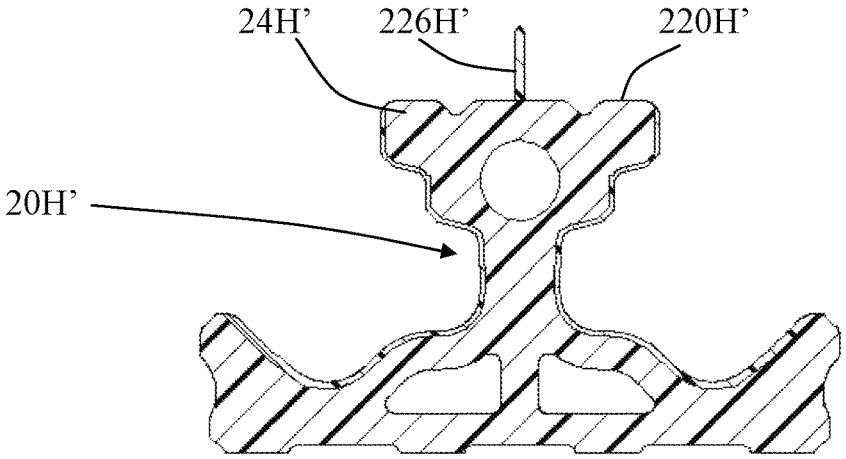
FIG. 68 is an end cross sectional view to show another embodiment of the connector based on the ninth embodiment of the present invention.
Figure 69:
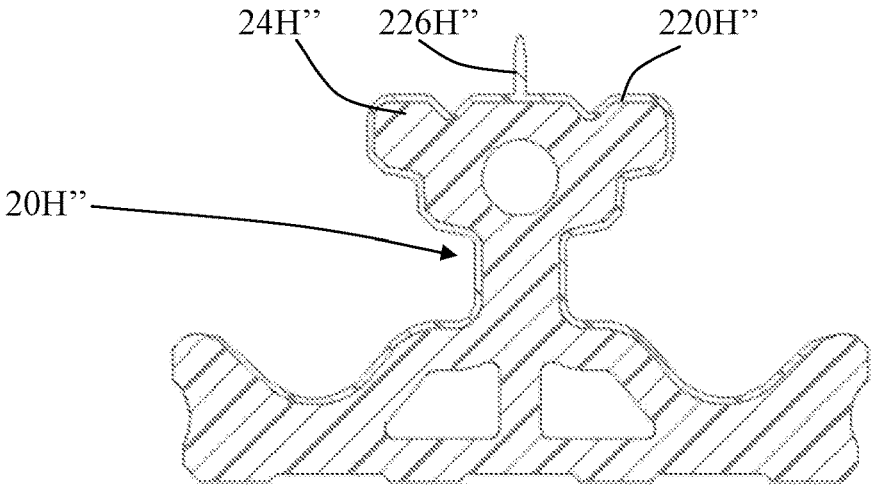
FIG. 69 is an end cross sectional view to show yet another embodiment of the connector based on the ninth embodiment of the present invention.

For the ninth embodiment, FIG. 67 shows the embodiment based on the embodiment disclosed in FIG. 49, FIG. 68 shows the embodiment based on the embodiment disclosed in FIG. 64, and FIG. 69 shows the embodiment based on the embodiment disclosed in FIG. 65.

As shown in FIG. 67, the top face 220H of the locking piece 24H of the connector 20H has a buffering plate 226H extending from the center thereof.

As shown in FIG. 68, the top face 220H' of the locking piece 24H' of the connector 20H' has a buffering plate 226H' extending from the center thereof.

As shown in FIG. 69, the top face 220H" of the locking piece 24H" of the connector 20H" has a buffering plate 226H" extending from the center thereof.

Taken the embodiment in FIG. 69 as an example, the connector 20H" basically the same as that in the FIG. 65, the difference is that the top face 220H" of the locking piece 24H" of the connector 20H" has a buffering plate 226H" extending from the center thereof. The buffering plate 226H" is made by the material that is softer than the material of the connector 20H' so that the buffering plate 226H" can be made with the connector 20G by way of double-layer extruding.

When the connection 20H" is connected with the panels on two sides of the connector 20H", the buffering plate 226H" is clamped between the top protrusions of the two panels to provide a separation between the top protrusions of the two panels. The buffering plate 226H" fills the space between the top protrusions of the two panels, and also ensures that there will be no noise generated due to friction between the top protrusions of the two panels.

Figure 70:
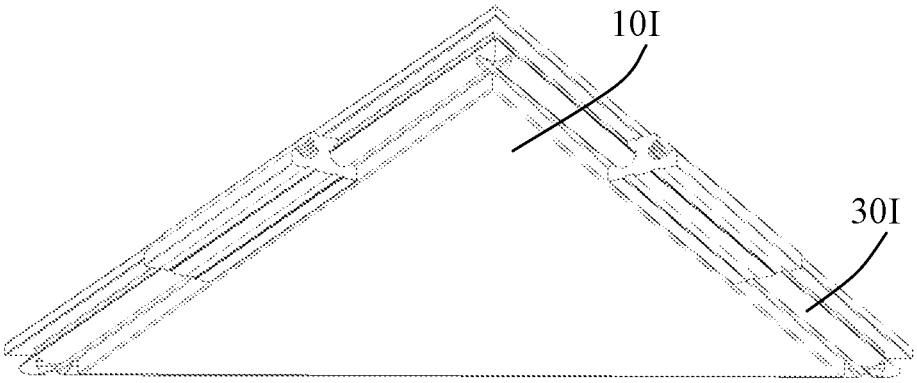
FIG. 70 is a perspective view of the tenth embodiment of the panel of the present invention.
Figure 71:
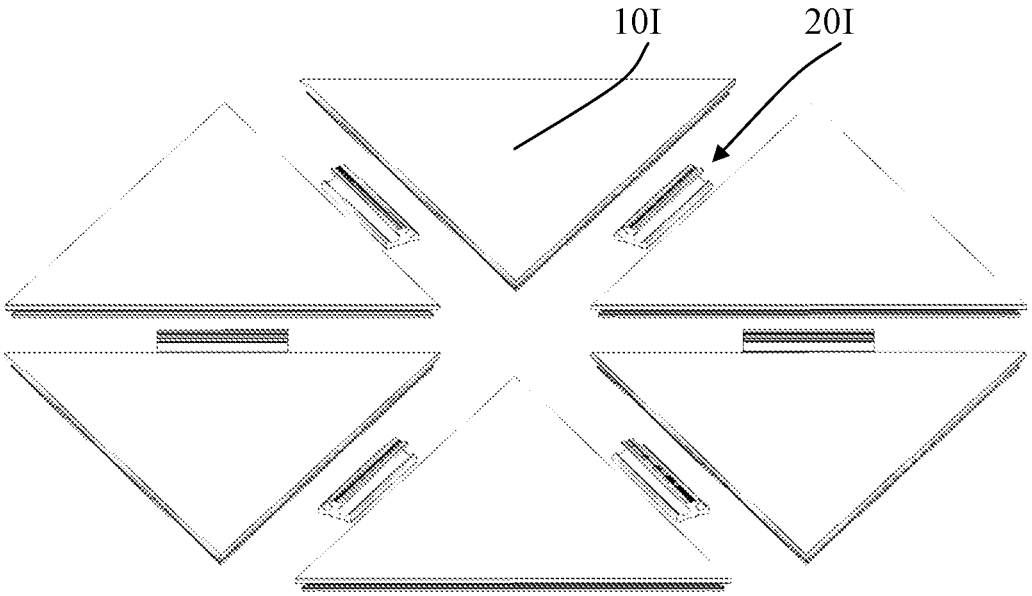
FIG. 71 show the panels and the connectors of the tenth embodiment of the present invention.
Figure 72:
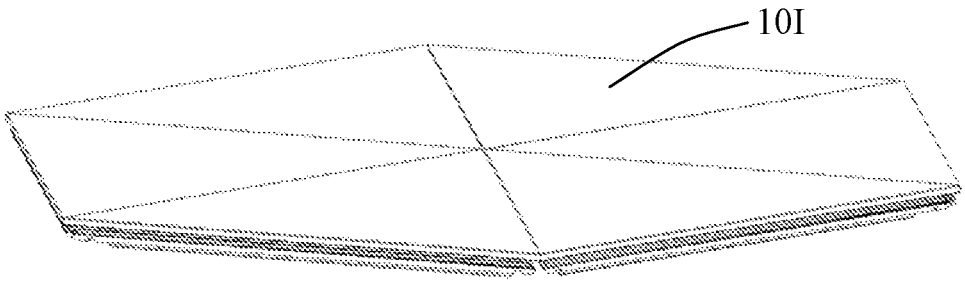
FIG. 72 shows the finished combination of the panels and connectors of the tenth embodiment in FIG. 70 of the present invention.

For the tenth embodiment, FIG. 70 discloses the panel 10I which is a triangular panel which has a first surface, a second surface which is located opposite to the first surface, and three sides, wherein at least two of the three sides has a tongue 301. As shown in FIG. 71, the panels 10I are cooperated with the connectors 201 to be arranged to form a specific pattern. When connecting the panels 10I, the panels 10I do not need to lift one side thereof so that the pattern as disclosed in FIG. 72 can be made.

In the tenth embodiment, the panels 10*i* and the connector 20*i* ca be cooperated with the tongues and engaging slots of the multiple embodiments described above to achieve the purpose of the present invention.

Figure 73:
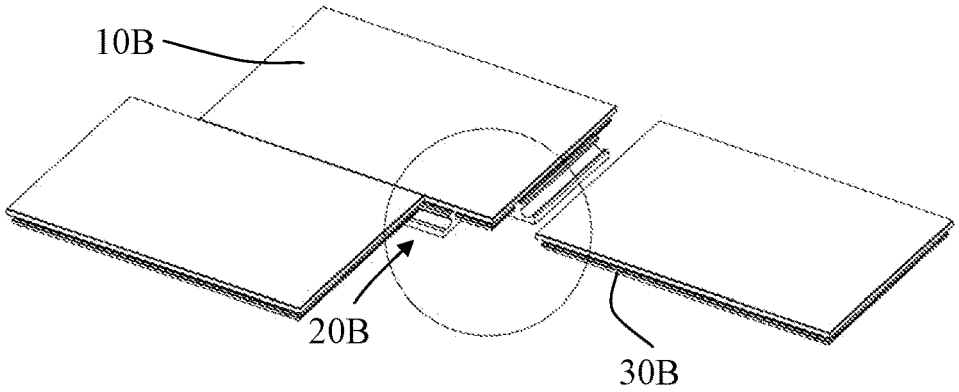
FIG. 73 show three panels are to be connected to each other.
Figure 74:
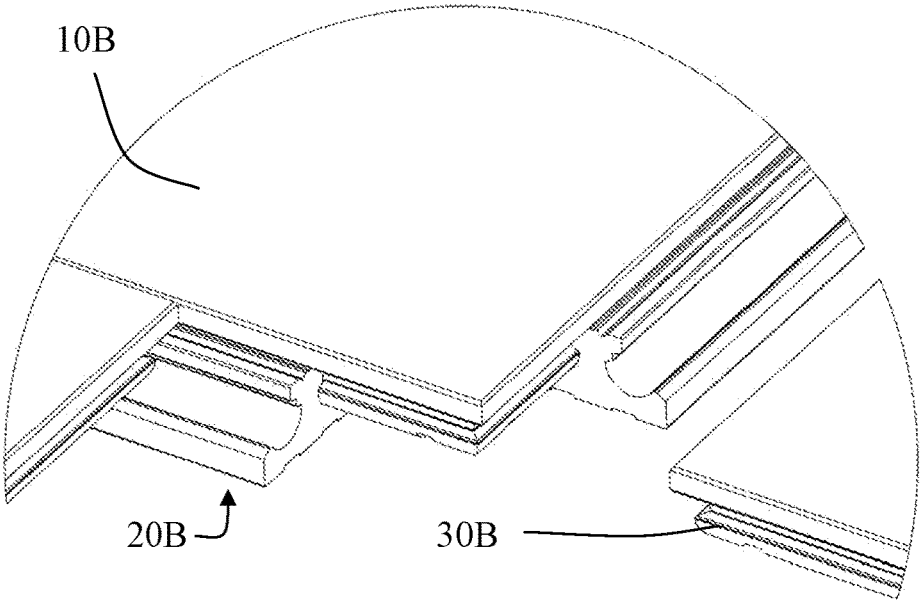
FIG. 74 is an enlarged view of the circled portion in FIG. 73.

FIGS. 73 and 74 show the panels are connected to each other, wherein the third embodiment is taken as an example to describe. Because the panels 10B and the connectors 20B are connected to each other by way of pressing, so that the connector 30B are respectively located on the four sides of the panels, and the panels 20B are easily connected to each other by the connectors 30B.

Figure 75:
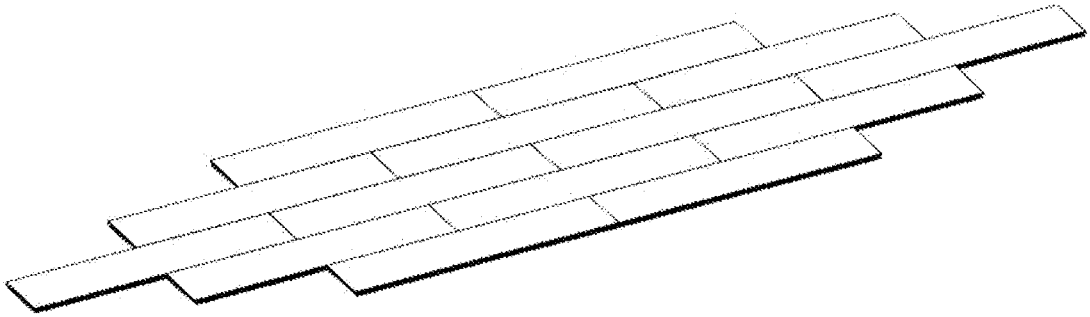
FIG. 75 shows multiple elongate panels are connected longitudinally to each other.
Figure 76:
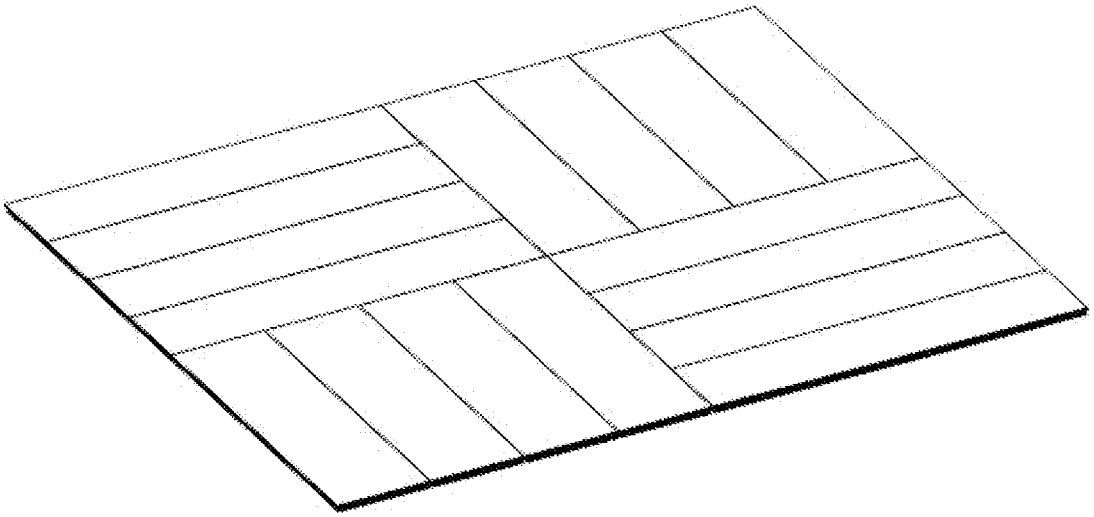
FIG. 76 shows that four unit composed of four elongate panels are connected to each other to form a square combination.
Figure 77:
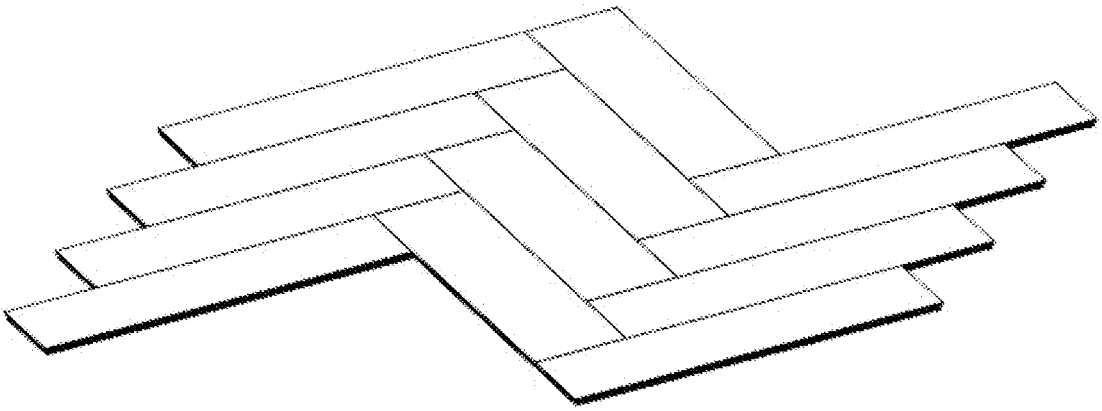
FIG. 77 shows that multiple panels are connected to each other to form a transverse S shape combination.

FIG. 75 shows the elongate panels are connected to each other along the longitudinal direction thereof. FIG. 76 shows that four elongate panels are connected to each other to form a unit, and four units are composed to form a square combination. FIG. 77 shows that multiple panels are connected to each other to form a transverse S shape combination. Because the panels are connected to the connectors of the present invention by way of pressing, the tongues of the panels are engaged with the engaging slots of the connectors without lifting one side of the panels, so that the panels can be connected to each other in different ratios of the length-and-width to form desired patterns and shapes.

While we have shown and described the embodiment in accordance with the present invention, it should be clear to those skilled in the art that further embodiments may be made without departing from the scope of the present invention.

The invention claimed is:

1. A flooring system having a connector provided with a base, an upright portion extending from the base, two locking pieces each oppositely relative to one another extending from a distal free end of the upright portion and at least two panels engageably connected to the connector to sandwich the connector therebetween, wherein the improvements comprise:

each of the at least two panels have a tongue extending out from a side thereof;

the connector has an engaging slot defined between the base and each one of the two locking pieces and expandably receiving therein the tongue so as to firmly secure the tongue inside the engaging slot; and a stop mechanism provided to initiating expansion of the engaging slot so as to allow the expansion of the engaging slot to allow the tongue to slide into the engaging slot and then recover to its initial dimension to securely receive the tongue inside the engaging slot.

2. The flooring system as claimed in claim 1, wherein the stop mechanism comprises:

a first step formed on a side face of each one of the at least two panels and a side face formed on a side of the two locking pieces of the connector to engageably connect to the first step to stop lateral movement of the at least two panels and to initiate downward movement of the at least two panels relative to the connector as well as the expansion of the engaging slot.

3. The flooring system as claimed in claim 2, wherein the connector further has a locking member formed on two opposite sides of the base and each of the at least two panels have a slot defined in an underside forming the tongue to receive therein a corresponding one of the locking member when the at least two panels are laterally moved toward the connector relative to one another.

4. The flooring system as claimed in claim 3, wherein the locking member has a curved face formed on a highest point of the locking member and the tongue has a lower protrusion with a curved outer periphery to correspond to and engageably connect to the curved face of the locking member such that when the tongue is extended into the engaging slot, engagement between the curved face of the locking member and the curved periphery of the lower protrusion of the tongue facilitates the extension of the tongue into the engaging slot.

5. The flooring system as claimed in claim 1, wherein the stop mechanism has:

a first step formed on a side face of each one of the at least two panels and a second step formed on a side of the two locking pieces of the connector to engageably connect to the first step to stop lateral movement of the at least two panels and to initiate downward movement of the at least two panels relative to the connector as well as the expansion of the engaging slot.

6. The flooring system as claimed in claim 5, wherein the connector further has a locking member formed on two opposite sides of the base and each of the at least two panels have a slot defined in an underside forming the tongue to receive therein a corresponding one of the locking member when the at least two panels are laterally moved toward the connector relative to one another.

7. The flooring system as claimed in claim 6, wherein the locking member has a curved face formed on a highest point of the locking member and the tongue has a lower protrusion with a curved outer periphery to correspond to and engageably connect to the curved face of the locking member such that when the tongue is extended into the engaging slot, engagement between the curved face of the locking member and the curved periphery of the lower protrusion of the tongue facilitates the extension of the tongue into the engaging slot.

8. The flooring system as claimed in claim 1, wherein the connector further has a locking member formed on two opposite sides of the base and each of the at least two panels have a slot defined in an underside forming the tongue to receive therein a corresponding one of the locking member when the at least two panels are laterally moved toward the connector relative to one another.

9. The flooring system as claimed in claim 8, wherein the connector further has a locking member formed on two opposite sides of the base and each of the at least two panels have a slot defined in an underside forming the tongue to receive therein a corresponding one of the locking member when the at least two panels are laterally moved toward the connector relative to one another.

10. The flooring system as claimed in claim 9, wherein the locking member has a curved face formed on a highest point of the locking member and the tongue has a lower protrusion with a curved outer periphery to correspond to and engageably connect to the curved face of the locking member such that when the tongue is extended into the engaging slot, engagement between the curved face of the locking member and the curved periphery of the lower protrusion of the tongue facilitates the extension of the tongue into the engaging slot.

11. The flooring system as claimed in claim 8, wherein the locking member has a curved face formed on a highest point of the locking member and the tongue has a lower protrusion with a curved outer periphery to correspond to and engageably connect to the curved face of the locking member such that when the tongue is extended into the engaging slot, engagement between the curved face of the locking member and the curved periphery of the lower protrusion of the tongue facilitates the extension of the tongue into the engaging slot.

* * * * *